US011457716B2

(12) United States Patent
Kase et al.

(10) Patent No.: US 11,457,716 B2
(45) Date of Patent: Oct. 4, 2022

(54) COMPACT CONTAINER

(71) Applicant: YOSHINO KOGYOSHO CO., LTD., Tokyo (JP)

(72) Inventors: Mai Kase, Tokyo (JP); Kazuo Suzuki, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 475 days.

(21) Appl. No.: 16/498,166

(22) PCT Filed: Mar. 30, 2018

(86) PCT No.: PCT/JP2018/013786
§ 371 (c)(1),
(2) Date: Sep. 26, 2019

(87) PCT Pub. No.: WO2018/181965
PCT Pub. Date: Oct. 4, 2018

(65) Prior Publication Data

US 2020/0029673 A1 Jan. 30, 2020

(30) Foreign Application Priority Data

Mar. 30, 2017 (JP) ..... JP2017-066608
Aug. 31, 2017 (JP) ..... JP2017-167873
(Continued)

(51) Int. Cl.
*A45D 33/00* (2006.01)
*A45D 33/24* (2006.01)
*A45D 33/02* (2006.01)

(52) U.S. Cl.
CPC ..... *A45D 33/24* (2013.01); *A45D 33/025* (2013.01); *A45D 2200/056* (2013.01)

(58) Field of Classification Search
CPC .... A45D 33/00; A45D 33/003; A45D 33/005; A45D 33/006; A45D 33/02;
(Continued)

(56) References Cited

U.S. PATENT DOCUMENTS 4,844,299 A 7/1989 Sekiguchi et al.
5,301,850 A 4/1994 Gueret
(Continued)

FOREIGN PATENT DOCUMENTS

CN 1230907 A 10/1999
CN 202890958 U 4/2013
(Continued)

OTHER PUBLICATIONS

Dec. 7, 2020 Extended Search Report issued in European Patent Application No. 18778175.2.
(Continued)

*Primary Examiner* — Rachel R Steitz
(74) *Attorney, Agent, or Firm* — Oliff PLC

(57) ABSTRACT

A compact container is the adjustment of a discharge amount of contents is easy. A compact container includes an inner container; an inner lid in which a communication hole is formed; a middle lid in which a discharge hole is formed; a first valve body; and a second valve body. When the inner pressure of the communication space is increased by the operation portion, the first valve body blocks communication between the communication hole and the communication space and the second valve body allows the discharge hole and the communication space to communicate with each other. When the inner pressure of the communication space is reduced by the operation portion, the second valve body blocks communication between the discharge hole and
(Continued)

the communication space and the first valve body allows the communication hole and the communication space to communicate with each other.

3 Claims, 18 Drawing Sheets

(30) Foreign Application Priority Data

Oct. 31, 2017 (JP) ..... JP2017-211264
Oct. 31, 2017 (JP) ..... JP2017-211265
Feb. 28, 2018 (JP) ..... JP2018-034924

(58) Field of Classification Search
CPC ..... A45D 33/025; A45D 33/04; A45D 33/22; A45D 33/24; A45D 40/0068; A45D 40/0075; A45D 2200/056
See application file for complete search history.

(56) References Cited

U.S. PATENT DOCUMENTS

| | | | |
|---|---|---|---|
| 6,406,207 | B1 | 6/2002 | Wiegner et al. |
| 2013/0058704 | A1 | 3/2013 | Yamada et al. |

FOREIGN PATENT DOCUMENTS

| | | | |
|---|---|---|---|
| CN | 104254263 | A | 12/2014 |
| CN | 105102338 | A | 11/2015 |
| CN | 106102511 | A | 11/2016 |
| CN | 106175032 | A | 12/2016 |
| EP | 0 549 049 | A1 | 6/1993 |
| JP | S60-192708 | U | 12/1985 |
| JP | H01-079408 | U | 5/1989 |
| JP | H01-101426 | U | 7/1989 |
| JP | H07-054125 | Y2 | 12/1995 |
| JP | 2003-093145 | A | 4/2003 |
| JP | 2003-205961 | A | 7/2003 |
| JP | 2011-116424 | A | 6/2011 |
| JP | 2011-225279 | A | 11/2011 |
| JP | 2016-534761 | A | 11/2016 |
| KR | 101627227 | B1 | 6/2016 |
| KR | 101663927 | B1 | 10/2016 |
| KR | 10-2017-0016561 | A | 2/2017 |
| WO | 2016/036228 | A1 | 3/2016 |

OTHER PUBLICATIONS

Apr. 6, 2021 Office Action issued in Japanese Patent Application No. 2017-167873.

Jul. 3, 2018 International Search Report issued in International Patent Application No. PCT/JP2018/013786.

Aug. 4, 2021 Office Action issued in Chinese Patent Application No. 201880021341.3.

Jan. 4, 2022 Office Action issued in Japanese Patent Application No. 2017-211264.

Mar. 29, 2022 Office Action issued in Korean Patent Application No. 10-2019-7026130.

Apr. 1, 2022 Office Action issued in Chinese Patent Application No. 201880021341.3.

COMPACT CONTAINER

TECHNICAL FIELD

Cross-Reference to Related Applications

The present invention relates to a compact container. Priority is claimed on Japanese Patent Application No. 2017-066608, filed Mar. 30, 2017, No. 2017-167873, filed Aug. 31, 2017, No. 2017-211264, filed Oct. 31, 2017, No. 2017-211265, filed Oct. 31, 2017, and No. 2018-034924, filed Feb. 28, 2018, the contents of which are incorporated herein by reference.

BACKGROUND ART

A cosmetics storage container having a middle lid container which accommodates cosmetics is known (for example, refer to Patent Document 1). In the cosmetics storage container of Patent Document 1, an upper surface of the middle lid container is covered with a net. A constitution is disclosed in which cosmetics are exuded through the mesh of a net attached to an applicator by pressing the net with an applicator such as a puff.

CITATION LIST

Patent Document

[Patent Document 1]
Japanese Unexamined Patent Application, First Publication No. 2003-93145

SUMMARY OF INVENTION

Technical Problem

In the cosmetics storage container as described above, the cosmetic is exuded through the mesh of the net and discharged to the outside by pressing the net covering the middle lid container with a puff or the like. However, in this case, it is difficult to adjust a discharge amount of the cosmetic, and thus it is difficult to discharge only a desired amount of the cosmetic. For example, an amount of contents which are exuded through the mesh changes significantly according to adjustment of a force applied when the net is pressed with the applicator. Accordingly, it is not easy to attach a stable amount of contents to the applicator.

An object of the invention is to provide a compact container in which adjustment of a discharge amount of contents is easy in view of the above-described problem.

Solution to Problem

In a first aspect of a compact container of the present invention, there is provided a compact container including: an inner container in which contents are accommodated; an inner lid which seals an inside of the inner container and in which a communication hole communicating with the inner container is formed; a middle lid which is disposed above the inner lid, which defines a communication space communicating with the communication hole between the middle lid and the inner lid, and in which a discharge hole communicating with the communication space and discharging the contents is formed; a first valve body which switches between communication and blocking between the communication hole and the communication space; and a second valve body which switches between communication and blocking between the discharge hole and the communication space, wherein the middle lid includes an operation portion which defines the communication space, which is formed to be elastically deformable, and which increases or decreases an internal pressure of the communication space by being elastically deformed. In the compact container, when the internal pressure of the communication space is increased by the operation portion, the first valve body blocks communication between the communication hole and the communication space, and the second valve body allows communication between the discharge hole and the communication space. In the compact container, when the internal pressure of the communication space is reduced by the operation portion, the second valve body blocks communication between the discharge hole and the communication space, and the first valve body allows communication between the communication hole and the communication space.

According to the first aspect of the compact container of the present invention, when the internal pressure of the communication space is increased by the operation portion, the first valve body blocks the communication between the communication hole and the communication space, and the second valve body allows communication between the discharge hole and the communication space. On the other hand, when the internal pressure of the communication space is reduced by the operation portion, the second valve body blocks the communication between the discharge hole and the communication space, and the first valve body allows communication between the communication hole and the communication space. Thus, a user can cause the inside of the communication space to have a negative pressure, can cause the contents in the inner container to flow into the communication space and can fill the communication space with the contents by pressing the operation portion or releasing the pressing to elastically deform the operation portion and thus increasing or decreasing the internal pressure of the communication space. In this state, when the internal pressure of the communication space is increased by the operation portion, the contents can be discharged from the discharge hole by an amount corresponding to the increase of the internal pressure of the communication space. Therefore, according to the first aspect of the compact container of the present invention, the compact container in which adjustment of the discharge amount of the contents is easy is obtained. Further, since the middle lid includes the operation portion and the operation portion is a part of the middle lid, it is possible to curb an increase in the number of components due to providing the operation portion. Furthermore, since the operation portion defines the communication space, for example, the operation portion can be formed to be large according to a size of the communication space, and a range in which the user can operate can be expanded when the contents are discharged.

A second aspect of the compact container of the present invention is the compact container according to the first aspect in which an annular thin portion is formed on the operation portion.

In this case, the annular thin portion is formed in the operation portion. Therefore, a portion of the operation portion located inward from the thin portion can be easily elastically deformed with the thin portion as a fulcrum. Thus, it is possible to greatly increase and decrease the internal pressure of the communication space, and the adjustment of the discharge amount of the contents can be made easier.

A third aspect of the compact container of the present invention is the compact container according to the first or second aspect which further includes an outer shell which covers the inner container, the inner lid and the middle lid, and in which a volume of the inner container is reduced as the contents flow out into the communication space through the communication hole.

In this case, the volume of the inner container is reduced as the contents flow out into the communication space through the communication hole. Therefore, it is possible to raise the inner container when the contents in the inner container are reduced by discharging the contents and thus to maintain a height position of the contents, and the contents can smoothly flow out from the communication hole into the communication space. Furthermore, for example, when the inner container has been taken out of the outer shell after the contents in the inner container have been used up, it is possible to reduce the volume of the inner container in advance and to realize volume reduction at the time of disposal.

A fourth aspect of the compact container of the present invention is the compact container according to the first aspect which further includes a biasing portion which biases the operation portion that has moved downward upward.

In this case, the biasing portion which biases upward the operation portion that has moved downward is provided. Therefore, when pressing of the operation portion is released, the biasing portion stably returns the operation portion to its original position before pressing. That is, the biasing portion assists the restoration and deformation of the elastically deformed operation portion. Accordingly, the contents can be stably suctioned from the inner container into the communication space, and the discharge amount of the contents can be made as desired amount when the operation portion is pressed the next time. Thus, the adjustment of the discharge amount of the contents is easy.

Further, since the operation portion is stably returned to the position before the pressing by the biasing portion, operability of the operation portion is good. Thus, for example, even when sealability by the second valve body is secured by forming the operation portion of an elastically deformable soft material such as an elastomer, preferable restoration characteristics can be provided to the operation portion. For example, a soft material such as an elastomer or a soft polyethylene, or a material such as an elastically deformable and relatively soft polypropylene (PP), or the like may be used as a material of the operation portion.

A fifth aspect of the compact container of the present invention is the compact container according to the first aspect in which a lower surface of the operation portion is formed in a shape which protrudes upward.

In this case, the lower surface of the operation portion is formed in a shape which protrudes upward. Therefore, a deformation amount of the lower surface of the operation portion when the operation portion is pressed increases, and an upward restoring deformation force acting on the operation portion also increases when the pressing is released. Thus, the operation portion is easily restored and deformed to the shape before the elastic deformation, the amount of contents suctioned from the inner container to the communication space is stabilized, and a discharge amount of the contents when the operation portion is pressed the next time can be stabilized.

A sixth aspect of the compact container of the present invention is the compact container according to the fifth aspect in which the lower surface of the operation portion is formed in a curved surface shape which protrudes upward.

In this case, the lower surface of the operation portion is formed in a curved surface shape which protrudes upward. Thus, when the operation portion is elastically deformed, it is possible to curb a large stress from locally acting on the lower surface of the operation portion, and durability of the compact container can be improved.

A seventh aspect of the compact container of the present invention is the compact container according to the fifth or sixth aspect in which an upper surface of the operation portion is formed in a curved surface shape which protrudes upward.

In this case, the upper surface of the operation portion is formed in a curved surface shape which protrudes upward. Thus, when the operation portion is elastically deformed, it is possible to curb a large stress locally acting on the upper surface of the operation portion. Further, the upper surface of the operation portion may be formed in a smooth shape, and for example, the contents discharged from the discharge holes can be suppressed from partially remaining on the upper surface of the operation portion.

An eighth aspect of the compact container of the present invention is the compact container according to the first aspect in which the operation portion includes a bulging portion of which an upper surface bulges upward.

In this case, the upper surface of the bulging portion bulges upward. Thus, it is possible to reduce a force required to press the bulging portion to discharge the contents. For example, the contents can be discharged smoothly even when the bulging portion is pressed while the upper surface of the operation portion is softly rubbed.

A ninth aspect of the compact container of the present invention is the compact container according to the eighth aspect in which the second valve body is mounted on the middle lid.

In this case, the second valve body is mounted on the middle lid. Thus, for example, when an external force acts on the middle lid, the second valve body moving with respect to the middle cover and the discharge hole being opened unexpectedly can be curbed. Therefore, a compact container with better sealability inward from the middle lid can be obtained.

A tenth aspect of the compact container of the present invention is the compact container according to the eighth aspect in which upper and lower surfaces of the bulging portion bulge upward. In this case, the upper and lower surfaces of the operation portion bulge upward. Therefore, the operating portion can be easily restored and deformed upward.

An eleventh aspect of the compact container of the present invention is the compact container according to any one of the eighth to tenth aspects in which the upper surface of the bulging portion is formed in a curved surface shape which protrudes upward. In this case, the upper surface of the bulging portion is formed in a curved surface shape which protrudes upward. Thus, it is possible to reliably reduce the force required to press the bulging portion to discharge the contents, and for example, when the bulging portion is pressed while the upper surface of the operation portion is softly rubbed with a finger, the upper surface of the operation portion can be smoothly slid without being caught by a finger.

A twelfth aspect of the compact container of the present invention is the compact container according to any one of the eighth to eleventh aspects in which an easily deformable portion of which a length is changeable is formed on at least a part of the bulging portion. In this case, the easily deformable portion of which a length is changeable is formed on at least a part of the bulging portion. Thus, when the bulging portion is pressed, it is possible to deform the easily deformable portion so that a length thereof is changeable, and an amount of elastic deformation of the bulging portion in the vertical direction can increase without excessively increasing the pressing force.

Advantageous Effects of Invention

According to the present invention, it is possible to provide a compact container in which adjustment of a discharge amount of contents is easy.

DESCRIPTION OF EMBODIMENTS

Hereinafter, a compact container according to an embodiment of the present invention will be described with reference to the drawings. The scope of the present invention is not limited to the following embodiments and can be arbitrarily changed within the scope of the technical idea of the present invention. Further, in the following drawings, the sizes and the numbers of respective structures may be different from the scale and the number of the actual structure to make each structure readily discernible.

First Embodiment

Figure 1:
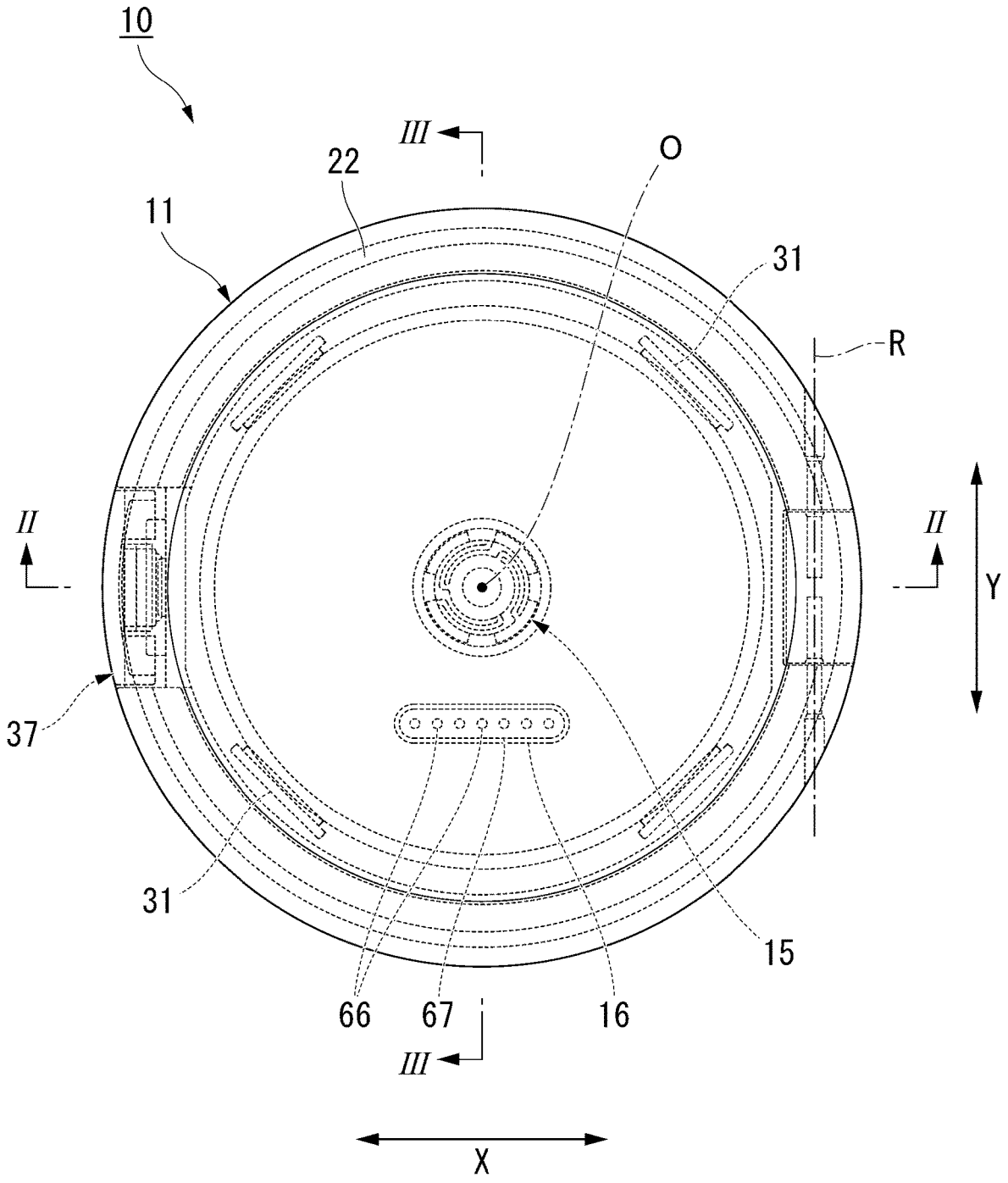
FIG. 1 is a plan view showing a compact container of a first embodiment.
Figure 2:
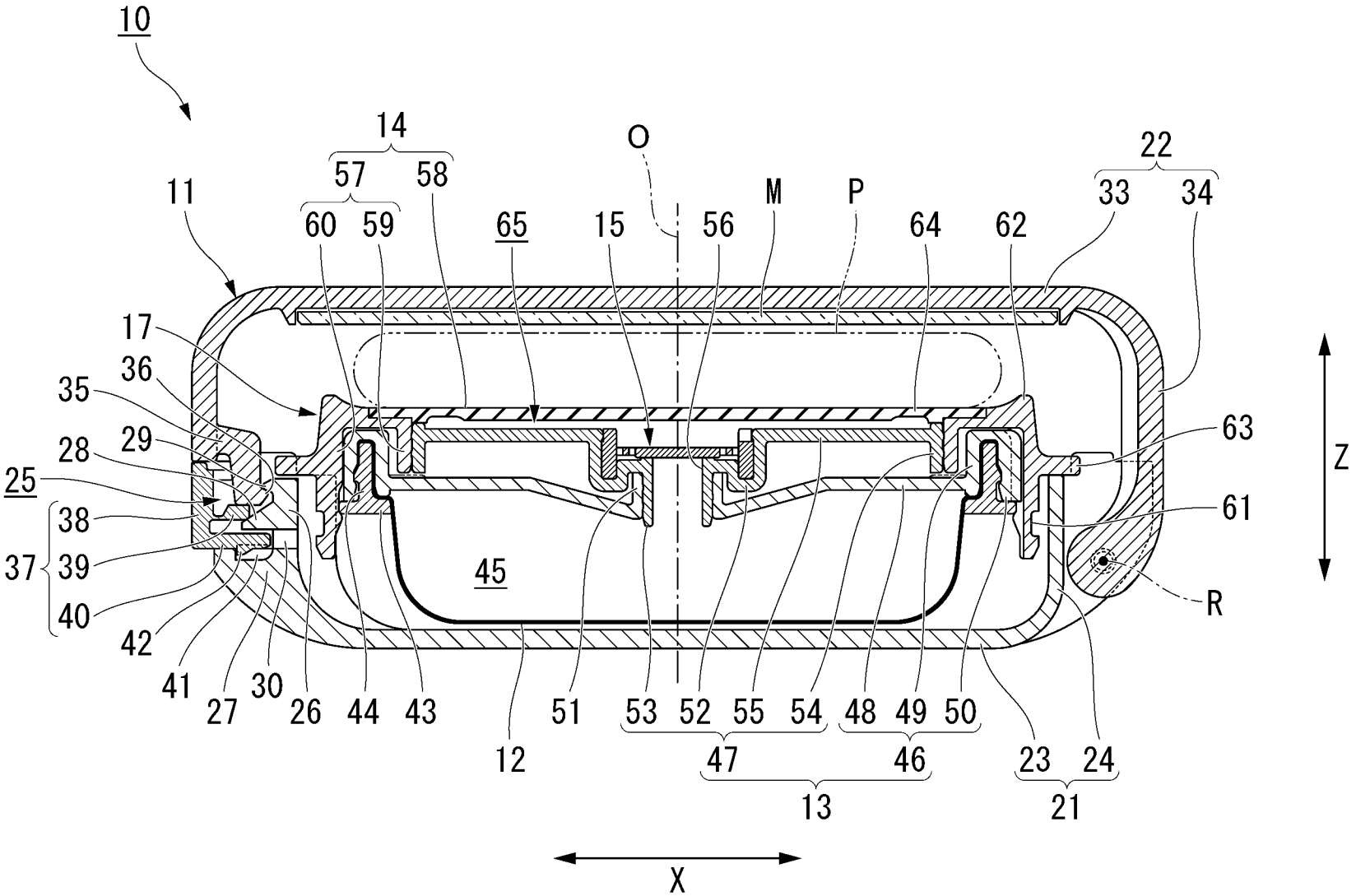
FIG. 2 is a cutaway perspective view taken along line II-II in FIG. 1.
Figure 3:
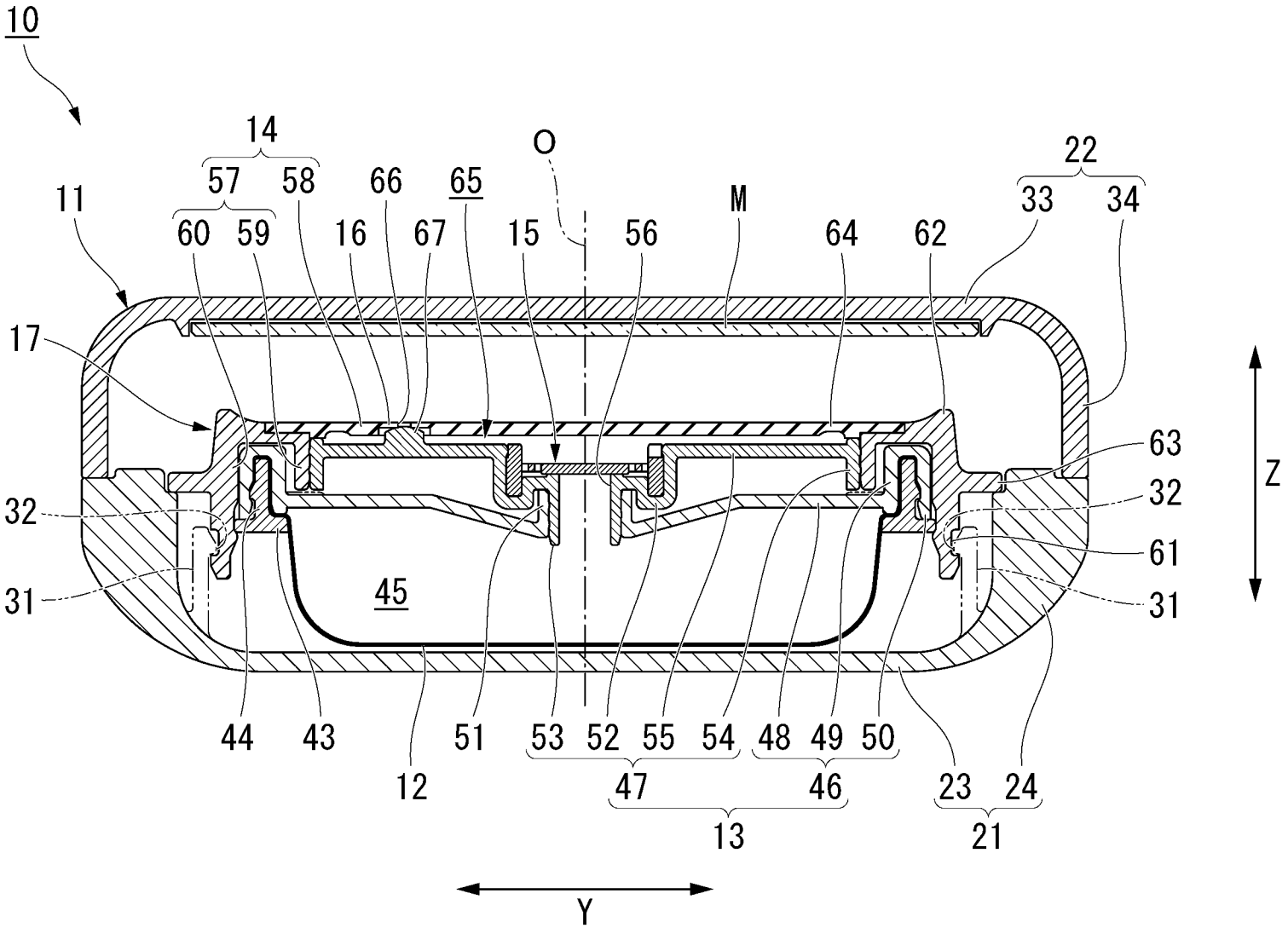
FIG. 3 is a cutaway perspective view taken along line in FIG. 1.

A compact container 10 according to a first embodiment of the present invention will be described with reference to FIGS. 1 to 3. The compact container 10 of the embodiment is a flat container having a circular shape in plan view, as shown in FIGS. 1 to 3. The compact container 10 includes an outer shell 11, an inner container 12, an inner lid 13, a middle lid 14, a first valve body 15, and a second valve body 16. The outer shell 11 covers the inner container 12, the inner lid 13, and the middle lid 14 and accommodates them inside. The outer shell 11 includes a bottom member 21 and a lid member 22. The bottom member 21 has a cylindrical shape with a bottom. The lid member 22 is mounted on the bottom member 21 to be rotatable around a rotational axis R.

Hereinafter, a central axis of the bottom member 21 (a central axis of the compact container 10) will be referred to as a container axis O, and a direction along the container axis O will be referred to as a vertical direction Z (a Z-axis direction). The lid member 22 side (the +Z side) in the vertical direction Z is referred to as the upper side, and the bottom member 21 side (the −Z side) in the vertical direction Z is referred to as the lower side. The container axis O is orthogonal to a direction along the rotational axis R. A direction along the rotational axis R is referred to as a right and left direction Y (a Y-axis direction), and a direction orthogonal to both the container axis O and the rotational axis R is referred to as a forward and rearward direction X (an X-axis direction). The rotational axis R side (the +X side) with respect to the container axis O in the forward and rearward direction X is referred to as the rear side, and the side opposite (the −X side) thereto is referred to as the front side. Further, in plan view seen in the vertical direction Z, a direction passing through the container axis O and orthogonal to the container axis O is referred to as a radial direction, and a direction circling around the container axis O is referred to as a circumferential direction.

As shown in FIG. 2, the bottom member 21 includes a disk-shaped bottom plate portion 23 which is disposed coaxially with the container axis O, and a substantially cylinder-shaped tubular wall portion 24 which extends upward from an outer edge of the bottom plate portion 23. An engagement space 25 recessed toward the rear side is provided in a portion of the tubular wall portion 24 located on the front side. The engagement space 25 opens toward the side in front and the side above. The engagement space 25 is defined by a rear wall portion 26 which faces forward and a bottom wall portion 27 which faces upward.

A guide wall portion 28 which protrudes forward is formed at a portion of the rear wall portion 26 located at a center in the right and left direction Y. An upper surface of the guide wall portion 28 is an inclined surface which is inclined downward toward the front side. A first engagement portion 29 which protrudes forward is formed at a portion of the rear wall portion 26 located above the guide wall portion 28. An escape hole 30 which passes through the rear wall portion 26 in the forward and rearward direction X is formed at a portion of the rear wall portion 26 located below the guide wall portion 28.

As shown in FIG. 3, the bottom member 21 includes an engagement plate portion 31 which extends upward from the bottom plate portion 23. As shown in FIG. 1, four engagement plate portions 31 are formed at equal intervals in the circumferential direction. A shape of the engagement plate portion 31 in plan view is a linear shape which extends in the circumferential direction. Front and back surfaces of the engagement plate portion 31 are orthogonal to the radial direction. An upper portion of the engagement plate portion 31 may be deformed radially outward with a lower end of the engagement plate portion 31 as a fulcrum, as shown in FIG. 3. An engagement claw 32 which protrudes radially inward is provided at an upper end portion of the engagement plate portion 31.

As shown in FIG. 2, the lid member 22 is mounted on a rear end portion of the tubular wall portion 24 of the bottom member 21. The lid member 22 may open and close an upper end opening of the bottom member 21. In addition, a positional relationship between each part in the following description is a positional relationship in a state in which the lid member 22 is closed unless otherwise described. The lid member 22 has a cylindrical shape with a lid which is disposed coaxially with the container axis O and opens downward. The lid member 22 includes a disk-shaped top plate portion 33 which is disposed coaxially with the container axis O, and a cylinder-shaped tubular portion 34 which extends downward from an outer circumferential edge of the top plate portion 33. A mirror M is fixed to a lower surface of the top plate portion 33 of the lid member 22.

An engagement piece 35 protrudes downward from a portion of the lid member 22 located on the front side. The engagement piece 35 is formed in a plate shape which protrudes downward from an inner circumferential surface of the tubular portion 34 and extends in the right and left direction Y, and enters the engagement space 25 from the upper side. A second engagement portion 36 which protrudes rearward and is undercut-fitted to the first engagement portion 29 formed on the bottom member 21 to be separable is formed at a lower end portion of the engagement piece 35. The lid member 22 is locked in a closed state by the second engagement portion 36 engaging with the first engagement portion 29 from the side below.

A push piece 37 which releases the engagement between the first engagement portion 29 and the second engagement portion 36 is provided in the engagement space 25. The push piece 37 includes an operation wall portion 38 disposed forward from the engagement piece 35, a release protrusion 39 which protrudes rearward from the operation wall portion 38 and is located on the inclined surface of the guide wall portion 28, and a base portion 40 which protrudes rearward from a lower end portion of the operation wall portion 38 and is mounted on the bottom wall portion 27. The push piece 37 may be pushed rearward.

The release protrusion 39 moves rearward along the inclined surface of the guide wall portion 28 according to rearward movement of the push piece 37 and pushes up the second engagement portion 36 from the lower side to separate the second engagement portion 36 from the first engagement portion 29. Thus, the engagement between the first engagement portion 29 and the second engagement portion 36 can be released, and the lid member 22 can be brought into a state in which the lid member 22 can be operated such that the lid member 22 is opened. When the push piece 37 moves rearward, the push piece 37 is restored and moved forward by a restoring deformation of the release protrusion 39.

The base portion 40 enters from the front into the relief hole 30 formed in the rear wall portion 26 in accordance with the rearward movement of the push piece 37. Further, a locking convex portion 42 which protrudes downward and is locked to a locking concave portion 41 formed in the bottom wall portion 27 is formed at the base portion 40. Accordingly, the push piece 37 is combined with the outer shell 11 in a state in which the push piece 37 is prevented from being removed forward.

The above-described push piece 37 is not essential and may not be provided. For example, the engagement between the first engagement portion 29 and the second engagement portion 36 may be released by causing the lower end portion of the engagement piece 35 to be slightly bent forward using a fingertip or the like, and thus the lock of the lid member 22 in the closed state may be released.

The inner container 12 is disposed on the radial inside of the tubular wall portion 24 of the bottom member 21. The inner container 12 is a flat cylindrical container which is disposed coaxially with the container axis O and opens upward. A thickness of the inner container 12 is relatively thin. The inner container 12 is flexible and is reducible in volume (deformable to be reduced in volume). The inner container 12 is constituted by, for example, a laminated film or a thin resin molded product. The inner container 12 may be a so-called delamination container in which an inner container having excellent flexibility is laminated on an inner surface of the outer container harder than the inner container. An annular fitting ring 43 which surrounds an upper end of the inner container 12 on the radial outside thereof is fixed to an upper end portion of the inner container 12. The fitting ring 43 has an engagement protrusion 44 which protrudes upward. The accommodation space 45 which is the inside of the inner container 12 accommodates contents having fluidity. The contents may be a liquid phase, a gel phase, or a jelly phase as long as they have fluidity. The contents are, for example, cosmetics such as liquid foundation.

The inner lid 13 is disposed above the inner container 12. The inner lid 13 closes an upper opening of the inner container 12 and seals the inside of the inner container 12. The inner lid 13 includes a lower member 46 directly mounted in the inner container 12 and an upper member 47 mounted in the inner container 12 via the lower member 46. The lower member 46 includes an inner lid disk portion 48, an inner tubular portion 49, and an outer tubular portion 50. The inner lid disk portion 48 has a disk shape which is disposed coaxially with the container axis O. The inner lid disk portion 48 covers the upper opening of the inner container 12. A mounting tubular portion 51 which extends upward is formed at the inner lid disk portion 48. The mounting tubular portion 51 is disposed coaxially with the container axis O. The mounting tubular portion 51 opens into the inner container 12. The inner tubular portion 49 has a cylindrical shape which extends upward from an outer circumferential edge of the inner lid disk portion 48. The outer tubular portion 50 has a cylindrical shape which is disposed coaxially with the container axis O and on the radial outside of the inner tubular portion 49. An upper end portion of the outer tubular portion 50 is connected to an upper end portion of the inner tubular portion 49.

The engagement protrusion 44 of the fitting ring 43 is fitted to a space between the outer tubular portion 50 and the inner tubular portion 49 in the radial direction. Thus, the inner container 12 and the inner lid 13 are fixed via the fitting ring 43. A lower end of the outer tubular portion 50 and a lower end of the inner tubular portion 49 are in contact with the fitting ring 43.

The upper member 47 includes a valve seat tubular portion 52, a communication tubular portion 53, a space-forming tubular portion 54, and a connection annular portion 55. The valve seat tubular portion 52 is formed in a tubular shape with a bottom which is coaxial with the container axis O. The valve seat tubular portion 52 has a diameter larger than that of the mounting tubular portion 51 and smaller than that of the inner tubular portion 49. A bottom surface of the valve seat tubular portion 52 is disposed on an opening edge of an upper end of the mounting tubular portion 51. The communication tubular portion 53 has a cylindrical shape which is disposed coaxially with the container axis O and extends downward from the valve seat tubular portion 52. The communication tubular portion 53 is fitted into the mounting tubular portion 51. A lower end portion of the communication tubular portion 53 is located below a lower end portion of the mounting tubular portion 51 and is in contact with the contents in the inner container 12. The inside of the communication tubular portion 53 is a communication hole 56 formed in the middle lid 14. The communication hole 56 communicates with the inside of the inner container 12.

The space-forming tubular portion 54 has a cylindrical shape which is coaxial with the container axis O. The space-forming tubular portion 54 has a diameter larger than the valve seat tubular portion 52 and smaller than the inner tubular portion 49. The space-forming tubular portion 54 is disposed in the inner tubular portion 49. A lower end portion of the space-forming tubular portion 54 is spaced apart from an upper surface of the inner lid disk portion 48. The connection annular portion 55 is disposed coaxially with the container axis O. An upper surface and a lower surface of the connection annular portion 55 extend in a direction orthogonal to the container axis O. An inner circumferential edge portion of the connection annular portion 55 is connected to an upper end portion of the valve seat tubular portion 52. An outer circumferential edge portion of the connection annular portion 55 is connected to an upper end portion of the space-forming tubular portion 54. The outer circumferential edge portion of the connection annular portion 55 is located below an upper end edge of the space-forming tubular portion 54 and above a center of the space-forming tubular portion 54 in the vertical direction Z.

The middle lid 14 is disposed above the inner lid 13. The middle lid 14 is formed in a tubular shape with a top. The middle lid 14 includes a mounting ring 57 which forms a circumferential wall of the middle lid 14, and an operation portion 58 which forms a top wall of the middle lid 14. The mounting ring 57 is mounted on the inner lid 13. The mounting ring 57 is formed in a double cylindrical shape having an inner cylinder 59 and an outer cylinder 60 of which upper end portions are connected to each other. The upper member 47 (the space-forming tubular portion 54) of the inner lid 13 is fitted into the inner cylinder 59. A circumferential groove 61 which is recessed radially inward from a radially outer surface is formed in a lower portion of the outer cylinder 60. The circumferential groove 61 extends continuously over the entire circumference in the circumferential direction. The circumferential groove 61 engages with the engagement claw 32 of the engagement plate portion 31 of the bottom member 21. Therefore, separation of the mounting ring 57 from the bottom member 21 is curbed. The lower member 46 (the inner tubular portion 49 and the outer tubular portion 50) of the inner lid 13 is fitted and fixed between the inner cylinder 59 and the outer cylinder 60 in the mounting ring 57. Thus, the inner container 12 is fixed to the mounting ring 57 (the middle lid 14) via the fitting ring 43. The inner container 12 is disposed to be spaced upward from the bottom plate portion 23 of the bottom member 21 in a state in which it is fixed to the middle lid 14.

A raised portion 62 which protrudes upward is formed on an upper surface of the mounting ring 57. The raised portion 62 has an annular shape. A shape of the raised portion 62 in plan view is an annular shape disposed coaxially with the container axis O. An inner circumferential surface of the raised portion 62 is formed in a curved surface shape which extends to the outside of the raised portion 62 as it goes upward. In a state in which the compact container 10 is closed, a puff P (an applicator) is mounted on an upper surface of the operation portion 58 located inside the raised portion 62. A flange portion 63 which extends radially outward is provided on an outer circumferential surface of the mounting ring 57. The flange portion 63 is provided over the entire circumference. A lower surface of the flange portion 63 is in contact with an upper surface of the tubular wall portion 24 of the bottom member 21 from the upper side.

The operation portion 58 closes the inside of the mounting ring 57 from the upper side. An outer circumferential edge portion of the operation portion 58 is connected to an upper surface of a portion of the mounting ring 57 located on the radial outside of the raised portion 62. The upper surface of the operation portion 58 is formed to be flush with a portion of the mounting ring 57 which is continuous with the operation portion 58 from the radial outside thereof without a step. The operation portion 58 is formed to be elastically deformable. In the illustrated example, a central portion of the operation portion 58 located on the radial inside of an outer circumferential edge portion (a portion connected to the mounting ring 57) is formed to be elastically deformable in the vertical direction Z. An upper end surface of the space-forming tubular portion 54 is in contact with a lower surface of the operation portion 58. For example, a soft material such as an elastomer, nitrile rubber, butyl rubber, silicone rubber, soft polyethylene, or urethane may be used as a material of the operation portion 58. Further, in consideration of chemical resistance to the contents, for example, elastically deformable and relatively soft polypropylene (PP), polyethylene terephthalate (PET) molded to be thin, or the like may be used as the material of the operation portion 58. The operation portion 58 is softer than the mounting ring 57, and the mounting ring 57 is harder than the operation portion 58. An annular thin portion 64 is formed in the operation portion 58. The thin portion 64 is formed in a portion of the operation portion 58 which defines a communication space 65 described later. The thin portion 64 is formed on an outer circumferential portion of the central portion of the operation portion 58. The thin portion 64 is formed by indenting the lower surface of the operation portion 58 upward. The upper surface of the operation portion 58 is formed to be flush at the front and rear straddling the thin portion 64 in the radial direction.

The middle lid 14 defines the communication space 65 which communicates with the communication hole 56 between the inner lid 13 and the middle lid 14. In the embodiment, the communication space 65 is formed by closing an upper opening of the space-forming tubular portion 54 (the upper member 47) by the operation portion 58. The operation portion 58 closes the inside of the mounting ring 57 from the upper side and defines the communication space 65 in the inside of the mounting ring 57. The communication space 65 is formed in a circular shape in plan view. A size (a height) of the communication space 65 in the vertical direction Z is smaller than ½ of a size of the space-forming tubular portion 54 in the vertical direction Z. The operation portion 58 is elastically deformed and thus increases or decreases an internal pressure of the communication space 65.

As shown in FIG. 1, a discharge hole 66 which discharges the contents is formed in the middle lid 14. A shape of the discharge hole 66 in plan view is circular. A plurality of discharge holes 66 are formed in the middle lid 14. The discharge holes 66 are arranged by being disposed in the forward and rearward direction X at positions shifted in the right and left direction Y with respect to the container axis O. The discharge holes 66 are formed in the operation portion 58 and pass through the operation portion 58 in the vertical direction Z, as shown in FIG. 3. The discharge holes 66 communicate with the communication space 65. The discharge holes 66 are closed by a valve seat portion 67 provided on the inner lid 13. The valve seat portion 67 protrudes upward from the connection annular portion 55 (the middle lid 14) of the upper member 47. The middle lid 14 may be formed, for example, by insert molding using the mounting ring 57 as an insert article.

The first valve body 15 is a valve which switches between communication and blocking between the communication hole 56 of the inner lid 13 and the communication space 65. In the embodiment, the first valve body 15 is disposed in the inner lid 13. The first valve body 15 is fitted into the valve seat tubular portion 52 of the inner lid 13. The first valve body 15 covers the upper side of the communication hole 56. The first valve body 15 is a check valve. The first valve body 15 allows a flow of a fluid from the accommodation space 45 of the inner container 12 to the communication space 65 and blocks the flow of the fluid from the communication space 65 to the accommodation space 45. For example, a three-point valve may be used as the first valve body 15. For example, a shape of the three-point valve may be appropriately changed or a check valve having a constitution different from that of the three-point valve may be adopted as the first valve body 15 according to properties of the contents stored in the inner container 12.

The second valve body 16 is a valve which switches between communication and blocking between the discharge hole 66 of the middle lid 14 and the communication space 65. In the embodiment, the second valve body 16 is disposed in the middle lid 14. The second valve body 16 is formed by a portion of the operation portion 58 including an opening circumferential edge portion of the discharge hole 66. The second valve body 16 is formed to be thinner than other portions of the operation portion 58 and to be thinner than the thin portion 64. As shown in FIG. 1, a shape of the second valve body 16 in plan view is similar to a shape of the valve seat portion 67 in plan view and is larger than the shape of the valve seat portion 67 in plan view. As shown in FIG. 3, the second valve body 16 blocks communication between the discharge hole 66 and the communication space 65 by being seated on the valve seat portion 67. The second valve body 16 allows the discharge hole 66 to communicate with the communication space 65 when the second valve body 16 is elastically deformed and separated from the valve seat portion 67. The second valve body 16 is a check valve. The second valve body 16 allows a flow of a fluid from the communication space 65 to the outside and blocks the flow of the fluid from the outside to the communication space 65.

In the embodiment, the inner container 12, the inner lid 13 and the middle lid 14 constitute a refill container 17. The refill container 17 is provided to be detachable from the outer shell 11. Thus, a user can replace the refill container 17 with a new refill container 17 filled with contents after using up the contents in the inner container 12. When the refill container 17 is removed from the outer shell 11, the user releases the engagement state between the engagement claws 32 of the engagement plate portion 31 and the circumferential groove 61. Specifically, the user deforms the engagement claw 32 radially outward by deforming the engagement plate portion 31 radially outward toward a gap between the engagement plate portion 31 and the tubular wall portion 24. Therefore, the engagement claw 32 can be removed from the inside of the circumferential groove 61 and can release the engagement state between the engagement claw 32 and the circumferential groove 61.

Hereinafter, a method of discharging the contents of the compact container 10 of the embodiment will be described. When the compact container 10 is in an unused state, the contents are accommodated only in the accommodation space 45, and the communication space 65 is filled with, for example, air. First, the user operates the push piece 37 to open the lid member 22 of the outer shell 11 and then presses the operation portion 58 from the side above such that it is elastically deformed and thus recessed downward. When the operation portion 58 is elastically deformed to be recessed downward, a volume of the communication space 65 is reduced, and thus the internal pressure of the communication space 65 increases. Then, the second valve body 16 bulges and is elastically deformed upward by the internal pressure of the communication space 65 and is separated from the valve seat portion 67, the closed state of the discharge hole 66 is released, and some of the air in the communication space 65 is discharged from the discharge hole 66 to the outside. Thereafter, the second valve body 16 is deformed and restored on the basis of an elastic restoring force to be seated on the valve seat portion 67 and closes the discharge hole 66. At this time, since the first valve body 15 blocks movement of a fluid from the communication space 65 to the accommodation space 45, the communication hole 56 is closed by the first valve body 15, and a flow of the air in the communication space 65 from the communication hole 56 to the accommodation space 45 is curbed. In this way, when the internal pressure of the communication space 65 is increased by the operation portion 58, the first valve body 15 blocks the communication between the communication hole 56 and the communication space 65, and the second valve body 16 causes the discharge hole 66 to communicate with the communication space 65.

Next, the user releases the pressing force applied to the operation portion 58 and deforms and restores the elastically deformed operation portion 58 to an original state. Therefore, the volume of the communication space 65 increases, and a pressure in the communication space 65 becomes negative. At this time, since the discharge hole 66 is closed by the second valve body 16, entry of air into the communication space 65 from the outside is curbed. Thus, the contents in the accommodation space 45 are suctioned up into the communication space 65 through the communication hole 56. Since the first valve body 15 allows a flow of a fluid from the accommodation space 45 to the communication space 65, the first valve body 15 is brought into a state in which the communication hole 56 and the communication space 65 are able to communicate with each other and thus does not inhibit flow of the contents. Accordingly, the contents flow into the communication space 65. In this way, when the internal pressure of the communication space 65 is lowered by the operation portion 58, the second valve body 16 blocks the communication between the discharge hole 66 and the communication space 65, and the first valve body 15 causes the communication hole 56 to communicate with the communication space 65.

The user can discharge the air of the communication space 65 to the outside and can fill the communication space 65 with the contents by performing the elastic deformation and the restoring deformation of the operation portion 58 a plurality of times. Here, since the inner container 12 has flexibility and is reduced in volume (deformed to be reduced in volume) by the contents flowing out to the communication space 65 through the communication hole 56, when the internal pressure of the accommodation space 45 decreases as the amount of contents decreases, the inner container 12 is deformed and contracts, and the volume of the accommodation space 45 decreases. Thus, even when the contents flow into the communication space 65 and the total amount of the contents in the accommodation space 45 decreases, it is possible to suitably send the contents from the accommodation space 45 to the communication space 65.

When the operation portion 58 is elastically deformed in a state in which the contents have been filled into the communication space 65, the internal pressure of the communication space 65 increases. Thus, the second valve body 16 bulges and is deformed upward, and the closing of the discharge hole 66 is released. Therefore, the contents pushed out from the communication space 65 are discharged from the discharge hole 66 to the outside. In this way, the user can discharge the contents. The contents are discharged from the discharge hole 66 to the inside of the raised portion 62 on the upper surface of the middle lid 14. Therefore, overflowing of the contents from the upper surface of the middle lid 14 can be curbed. The user wipes the upper surface of the middle lid 14 with a puff P or the like, and the contents become adhered to the puff P or the like and then the contents are used.

As described above, according to the compact container 10 of the embodiment, when the internal pressure of the communication space 65 is increased by the operation portion 58, the first valve body 15 blocks the communication between the communication hole 56 and the communication space 65, and the second valve body 16 causes the discharge hole 66 to communicate with the communication space 65. On the other hand, when the internal pressure of the communication space 65 is lowered by the operation portion 58, the second valve body 16 blocks the communication between the discharge hole 66 and the communication space 65, and the first valve body 15 causes the communication hole 56 to communicate with the communication space 65. Thus, the user presses the operation portion 58 or releases the pressing to elastically deform the operation portion 58, increases or decreases the internal pressure of the communication space 65, makes the inside of the communication space 65 have a negative pressure, causes the contents in the inner container 12 to flow into the communication space 65, and thus can fill the communication space 65 with the contents. In this state, when the internal pressure of the communication space 65 is increased by the operation portion 58, the contents can be discharged from the discharge hole 66 by an amount corresponding to the increase in the internal pressure of the communication space 65. Therefore, the compact container 10 in which the adjustment of the discharge amount of the contents is easy can be obtained.

Further, since the middle lid 14 includes the operation portion 58 and the operation portion 58 is a part of the middle lid 14, it is possible to curb an increase in the number of components by providing the operation portion 58. Furthermore, since the operation portion 58 defines the communication space 65, for example, the operation portion 58 can be formed to be large according to a size of the communication space 65, and a range in which the user can operate when the contents are discharged can be expanded. In the embodiment, since the operation portion 58 forms a top wall of the middle lid 14, the user can carry out the discharge operation by pressing anywhere on the top wall. Furthermore, the puff P is provided on the operation portion 58, and the operation portion 58 can be pressed via the puff P. In this case, for example, the contents may also be discharged directly from the discharge hole 66 to the puff P, and thus it is possible to make work of wiping the contents by the puff P unnecessary.

Further, the annular thin portion 64 is formed in the operation portion 58. Therefore, a portion of the operation portion 58 located inside the thin portion 64 can be easily elastically deformed from the thin portion 64 as a fulcrum. Thus, it is possible to greatly increase and decrease the internal pressure of the communication space 65 and to more easily adjust the discharge amount of the contents.

Further, a plurality of discharge holes 66 are formed in the middle lid 14.

Therefore, for example, as compared with a case in which only one discharge hole 66 is formed in the middle lid 14, the contents discharged from the discharge holes 66 can be easily dispersed in a wide range. Accordingly, for example, in the case in which the contents discharged onto the middle lid 14 are wiped with the puff P, or the like, the contents can be uniformly distributed to the entire puff P. For example, in the case of the compact container 10 containing cosmetics (so-called foundation or the like) as the contents, it is possible to make it easy to apply the cosmetic uniformly from the puff P to the skin (an applying portion) and to make it easy to spread the cosmetic.

Further, as the contents flow out to the communication space 65 through the communication hole 56, the volume of the inner container 12 is reduced. Therefore, when the contents in the inner container 12 are decreased by discharging the contents, it is possible to raise the inner container 12 and to maintain a height position of the contents, and the contents can smoothly flow out from the communication hole 56 into the communication space 65. Furthermore, for example, when the inner container 12 is removed from the outer shell 11 after the contents in the inner container 12 have been used up, it is possible to reduce the volume of the inner container 12 in advance, and volume reduction at the time of disposal can be realized.

In addition, the discharge hole 66 is formed in the operation portion 58.

Therefore, for example, an operation in which the user brings his hand close to the middle lid 14 (the operation portion 58) when wiping the contents discharged from the discharge hole 66 with the puff P can be substantially the same as an operation in which the user brings his hand close to the middle lid 14 when operating the operation portion 58. Therefore, the compact container 10 can be easily used. Further, the second valve body 16 is formed by a portion of the operation portion 58 including the opening circumferential edge portion of the discharge hole 66. Therefore, an increase in the number of components by providing the second valve body 16 can be curbed.

Also, the middle lid 14 includes the mounting ring 57. Therefore, the mounting ring 57 can be appropriately formed to be rigid while the operability is secured based on the elastic deformation of the operation portion 58, and the mountability of the middle lid 14 to the inner lid 13 can be secured by the mounting ring 57. Accordingly, both the operability of the operation portion 58 and the mountability of the middle lid 14 can be secured.

Second Embodiment

Figure 4:
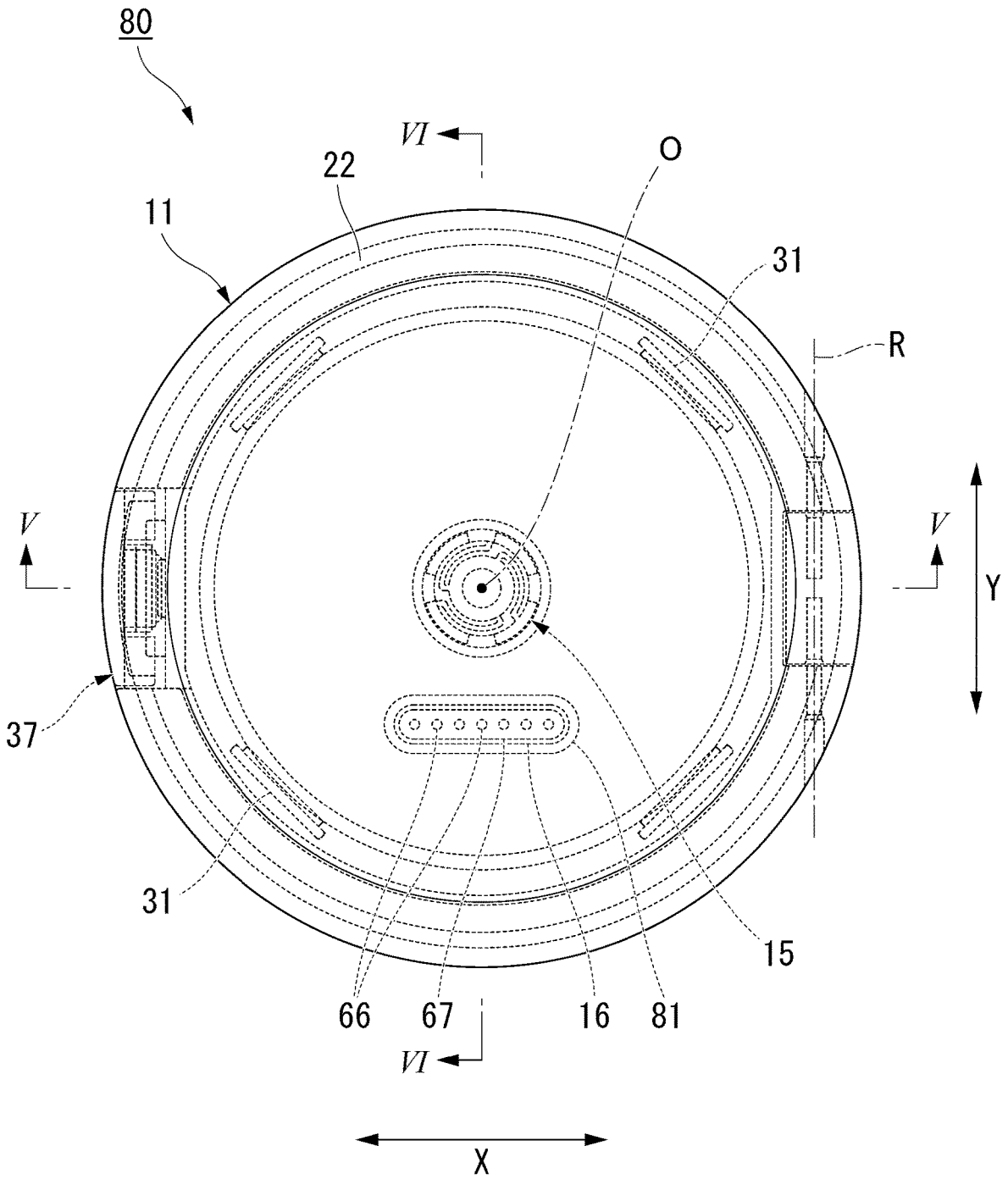
FIG. 4 is a plan view showing a compact container of a second embodiment.
Figure 5:
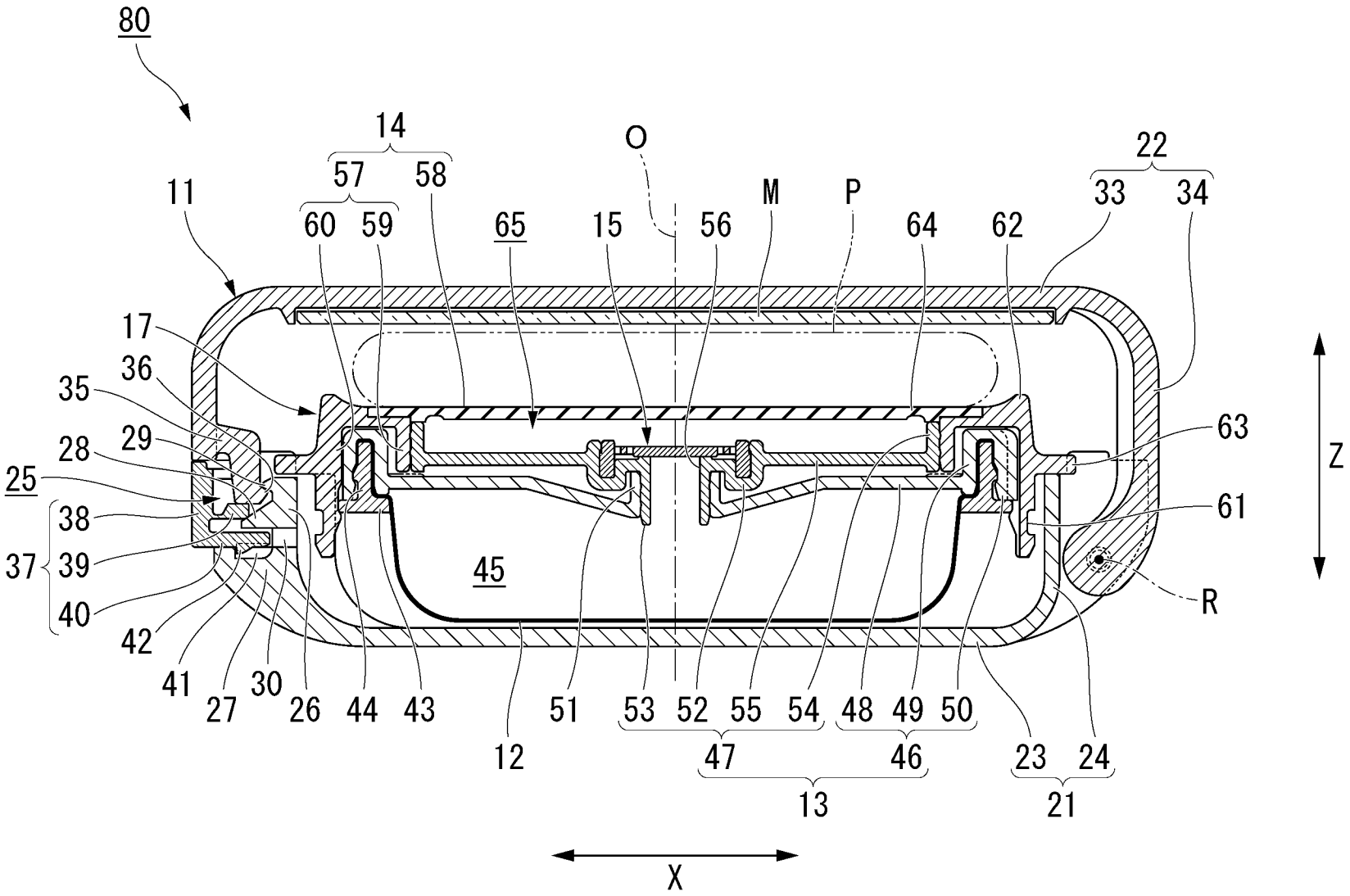
FIG. 5 is a cutaway perspective view taken along line V-V in FIG. 4.
Figure 6:
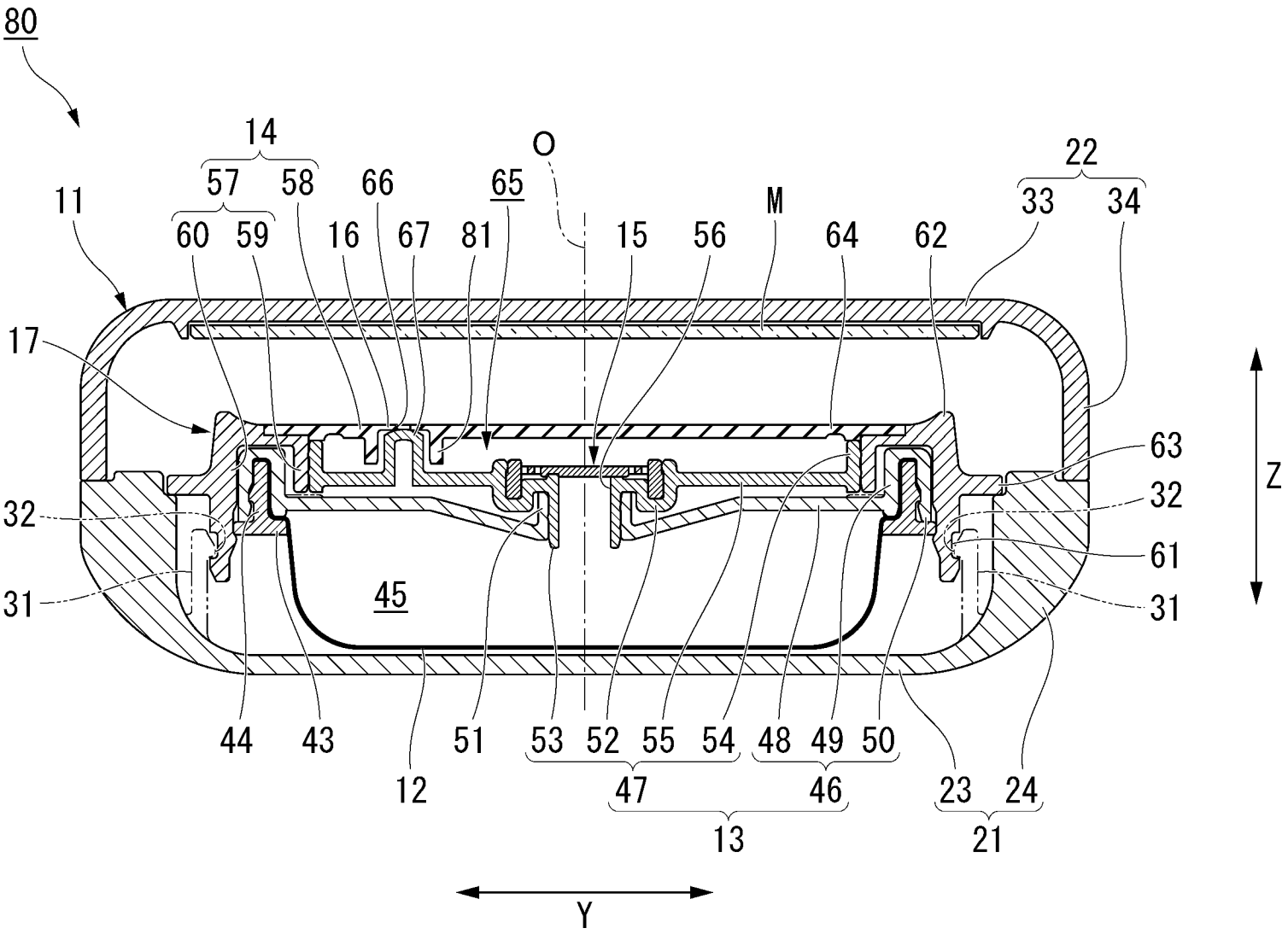
FIG. 6 is a cutaway perspective view taken along line VI-VI in FIG. 4.

Next, a compact container 80 according to a second embodiment of the present invention will be described with reference to FIGS. 4 to 6. In the second embodiment, the same reference numerals are given to the same components as those in the first embodiment, the description thereof will be omitted, and only different points will be described.

In the compact container 80 according to the embodiment, the outer circumferential edge portion of the connection annular portion 55 is connected to the lower end portion of the space-forming tubular portion 54. The outer circumferential edge portion of the connection annular portion 55 is located above a lower end edge of the space-forming tubular portion 54 and below the center of the space-forming tubular portion 54 in the vertical direction Z. Thus, a size (a height) of the communication space 65 in the vertical direction Z is larger than ½ of the size of the space-forming tubular portion 54 in the vertical direction Z. Additionally, in the communication space 65 in the compact container 80 of the embodiment, the size thereof in the vertical direction Z is larger than that of the communication space 65 in the compact container 10 of the first embodiment, and the volume thereof is also larger. In this way, in the case in which the size of the communication space 65 in the vertical direction Z is secured, when the user presses the operation portion 58 from the upper side, the user can appropriately adjust a pressing amount of the operation portion 58. For example, when the user wants to discharge a large amount of contents, the operation portion 58 may be pushed in until the operation portion 58 comes into contact with the connection annular portion 55, or when the user wants to discharge a small amount of contents, the operation portion 58 may be slightly pushed in as long as the operation portion 58 does not comes into contact with the connection annular portion 55. Therefore, the discharge amount of the contents can be adjusted by the user adjusting the pressing amount of the operation portion 58.

A restriction wall portion 81 which extends downward is provided at a circumferential edge portion of the second valve body 16. The restriction wall portion 81 is formed in a tubular shape which extends around the entire circumference of the circumferential edge portion. The restriction wall portion 81 suppresses the elastic deformation generated on the outside of the second valve body 16 in the operation portion 58 from being propagated to the second valve body 16.

The technical scope of the present invention is not limited to the above-described embodiment. For example, as described below, various modifications can be made to the above-described embodiment without departing from the spirit of the present invention.

A shape of the operation portion 58 in plan view is not particularly limited and may be an elliptical shape, a triangular shape, a quadrangular shape, or a polygonal shape having five or more sides. Further, a shape of the inner container 12 is not particularly limited and may be, for example, an elliptical cylinder shape or an angular cylinder shape. Further, the inner container 12, the inner lid 13 and the middle lid 14 may not constitute the refill container 17. That is, the inner container 12, the inner lid 13 and the middle lid 14 may be constituted such that the inner container 12 cannot be replaced when the contents are used up.

The mounting ring 57 may not be present. Instead of including the mounting ring 57, the elastically deformable operation portion 58 (the elastically deformable portion) may be mounted on the inner lid 13 by being formed in, for example, a tubular shape with a top. The discharge hole 66 may not be formed in the operation portion 58. For example, a flange which protrudes radially inward and defines the communication space 65 may be provided on the mounting ring 57, and the discharge hole 66 may be provided in the flange. Only one discharge hole 66 may be formed. The second valve body 16 may not be formed by the operation portion 58, and the second valve body 16 may be formed by a member different from the operation portion 58. Even when the contents flow into the communication space 65 through the communication hole 56, the volume of the inner container 12 may not be reduced. The inner container 12 may adopt a non-flexible constitution. The thin portion 64 may not be formed in the operation portion 58.

In addition, it is possible to replace components in the embodiment with known components as appropriate without departing from the spirit of the present invention, and the above-described modified examples may also be appropriately combined with the embodiment.

Third Embodiment

Next, a compact container 190 according to a third embodiment of the present invention will be described with reference to FIGS. 7 and 8.

Figure 7:
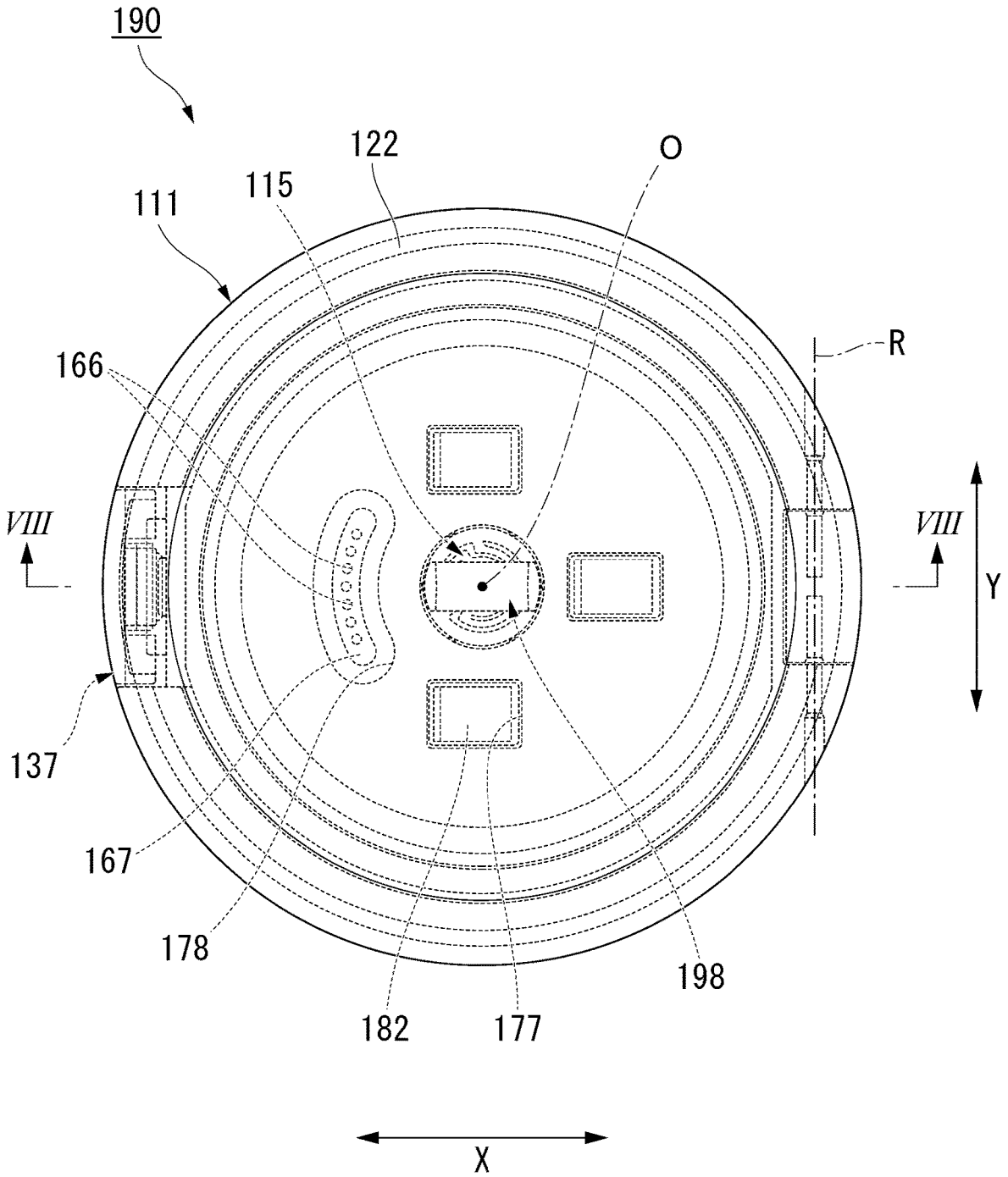
FIG. 7 is a top view showing a compact container of a third embodiment.
Figure 8:
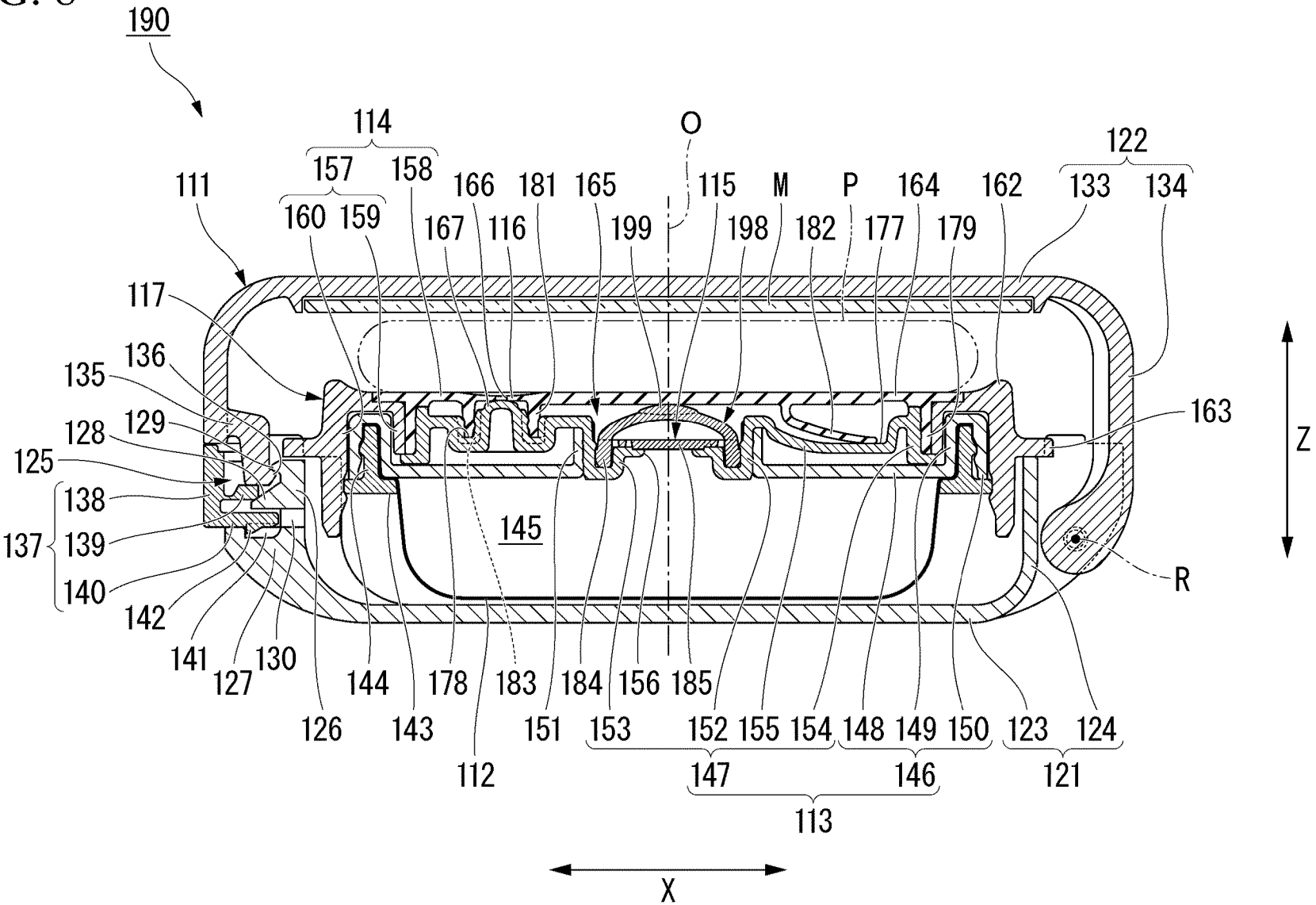
FIG. 8 is a cutaway perspective view taken along line VIII-VIII in FIG. 7.

As shown in FIGS. 7 and 8, the compact container 190 of the embodiment is a flat container having a circular shape in plan view. The compact container 190 includes an outer shell 111, an inner container 112, an inner lid 113, a middle lid 114, a first valve body 115, a second valve body 116, and a biasing portion 198. The outer shell 111 covers the inner container 112, the inner lid 113 and the middle lid 114 and accommodates them inside. That is, in the compact container 190, members other than the outer shell 111 are accommodated inside the outer shell 111. The outer shell 111 includes a bottom member 121 and a lid member 122. The bottom member 121 has a cylindrical shape with a bottom. The lid member 122 has a cylindrical shape with a top. The lid member 122 is mounted on the bottom member 121 to be rotatable about the rotational axis R.

Hereinafter, a central axis of the outer shell 111 (a central axis of the compact container 190) is referred to as a container axis O, and a direction along the container axis O (a direction in which the container axis O extends) is referred to as a vertical direction Z. A direction from the bottom member 121 to the lid member 122 in the vertical direction Z is referred to as an upward direction, and a direction from the lid member 122 to the bottom member 121 is referred to as a downward direction. A direction orthogonal to the container axis O in plan view when seen in the vertical direction Z is referred to as a radial direction. A direction approaching the container axis O in the radial direction is referred to as a radial inside, and a direction away from the container axis O is referred to as a radial outside. In the radial direction, a direction parallel to the rotational axis R is referred to as a right and left direction Y, and a direction orthogonal to the rotational axis R is referred to as a forward and rearward direction X. In the forward and rearward direction X, a direction from the container axis O toward the rotational axis R is referred to as a rear, and a direction from the rotational axis R toward the container axis O is referred to as a front. A direction circling around the container axis O is referred to as a circumferential direction.

As shown in FIG. 8, the bottom member 121 includes a disk-shaped bottom plate portion 123 which is disposed coaxially with the container axis O, and a cylindrical tubular wall portion 124 which extends upward from an outer circumferential edge of the bottom plate portion 123. An engagement space 125 which is recessed rearward is provided in a front end portion of the tubular wall portion 124. The engagement space 125 opens forward and upward. The engagement space 125 is defined by a rear wall portion 126 which faces forward and a bottom wall portion 127 which faces upward.

A guide wall portion 128 which protrudes forward is formed at a portion of the rear wall portion 126 located at a center in the right and left direction Y. An upper surface of the guide wall portion 128 is an inclined surface which is inclined downward toward the front side. A first engagement portion 129 which protrudes forward is formed at a portion of the rear wall portion 126 located above the guide wall portion 128. An escape hole 130 which passes through the rear wall portion 126 in the forward and rearward direction X is formed in a portion of the rear wall portion 126 located below the guide wall portion 128.

The bottom member 121 includes an engagement plate portion (not shown) which extends upward from the bottom plate portion 123. A plurality of engagement plate portions are formed at regular intervals in the circumferential direction. Front and back surfaces of the engagement plate portion are disposed to be orthogonal to the radial direction. An engagement claw which protrudes radially inward is provided at an upper end portion of the engagement plate portion.

The lid member 122 is mounted on a rear end portion of the tubular wall portion 124 in the bottom member 121. The lid member 122 closes an upper end opening of the bottom member 121 to open and close. The lid member 122 includes a disk-shaped top plate portion 133 which is disposed coaxially with the container axis O, and a cylindrical tubular portion 134 which extends downward from an outer circumferential edge of the top plate portion 133. A mirror M is fixed to a lower surface of the top plate portion 133 of the lid member 122.

An engagement piece 135 is provided at a front end portion of the lid member 122 to protrude downward. The engagement piece 135 is formed in a plate shape which protrudes downward from an inner circumferential surface of the tubular portion 134 and extends in the right and left direction Y, and enters the engagement space 125 from the upper side. A second engagement portion 136 which protrudes rearward and is undercut-fitted to the first engagement portion 129 formed on the bottom member 121 to be separable is formed at a lower end portion of the engagement piece 135. The lid member 122 is locked in a closed state by the second engagement portion 136 engaging with the first engagement portion 129 from the lower side.

A push piece 137 which releases the engagement between the first engagement portion 129 and the second engagement portion 136 is provided in the engagement space 125. The push piece 137 includes an operation wall portion 138 disposed forward from the engagement piece 135, a release protrusion 139 which protrudes rearward from the operation wall portion 138 and is located on the inclined surface of the guide wall portion 128, and a base portion 140 which protrudes rearward from a lower end portion of the operation wall portion 138 and is mounted on the bottom wall portion 127. The push piece 137 is movable rearward with respect to the bottom member 121 and the lid member 122 when the push piece 137 is pushed rearward.

The release protrusion 139 moves rearward along the inclined surface of the guide wall portion 128 according to rearward movement of the push piece 137 and pushes up the second engagement portion 136 from the lower side to separate the second engagement portion 136 from the first engagement portion 129. Thus, the engagement between the first engagement portion 129 and the second engagement portion 136 can be released, and the lid member 122 can be brought into a state in which it can be operated to be open. When the push piece 137 moves rearward, the push piece 137 is restored and moved forward by restoring deformation of the release protrusion 139.

The base portion 140 enters from the front into the relief hole 130 formed in the rear wall portion 126 in accordance with the rearward movement of the push piece 137. Further, a locking convex portion 142 which protrudes downward and is locked to a locking concave 1 portion 141 formed in the bottom wall portion 127 is formed at the base portion 140.

Accordingly, the push piece 137 is combined with the outer shell 111 in a state in which the push piece 137 is prevented from being removed forward.

The above-described push piece 137 is not essential and may not be provided. For example, the engagement between the first engagement portion 129 and the second engagement portion 136 may be released by causing the lower end portion of the engagement piece 135 to be slightly bent forward using a fingertip or the like, and thus the lock of the lid member 122 in the closed state may be released.

The inner container 112 is disposed on the radial inside of the tubular wall portion 124 of the bottom member 121. The inner container 112 is a flat cylindrical container which is disposed coaxially with the container axis O and opens upward. The inner container 112 is flexible and is reducible in volume (deformable to be reduced in volume). The inner container 112 is constituted by, for example, a laminated film or a thin resin molded product. The inner container 112 may be a so-called delamination container in which an inner container having excellent flexibility is laminated on an inner surface of the outer container harder than the inner container. Other constitutions in which a volume in the inner container 112 (an accommodation space 145 which will be described later) is reducible may be employed. An annular fitting ring 143 which surrounds an upper end of the inner container 112 on the radial outside thereof is fixed to an upper end portion of the inner container 112. The fitting ring 143 has an engagement tubular portion 144 which protrudes upward.

The accommodation space 145 which is the inside of the inner container 112 accommodates contents having fluidity. The contents may be a liquid phase, a gel phase, or a jelly phase. The contents are, for example, cosmetics such as liquid foundation.

The inner lid 113 is disposed above the inner container 112. The inner lid 113 closes an upper opening of the inner container 112 and seals the inside of the inner container 112. The inner lid 113 includes a lower member 146 directly mounted in the inner container 112 and an upper member 147 mounted in the inner container 112 via the lower member 146.

The lower member 146 includes an inner lid disk portion 148, an inner tubular portion 149, and an outer tubular portion 150. The inner lid disk portion 148 is in the form of a disk which is disposed coaxially with the container axis O. The inner lid disk portion 148 covers the upper opening of the inner container 112. A mounting tubular portion 151 which extends upward is formed at the inner lid disk portion 148. The mounting tubular portion 151 protrudes upward from an inner circumferential end of the inner lid disk portion 148. The mounting tubular portion 151 is disposed coaxially with the container axis O. The mounting tubular portion 151 is open into the inner container 112. The inner tubular portion 149 has a cylindrical shape which extends upward from an outer circumferential edge of the inner lid disk portion 148. The outer tubular portion 150 has a cylindrical shape which is disposed coaxially with the container axis O on the radial outside of the inner tubular portion 149. An upper end portion of the outer tubular portion 150 is connected to an upper end portion of the inner tubular portion 149.

The engagement tubular portion 144 of the fitting ring 143 is fitted to a space between the outer tubular portion 150 and the inner tubular portion 149 in the radial direction. Thus, the inner container 112 and the inner lid 113 are fixed via the fitting ring 143. A lower end of the outer tubular portion 150 and a lower end of the inner tubular portion 149 are in contact with the fitting ring 143.

The upper member 147 includes a fitting tubular portion 152, a first valve seat portion 153, an outer circumferential tubular portion 154, and a connection annular portion 155. The fitting tubular portion 152 is formed in a cylindrical shape which is coaxial with the container axis O. The fitting tubular portion 152 is fitted into the mounting tubular portion 151. The first valve seat portion 153 includes a tubular portion (a circumferential wall portion) which is disposed coaxially with the container axis O and has a diameter smaller than that of the fitting tubular portion 152, and a valve seat plate which extends radially inward from an upper end portion of the tubular portion. A lower end portion of the tubular portion of the first valve seat portion 153 is connected to a lower end portion of the fitting tubular portion 152. The valve seat plate of the first valve seat portion 153 is located below an upper end of the fitting tubular portion 152. A communication hole 156 which passes through the valve seat plate in the vertical direction Z is formed in a central portion of the valve seat plate of the first valve seat portion 153. Therefore, the valve seat plate has a ring plate shape. The communication hole 156 has a circular hole shape which is disposed coaxially with the container axis O. The communication hole 156 communicates with the inside of the inner container 112. That is, the communication hole 156 which communicates with the inside of the inner container 112 is formed in the inner lid 113.

The outer circumferential tubular portion 154 has a cylindrical shape which is coaxial with the container axis O. The outer circumferential tubular portion 154 has a diameter larger than that of the fitting tubular portion 152 and smaller than that of the inner tubular portion 149. The outer circumferential tubular portion 154 is disposed in the inner tubular portion 149. A flange portion which extends radially outward from a lower end portion is formed on the lower end portion of the outer circumferential tubular portion 154. The flange portion of the outer circumferential tubular portion 154 faces a radially outer end portion of an upper surface of the inner lid disk portion 148 from the upper side.

The connection annular portion 155 is disposed coaxially with the container axis O. The connection annular portion 155 has a ring plate shape of which a plate surface faces in the vertical direction Z. An inner circumferential edge portion of the connection annular portion 155 is connected to an upper end portion of the fitting tubular portion 152. An outer circumferential edge portion of the connection annular portion 155 is connected to an upper end portion of the outer circumferential tubular portion 154. The outer circumferential edge portion of the connection annular portion 155 is located below an upper end of the outer circumferential tubular portion 154 and above a center of the outer circumferential tubular portion 154 in the vertical direction Z.

A plurality of accommodation concave portions 177 are formed in the connection annular portion 155 at intervals in the circumferential direction. In the example of the embodiment, the accommodation concave portions 177 are disposed on the left, right and rear of the container axis O (refer to FIG. 7). As shown in FIG. 8, the accommodation concave portion 177 has a concave shape which is recessed downward in the connection annular portion 155. The second valve seat portion 167 is disposed on a portion of the connection annular portion 155 located forward from the container axis O. The second valve seat portion 167 has a protruding shape which protrudes upward at the connection annular portion 155. In the embodiment, the second valve seat portion 167 has a tubular shape with a top. In the illustrated example, the second valve seat portion 167 protrudes upward from a bottom wall of a tubular recessed portion 178 with a bottom. The recessed portion 178 is disposed in a portion of the connection annular portion 155 located forward from the container axis O. The recessed portion 178 has a concave shape which is recessed downward in the connection annular portion 155. As shown in FIG. 7, in the example of the embodiment, the second valve seat portion 167 and the recessed portion 178 have an arc shape which extends in the circumferential direction.

As shown in FIG. 8, the middle lid 114 is provided above the inner lid 113.

The middle lid 114 is formed in a tubular shape with a top. The middle lid 114 includes a mounting ring 157 which forms a circumferential wall of the middle lid 114, and an operation portion 158 which forms a top wall of the middle lid 114.

The mounting ring 157 is mounted to the inner lid 113. The mounting ring 157 is formed in a double cylindrical shape having an inner cylinder 159 and an outer cylinder 160 of which upper ends are connected to each other. A plurality of circumferential grooves (not shown) which extend in the circumferential direction are formed in a lower portion of an outer circumferential surface of the outer cylinder 160 at intervals in the circumferential direction. The engagement claw of the engagement plate portion (not shown) of the bottom member 121 engages with the circumferential grooves. Thus, the mounting ring 157 is prevented from being separated from the bottom member 121.

The lower member 146 (the inner tubular portion 149 and the outer tubular portion 150) of the inner lid 113 is fitted and fixed between the inner cylinder 159 and the outer cylinder 160 in the mounting ring 157. Therefore, the inner container 112 is fixed to the mounting ring 157 (the middle lid 114) via the fitting ring 143. The inner container 112 is disposed to be separated upward from the bottom plate portion 123 of the bottom member 121 in a state in which the inner container 112 is fixed to the middle lid 114.

A raised portion 162 which protrudes upward is formed on an upper surface of the mounting ring 157. The raised portion 162 has an annular shape. A shape of the raised portion 162 in a plan view is a circular ring shape which is disposed coaxially with the container axis O. An inner circumferential surface of the raised portion 162 has a curved surface shape which extends radially outward toward the upper side. In a closed state of the compact container 190110, a puff P (an applicator) is mounted on an upper surface of the operation portion 158 located on the radial inside of the raised portion 162.

A flange portion 163 which extends outward in the radial direction is provided on an outer circumferential surface of the mounting ring 157. The flange portion 163 is provided over the entire circumference of the outer circumferential surface of the mounting ring 157. A lower surface of the flange portion 163 is in contact with an upper surface of the tubular wall portion 124 of the bottom member 121 from the upper side.

The operation portion 158 closes the inside of the mounting ring 157 from the upper side. In the embodiment, the operation portion 158 has a disk shape. An outer circumferential edge portion of the operation portion 158 is connected to an upper surface of a portion of the mounting ring 157 located on the radial inside of the raised portion 162. The upper surface of the operation portion 158 is formed to be flush with a portion of the mounting ring 157 which is continuous with the operation portion 158 from the radial outside thereof without a step. The operation portion 158 is disposed at a position which overlaps the first valve body 115 which will be described later when seen in the vertical direction Z.

The operation portion 158 is formed to be elastically deformable. For example, a soft material such as an elastomer, nitrile rubber, butyl rubber, silicone rubber, soft polyethylene, or urethane may be used as a material of the operation portion 158. Further, in consideration of chemical resistance to the contents, for example, elastically deformable and relatively soft polypropylene (PP), polyethylene terephthalate (PET) molded to be thin, or the like may be used as the material of the operation portion 158. The operation portion 158 is softer than the mounting ring 157, and the mounting ring 157 is harder than the operation portion 158. In the illustrated example, a central portion of the operation portion 158 located on the radial inside of the outer circumferential edge portion (a portion connected to the mounting ring 157) is formed to be elastically deformable in the vertical direction Z.

A hanging tubular portion 179, a restriction wall portion 181, and an elastic plate 182 are provided on a lower surface of the operation portion 158. The hanging tubular portion 179 is disposed coaxially with the container axis O. The hanging tubular portion 179 has a cylindrical shape which protrudes downward from the lower surface of the operation portion 158. The hanging tubular portion 179 is fitted to the inside of the inner cylinder 159 in the radial direction and is fitted to the outside of the outer circumferential tubular portion 154 in the radial direction. The hanging tubular portion 179 is sandwiched and fixed in the radial direction by the inner cylinder 159 and the outer circumferential tubular portion 154. In the illustrated example, an upper end of the outer circumferential tubular portion 154 is in contact with the lower surface of the operation portion 158.

The restriction wall portion 181 has a tubular shape which protrudes downward from the lower surface of the operation portion 158. The restriction wall portion 181 surrounds the second valve seat portion 167 in the directions (the forward and rearward direction X and the right and left direction Y) other than the vertical direction Z. In the illustrated example, the second valve seat portion 167 is fitted into the restriction wall portion 181. Further, a lower end portion of the restriction wall portion 181 is fitted into a circumferential wall of the recessed portion 178. Therefore, the lower end portion of the restriction wall portion 181 is sandwiched and fixed by the circumferential wall of the second valve seat portion 167 and the circumferential wall of the recessed portion 178 in the directions other than the vertical direction Z. Further, the lower end of the restriction wall portion 181 is in contact with a bottom wall of the recessed portion 178 from the upper side. Although not illustrated in particular, in the bottom view of the operation portion 158, the restriction wall portion 181 has an arc shape which extends in the circumferential direction corresponding to shapes of the second valve seat portion 167 and the recessed portion 178.

The elastic plate 182 has a plate shape which protrudes downward from the lower surface of the operation portion 158. The elastic plate 182 is elastically deformable. As shown in FIG. 7, in the example of the embodiment, the elastic plate 182 has a rectangular plate shape. A plurality of elastic plates 182 are formed on the lower surface of the operation portion 158 at intervals in the circumferential direction. The elastic plate 182 is disposed on the left, right and rear of the container axis O. As shown in FIG. 8, the elastic plate 182 extends rearward from the lower surface of the operation portion 158 toward the lower side. The elastic plate 182 is disposed in the accommodation concave portion 177. A lower end portion of the elastic plate 182 is in contact with a bottom surface of the accommodation concave portion 177. The elastic plate 182 is integrally formed with the operation portion 158.

An annular thin portion 164 is formed in the operation portion 158. The thin portion 164 is disposed coaxially with the container axis O. The thin portion 164 is formed in a portion of the operation portion 158 which defines a communication space 165 described later. The thin portion 164 is formed on the outer circumferential portion of the central portion of the operation portion 158. The thin portion 164 is formed by indenting the lower surface of the operation portion 158 upward. An upper surface of the operation portion 158 is formed to be flush at both sides (the inside and outside) straddling the thin portion 164 in the radial direction.

The middle lid 114 defines the communication space 165 which communicates with the communication hole 156 between the inner lid 113 and the middle lid 114. In the embodiment, the communication space 165 is formed by closing an upper opening of the outer circumferential tubular portion 154 (the upper member 147) by the operation portion 158. The operation portion 158 closes the inside of the mounting ring 157 from the upper side and defines the communication space 165 in the inside of the mounting ring 157. The communication space 165 is formed in a circular shape in a plan view. A size (a height) of the communication space 165 in the vertical direction Z is smaller than ½ of a size of the outer circumferential tubular portion 154 in the vertical direction Z. The operation portion 158 is elastically deformed and thus increases or decreases an internal pressure of the communication space 165.

As shown in FIGS. 7 and 8, a discharge hole 166 which discharges the contents is formed in the middle lid 114. A shape of the discharge hole 166 in plan view is circular. A plurality of discharge holes 166 are formed in the middle lid 114. In the embodiment, the discharge holes 166 are located in a portion of the middle lid 114 located forward from the container axis O and are disposed in an arc in the circumferential direction.

As shown in FIG. 8, the discharge holes 166 are formed in the operation portion 158 and pass through the operation portion 158 in the vertical direction Z. The discharge holes 166 communicate with the communication space 165. In the embodiment, the discharge holes 166 and the communication space 165 communicate with each other by a plurality of groove portions 183 formed in the circumferential wall of the second valve seat portion 167 and the bottom wall and the circumferential wall of the recessed portion 178. The discharge holes 166 are closed by the second valve seat portion 167 provided in the inner lid 113. The discharge holes 166 are closed from the lower side by a top wall of the second valve seat portion 167. The middle lid 114 is manufactured, for example, by insert molding using the mounting ring 157 as an insert article.

The first valve body 115 is a valve which switches between communication and blocking between the communication hole 156 of the inner lid 113 and the communication space 165. In the embodiment, the first valve body 115 is provided on the inner lid 113. The first valve body 115 includes a valve cylinder 184 and a valve main body 185. In the embodiment, the valve cylinder 184 is fitted into the fitting tubular portion 152 of the inner lid 113. A tubular portion (a circumferential wall portion) of the first valve seat portion 153 is disposed in the valve cylinder 184. A lower end of the valve cylinder 184 is in contact with a ring plate-shaped connection portion which connects a lower end portion of the tubular portion of the first valve seat portion 153 with a lower end portion of the fitting tubular portion 152 from the upper side. The valve main body 185 is connected to an upper end of the valve cylinder 184. The valve main body 185 is disposed inside the valve cylinder 184. The valve main body 185 includes a disk-shaped valve plate and a plurality of elastic legs which connect the valve plate with the valve cylinder 184. The valve main body 185 is movable in the vertical direction Z with respect to the valve cylinder 184. The valve seat plate of the first valve seat portion (the communication tubular portion) 153 is in contact with the valve plate of the valve main body 185 from the lower side.

The first valve body 115 covers the upper side of the communication hole 156. The first valve body 115 is a check valve. The first valve body 115 allows a flow of a fluid (the contents, hereinafter, the same) from the accommodation space 145 of the inner container 112 to the communication space 165 and blocks the flow of the fluid from the communication space 165 to the accommodation space 145. In the example of the embodiment, a three-point valve may be used as the first valve body 115. For example, a shape of the three-point valve may be appropriately changed or a check valve having a constitution different from that of the three-point valve may be adopted as the first valve body 115 according to properties of the contents stored in the inner container 112.

The second valve body 116 is a valve which switches between communication and blocking between the discharge hole 166 of the middle lid 114 and the communication space 165. In the embodiment, the second valve body 116 is provided in the middle lid 114. The second valve body 116 is integrally formed with the operation portion 158. The second valve body 116 is formed by a portion of the operation portion 158 including an opening circumferential portion of the discharge hole 166. In the embodiment, the second valve body 116 is formed in a portion of the operation portion 158 which is surrounded by the tubular restriction wall portion 181.

The second valve body 116 is formed to be thinner than the other portions of the operation portion 158 and to be thinner than the thin portion 164. A shape of the second valve body 116 in a plan view is similar to a shape of the second valve seat portion 167 in a plan view and is larger than the shape of the second valve seat portion 167 in the plan view (refer to FIG. 7). As shown in FIG. 8, the second valve body 116 blocks the communication between the discharge hole 166 and the communication space 165 by being seated on the second valve seat portion 167. The second valve body 116 causes the discharge hole 166 to communicate with the communication space 165 when the second valve body 116 is elastically deformed and separated from the second valve seat portion 167. The second valve body 116 is a check valve. The second valve body 116 allows the flow of the fluid from the communication space 65 to the outside and blocks the flow of the fluid from the outside to the communication space 165.

As shown in FIGS. 7 and 8, in the embodiment, the biasing portion 198 has a plate shape which protrudes upward from the upper end surface of the valve cylinder 184. The biasing portion 198 is elastically deformable. The biasing portion 198 has a band plate shape (a rectangular plate shape), and both end portions thereof in the extension direction are respectively connected to an upper end portion of the valve cylinder 184. Both end portions of the biasing portion 198 are connected to both portions of the upper end portion of the valve cylinder 184 which face in the radial direction with the container axis O interposed therebetween. A central portion of the biasing portion 198 located between both the end portions in the extension direction has a protruding shape which bulges upward. The central portion 199 of the biasing portion 198 in the extension direction is in contact with the lower surface of the operation portion 158 from the lower side. The central portion 199 of the biasing portion 198 in the extension direction is formed to be thicker than the portions other than the central portion 199. In the illustrated example, the extension direction of the biasing portion 198 is along the forward and rearward direction X. The extension direction of the biasing portion 198 is not limited to the forward and rearward direction X.

The biasing portion 198 biases upward the operation portion 158 which has moved downward. In a state before the operation portion 158 moves downward (a state shown in FIG. 8), the biasing portion 198 may bias the operation portion 158 upward or may not bias it. As shown in FIG. 8, the biasing portion 198 is disposed between the inner lid 113 and the middle lid 114. The biasing portion 198 is disposed between the upper member 147 of the inner lid 113 and the operation portion 158 of the middle lid 114. The biasing portion 198 is disposed in the communication space 165.

The biasing portion 198 is provided on the lower surface of the operation portion 158. The biasing portion 198 is disposed so that a center thereof is coaxial with the container axis O. The biasing portion 198 biases upward a portion of the operation portion 158 which overlaps the first valve body 115 when seen in the vertical direction Z.

In the embodiment, the inner container 112, the inner lid 113 and the middle lid 114 constitute a refill container 117. The refill container 117 is provided detachably to the outer shell 111. Thus, a user can replace the refill container 117 with a new refill container 117 filled with the contents after using up the contents in the inner container 112. When the refill container 117 is removed from the outer shell 111, the user releases the engagement state between the engagement claw of the engagement plate portion of the bottom member 121 and the circumferential groove of the mounting ring 157.

Next, a discharge method of the contents of the compact container 190 of the embodiment will be described. When the compact container 190 is in an unused state, the contents are accommodated only in the accommodation space 145, and the communication space 165 is filled with, for example, air. First, the user operates the push piece 137 to open the lid member 122 of the outer shell 111 and then presses the operation portion 158 from the upper side to be elastically deformed and thus to be recessed downward. When the operation portion 158 is elastically deformed to be recessed downward, a volume of the communication space 165 is reduced, and thus an internal pressure of the communication space 165 increases. That is, when at least a part of the operation portion 158 is moved downward, the internal pressure of the communication space 165 is increased. Then, the second valve body 116 bulges and is elastically deformed upward by the internal pressure of the communication space 165 and is separated from the second valve seat portion 167, the closed state of the discharge hole 166 is released, and some of the air in the communication space 165 is discharged from the discharge hole 166 to the outside. Thereafter, the second valve body 116 is deformed and restored to be seated on the second valve seat portion 167 and closes the discharge hole 166. At this time, since the first valve body 115 blocks movement of the fluid from the communication space 165 to the accommodation space 145, the communication hole 156 is closed by the first valve body 115, and a flow of the air in the communication space 165 from the communication hole 156 to the accommodation space 145 is curbed. In this way, when the internal pressure of the communication space 165 is increased by downward movement of the operation portion 158, the first valve body 115 blocks the communication between the communication hole 156 and the communication space 165, and the second valve body 116 causes the discharge hole 166 to communicate with the communication space 165.

When the operation portion 158 is pressed down, the biasing portion 198 is elastically deformed. At this time, the biasing portion 198 biases the operation portion 158 upward by a restoring deformation force.

Next, the user releases the pressing force applied to the operation portion 158 and restores the elastically deformed operation portion 158 to an original state. At this time, the biasing portion 198 biases the operation portion 158 upward to urge restoring deformation. In addition, the elastic plate 182 assists the restoring deformation of the operation portion 158. Therefore, the volume of the communication space 165 increases, and a pressure in the communication space 165 becomes negative. That is, as the portion of the operation portion 158 which has moved downward is moved upward to the original position, the internal pressure of the communication space 165 is lowered. At this time, since the discharge hole 166 is closed by the second valve body 116, entry of air into the communication space 165 from the outside is curbed. Thus, the contents in the accommodation space 145 are suctioned up into the communication space 165 through the communication hole 156. Since the first valve body 115 allows the flow of the fluid from the accommodation space 145 to the communication space 165, the first valve body 115 is in a state in which the communication hole 156 and the communication space 165 communicates with each other and thus does not inhibit the flow of the contents. Accordingly, the contents flow into the communication space 165. In this way, when the internal pressure of the communication space 165 is lowered by upward movement of the operation portion 158, the second valve body 116 blocks the communication between the discharge hole 166 and the communication space 165, and the first valve body 115 causes the communication hole 156 to communicate with the communication space 165.

The user can discharge the air of the communication space 165 to the outside and can fill the communication space 165 with the contents by performing the elastic deformation and the restoring deformation of the operation portion 158 a plurality of times. Here, since the inner container 112 has flexibility and is reduced in volume (deformed to be reduced in volume) by the contents flowing out to the communication space 165 through the communication hole 156, when the internal pressure of the accommodation space 145 decreases as the contents decrease, the inner container 112 is deformed and contacted, and the volume of the accommodation space 145 decreases. Thus, even when the contents flow into the communication space 165 and the total amount of the contents in the accommodation space 145 decreases, it is possible to stably send the contents from the accommodation space 145 to the communication space 165.

When the operation portion 158 is elastically deformed in a state in which the contents are filled in the communication space 165, the internal pressure of the communication space 165 increases. Thus, the second valve body 116 bulges and is deformed upward, and the closing of the discharge hole 166 is released. Therefore, the contents pushed out from the communication space 165 are discharged from the discharge hole 166 to the outside. In this way, the user can discharge the contents. The contents are discharged from the discharge hole 166 to the inside of the raised portion 162 on the upper surface of the middle lid 114. Therefore, overflowing of the contents from the upper surface of the middle lid 114 can be curbed. The user wipes the upper surface of the middle lid 114 with a puff P or the like, and the contents become adhered to the puff P or the like and then the contents are used.

As described above, according to the compact container 190 of the embodiment, when the internal pressure of the communication space 165 is increased by the downward movement of the operation portion 158, the first valve body 115 blocks the communication between the communication hole 156 and the communication space 165, and the second valve body 116 causes the discharge hole 166 to communicate with the communication space 165. Also, when the internal pressure of the communication space 165 is lowered by the upward movement of the operation portion 158, the second valve body 116 blocks the communication between the discharge hole 166 and the communication space 165, and the first valve body 115 causes the communication hole 156 to communicate with the communication space 165. Thus, the user presses the operation portion 158 or releases the pressing to elastically deform the operation portion 158, increases or decreases the internal pressure of the communication space 165, makes the inside of the communication space 165 have a negative pressure, causes the contents in the inner container 112 to flow into the communication space 165, and thus can fill the communication space 165 with the contents. In this state, when the internal pressure of the communication space 165 is increased by the pressing of the operation portion 158, the contents can be discharged from the discharge hole 166 by an amount corresponding to the increase in the internal pressure of the communication space 165.

Additionally, in the embodiment, the biasing portion 198 which biases upward the operation portion 158 that has been moved downward is provided. Therefore, when the pressing of the operation portion 158 is released, the biasing portion 198 stably returns the operation portion 158 to the original position before the pressing. That is, the biasing portion 198 assists the elastically deformed operation portion 158 to be restored and deformed. Accordingly, the contents can be stably suctioned from the inner container 112 into the communication space 165, and then the discharge amount of the contents when the operation portion 158 is pressed the next time can be made a desired amount. Therefore, in the compact container 190 of the embodiment, adjustment of the discharge amount of the contents is easy.

Further, since the operation portion 158 is stably returned to the position before the pressing by the biasing portion 198, the operability of the operation portion 158 is good. Thus, even when sealability by the second valve body 116 is ensured by forming the operation portion 158 of, for example, an elastically deformable soft material such as an elastomer, it is possible to have good restorability.

Specifically, as in the embodiment, when the second valve body 116 is integrally formed with the operation portion 158, a soft material is employed as the operation portion 158 to ensure the sealability of the second valve body 116. Thus, the restoration characteristics of the operation portion 158 are more difficult to secure. Such a problem is solved by providing the biasing portion 198. That is, the sealability of the second valve body 116 and the restoration characteristics of the operation portion 158 can be compatible by providing the biasing portion 198.

In addition, since the middle lid 114 includes the operation portion 158, that is, the operation portion 158 is a part of the middle lid 114, an increase in the number of components due to the providing the operation portion 158 can be curbed. Also, since the operation portion 158 defines the communication space 165, for example, the operation portion 158 can be formed to be large according to a size of the communication space 165, and a range in which the user can operate when the contents are discharged can be expanded.

Further, in the embodiment, since the biasing portion 198 biases a portion of the operation portion 158 which overlaps the first valve body 115 when seen in the vertical direction Z, the following effects can be obtained. That is, in this case, the operation portion 158, the biasing portion 198 and the first valve body 115 can be arranged and disposed in the vertical direction Z. Since the operation portion 158 and the first valve body 115 can be disposed at positions close to each other, the variation (a positive pressure, a negative pressure) of the internal pressure of the communication space 165 when the operation portion 158 is operated can easily act on the first valve body 115. Therefore, the operation of the first valve body 115 is stabilized. Further, a portion of the operation portion 158 located immediately above the first valve body 115 which is particularly difficult to be restored and deformed can be reliably returned to the original position by the biasing portion 198.

Further, in the embodiment, since the biasing portion 198 is disposed between the inner lid 113 and the middle lid 114, the biasing portion 198 can be easily provided. Also, the biasing portion 198 acts to push up the operation portion 158 from the inside of the communication space 165, and the restoration characteristics of the operation portion 158 are appropriately maintained.

Furthermore, the middle lid 114 includes the mounting ring 157. Therefore, the mounting ring 157 can be appropriately formed to be rigid while the operability is secured based on the elastic deformation of the operation portion 158, and the mountability of the middle lid 114 to the inner lid 113 can be secured by the mounting ring 157. Accordingly, both the operability of the operation portion 158 and the mountability of the middle lid 114 can be secured.

The technical scope of the present invention is not limited to the above-described embodiment. For example, as described below, various modifications can be made to the above-described embodiment without departing from the spirit of the present invention.

In the above-described embodiment, the biasing portion 198 biases the portion of the operation portion 158 which overlaps the first valve body 115 when seen in the vertical direction Z. The biasing portion may bias a portion of the operation portion 158 which does not overlap the first valve body 115 when seen in the vertical direction Z. The biasing portion may not be disposed between the inner lid 113 and the middle lid 114.

Although not particularly shown, the communication space 165 may include a main communication space in which the communication hole 156 opens, and a sub communication space which communicates with the main communication space, and at least a part of a wall surface which defines the sub communication space may be used as the operation portion. In this case, the biasing portion may be provided in the sub communication space, and the biasing portion may bias the operation portion upward.

The biasing portion may be integrally formed with the inner lid 113. In this case, since the biasing portion is integrally formed with the inner lid 113, the number of components can be reduced, and a structure of the compact container can be simplified. Further, since movement of the biasing portion in the container is curbed, the function of the biasing portion is well maintained.

The elastic plate 182 may be integrally formed with the upper member 147 of the inner lid 113 instead of being integrally formed with the operation portion 158. A shape of the elastic plate 182 is not limited to the rectangular plate shape and may be appropriately changed to other plate shapes, shapes other than the plate shape, and the like.

A shape of the operation portion 158 in plan view is not particularly limited and may be an elliptical shape, a triangular shape, a quadrangular shape, or a polygonal shape having five or more sides. Further, a shape of the inner container 112 is not particularly limited and may be, for example, an elliptical cylinder shape or an angular cylinder shape. Further, the inner container 112, the inner lid 113 and the middle lid 114 may not constitute the refill container 117. That is, the structure may be such that the content container 112 cannot be replaced when the contents are used up.

The mounting ring 157 may not be present. Instead of including the mounting ring 157, the elastically deformable operation portion 158 (the elastically deformable portion) may be mounted on the inner lid 113 by being formed in, for example, a tubular shape with a top. The discharge hole 166 may not be formed in the operation portion 158. For example, a flange which protrudes radially inward and defines the communication space 165 may be provided on the mounting ring 157, and the discharge hole 166 may be provided in the flange. Only one discharge hole 166 may be formed. The second valve body 116 may not be formed by the operation portion 158, and the second valve body 116 may be formed by a member different from the operation portion 158. Even when the contents flow into the communication space 165 through the communication hole 156, the volume of the inner container 112 may not be reduced. The inner container 112 may adopt a non-flexible constitution. The thin portion 164 may not be formed in the operation portion 158.

In addition, it is possible to replace components in the embodiment with known components as appropriate without departing from the spirit of the present invention, and the above-described modified examples may also be appropriately combined with the embodiment.

Fourth Embodiment

Next, a compact container 201A according to a fourth embodiment of the present invention will be described with reference to FIGS. 9 to 11.

Figure 9:
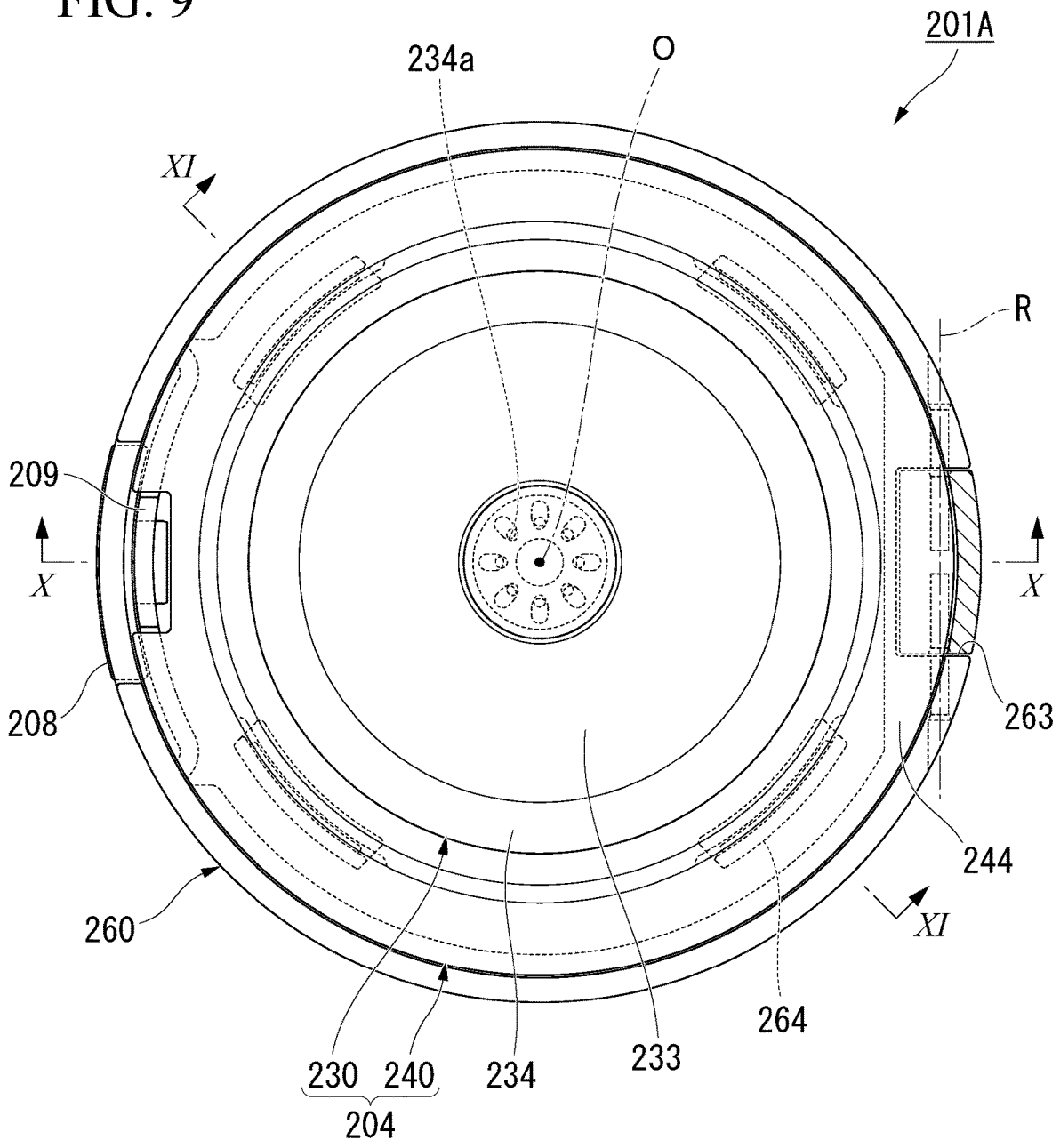
FIG. 9 is a plan view showing a compact container of a fourth embodiment.
Figure 10:
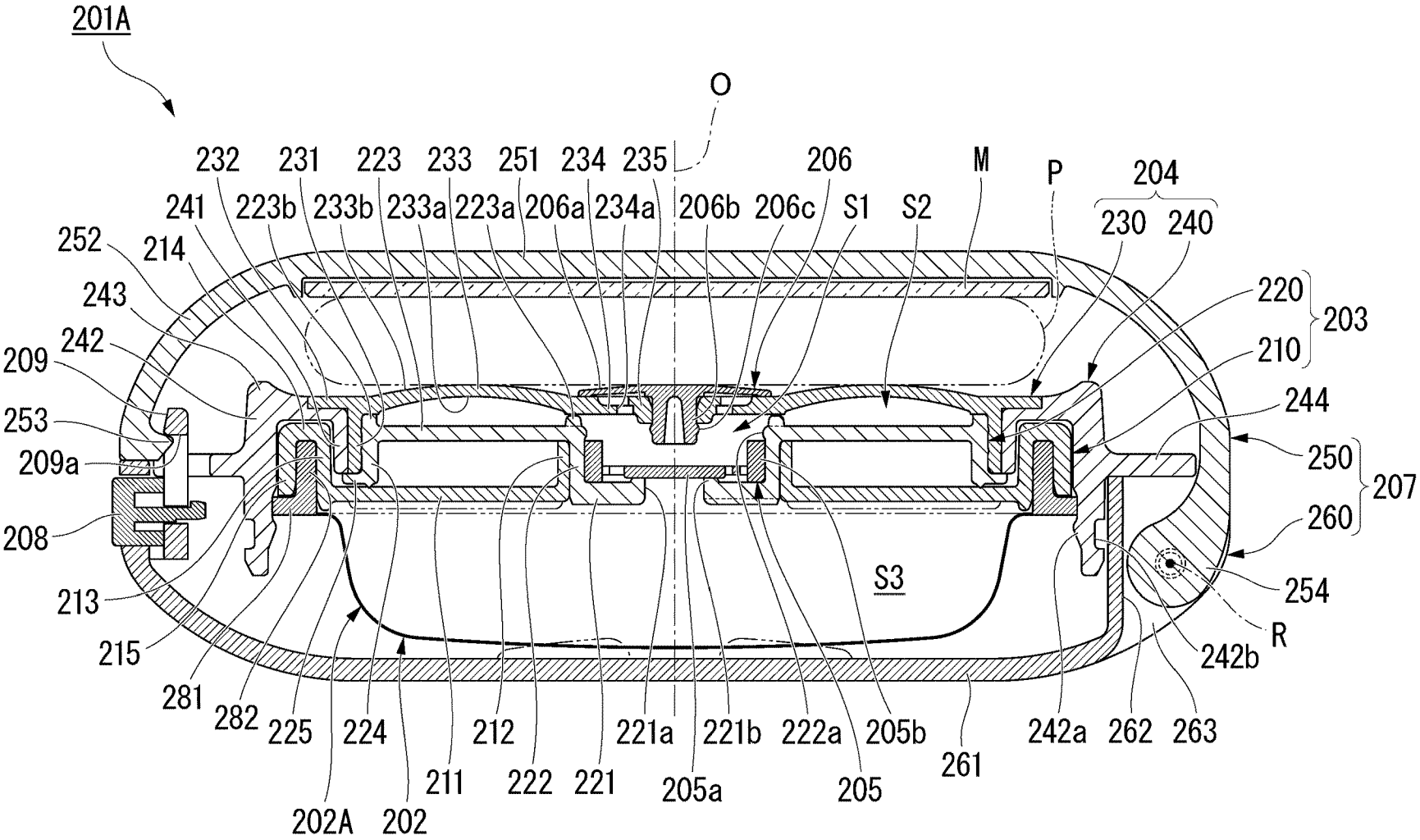
FIG. 10 is a cutaway perspective view taken along line X-X in FIG. 9.

As shown in FIGS. 9 and 10, the compact container 201A includes an inner container 202 in which the contents are accommodated, an inner lid 203 which seals the inside of the inner container 202, a middle lid 204 in which a discharge hole 234*a* for discharging the content is formed, a first valve body 205, a second valve body 206, and an outer shell 207. The inner container 202, the inner lid 203, the middle lid 204, the first valve body 205, and the second valve body 206 are accommodated inside the outer shell 207. The outer shell 207 includes a lid member 250 and a bottom member 260 which are rotatable around the rotational axis R relative to each other.

In the embodiment, a central axis of the outer shell 207 (a central axis of the compact container 201A) is referred to as a container axis O, and a direction along the container axis O is referred to as a vertical direction. Further, in a state in which the lid member 250 is closed, a direction from the bottom member 260 toward the lid member 250 in the vertical direction is referred to as an upward direction, and a direction from the lid member 250 toward the bottom member 260 is referred to as a downward direction. Also, a cross section along the container axis O is referred to as a longitudinal cross section. In plan view when seen in the vertical direction, a direction orthogonal to the container axis O is referred to as a radial direction, and a direction circling around the container axis O is referred to as a circumferential direction. A direction approaching the container axis O in the radial direction is referred to as a radial inside, and a direction away from the container axis O is referred to as a radial outside. In the radial direction, a direction parallel to the rotational axis R is referred to as a right and left direction, and a direction orthogonal to the rotational axis R is referred to as a forward and rearward direction. In the forward and rearward direction, a direction from the container axis O toward the rotational axis R is referred to as a rear, and a direction from the rotational axis R toward the container axis O is referred to as a front.

As shown in FIG. 10, the bottom member 260 includes a disk-shaped bottom plate portion 261 which is disposed coaxially with the container axis O, and a cylindrical tubular wall portion 262 which extends upward from an outer circumferential edge of the bottom plate portion 261 and is formed in a tubular shape with a bottom. A concave portion 263 which is recessed forward is provided in a rear end portion of the bottom member 260. A push piece 208 and a locking member 209 are provided at a front end portion of the bottom member 260. The push piece 208 is located forward from the locking member 209, and at least a part thereof protrudes forward from the tubular wall portion 262. The push piece 208 is provided to be movable rearward with respect to the bottom member 260 in a state in which it is biased forward. A locking hole 209*a* which is recessed rearward is formed in the locking member 209. In the embodiment, the locking hole 209*a* passes through the locking member 209 in the forward and rearward direction.

Figure 11:
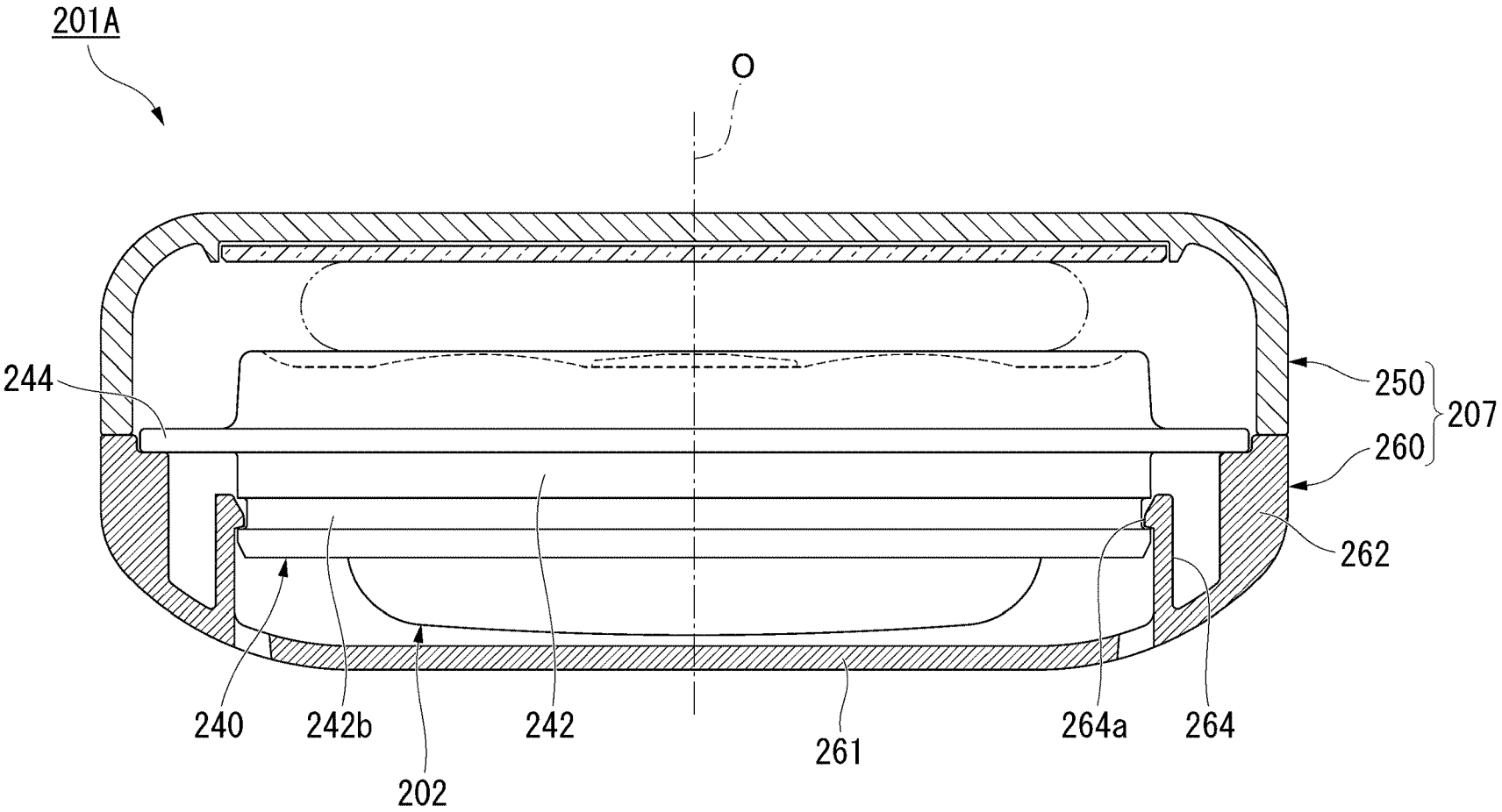
FIG. 11 is a cutaway perspective view taken along line XI-XI in FIG. 9.

As shown in FIG. 11, a locking piece 264 which extends upward from the bottom plate portion 261 is formed at the bottom member 260. A locking portion 264*a* which protrudes inward in the radial direction is formed at an upper end portion of the locking piece 264. As shown in FIG. 9, a plurality of locking pieces 264 are formed at regular intervals in the circumferential direction. Each of the locking pieces 264 extends in the circumferential direction and is formed in a plate shape of which front and back surfaces are directed in the radial direction.

As shown in FIG. 10, the lid member 250 includes a disk-shaped top plate portion 251 coaxially arranged with the container axis O, and a cylindrical tubular portion 252 extending downward from the outer peripheral edge of the top plate portion 251. A connection portion 254 which protrudes downward from the tubular portion 252 is formed at a rear end portion of the lid member 250. The connection portion 254 is located in the concave portion 263 of the bottom member 260 and is rotatable around the rotational axis R in the concave portion 263. With this constitution, the lid member 250 is rotatable around the rotational axis R with respect to the bottom member 260 and closes an upper end opening of the bottom member 260 to be openable and closable.

A locking protrusion 253 which protrudes rearward and is removably undercut-fitted to the locking member 209 is formed at a lower end of a front end portion of the tubular portion 252. When the locking protrusion 253 is located in the locking hole 209*a* of the locking member 209, the lid member 250 is locked in the closed state. When the push piece 208 is pushed rearward by a user, the locking member 209 moves rearward with the push piece 208, and the engagement between the locking member 209 and the locking protrusion 253 is released. Thus, the lid member 250 is in a state in which an opening operation thereof is allowed. When the pushing of the push piece 208 toward the rear side is released, the push piece 208 and the locking member 209 are moved and restored forward.

The compact container 201A may not have the above-described push piece 208. For example, the engagement between the locking protrusion 253 and the locking hole 209*a* may be released by pushing the locking protrusion 253 upward with a fingertip or the like, and thus the lock of the lid member 250 in the closed state may be released.

A mirror M is fixed to a lower surface of the top plate portion 251 of the lid member 250. A puff P (an applicator) is disposed between the lid member 250 and the inner lid 203. The puff P is placed on an operation portion 233 of the middle lid 204 which will be described later.

The inner container 202 is disposed inside the tubular wall portion 262 of the bottom member 260 in the radial direction. The inner container 202 is a flat cylindrical container which is disposed coaxially with the container axis O and opens upward. The inner container 202 is flexible and is reducible in volume (deformable to be reduced in volume). The inner container 202 is constituted by, for example, a laminated film or a thin resin molded product. The inner container 202 may be a so-called delamination container in which an inner container having excellent flexibility is laminated on an inner surface of the outer container harder than the inner container. Alternatively, other constitutions capable of reducing the volume of an accommodation space S3 in the inner container 202 may be employed.

The accommodation space S3 which is the inside of the inner container 202 accommodates contents having fluidity. The contents may be a liquid phase, a gel phase, or a jelly phase. The contents are, for example, cosmetics such as liquid foundation. An annular fitting ring 281 which surrounds an upper end portion of the inner container 202 on the radial outside thereof is fixed to the upper end portion of the inner container 202. The fitting ring 281 has a fitting tubular portion 282 which protrudes upward. The fitting ring 281 serves to mount the inner container 202 to the middle lid 204. As a method of fixing the fitting ring 281 to the inner container 202, for example, the fitting ring 281 may be injection-molded using the inner container 202 as an insert article. Alternatively, the inner container 202 and the fitting ring 281 may be bonded or welded, or the molding of the inner container 202 and the fixing of the fitting ring 281 to the inner container 202 may be performed simultaneously.

The inner lid 203 is disposed above the inner container 202. The inner lid 203 closes an upper opening of the inner container 202 and seals the inside of the inner container 202. The inner lid 203 includes a lower member 210 which is mounted in the inner container 202 via the fitting ring 281, and an upper member 220 which is mounted in the inner container 202 via the lower member 210. The lower member 210 may be formed integrally with the fitting ring 281.

The lower member 210 includes a lower annular portion 211 which covers the upper opening of the inner container 202, a mounting tubular portion 212 and an inner tubular portion 213 which extend upward from the lower annular portion 211, an annular connection portion 214 which extends radially outward from an upper end portion of the inner tubular portion 213, and an outer tubular portion 215 which extends downward from an outer circumferential edge of the connection portion 214. The lower annular portion 211, the mounting tubular portion 212, the inner tubular portion 213, the connection portion 214, and the outer tubular portion 215 are disposed coaxially with the container axis O.

The mounting tubular portion 212 protrudes upward from an inner circumferential edge of the lower annular portion 211. A lower end portion of the mounting tubular portion 212 opens toward the inner container 202. The inner tubular portion 213 extends upward from an outer circumferential edge of the lower annular portion 211. The outer tubular portion 215 is located on the radial outside of the inner tubular portion 213. In the radial direction, the inner tubular portion 213 is disposed substantially at the same position as an outer circumferential portion of the inner container 202, and the outer tubular portion 215 is located outside the outer circumferential portion of the inner container 202. The fitting tubular portion 282 of the fitting ring 281 is fitted to a space between the outer tubular portion 215 and the inner tubular portion 213. Thus, the inner container 202 and the inner lid 203 are fixed via the fitting ring 281.

The upper member 220 includes a first valve seat portion 221 which has an annular shape in plan view, an internal tubular portion 222 which extends upward from an outer circumferential edge of the first valve seat portion 221, an upper annular portion 223 which extends radially outward from an upper end portion of the internal tubular portion 222, an outer circumferential tubular portion 224 which extends downward from an outer circumferential edge of the upper annular portion 223, and a lower flange portion 225 which extends radially outward from a lower end portion of the outer circumferential tubular portion 224. The first valve seat portion 221, the internal tubular portion 222, the upper annular portion 223, the outer circumferential tubular portion 224, and the lower flange portion 225 are disposed coaxially with the container axis O.

An inner circumferential surface of the first valve seat portion 221 is a communication hole 221*a* which allows communication between a communication space S1 described later and the inside of the inner container 202. The communication hole 221*a* is formed in a circular hole which is coaxial with the container axis O. An annular valve seat 221*b* which protrudes upward from the first valve seat portion 221 is formed at an upper end opening edge of the communication hole 221*a*. The internal tubular portion 222 is fitted into the mounting tubular portion 212 of the lower member 210. A restriction protrusion 222*a* which protrudes inward in the radial direction is formed at an upper end portion of the internal tubular portion 222. The outer circumferential tubular portion 224 is located between the mounting tubular portion 212 of the lower member 210 and the inner tubular portion 213 in the radial direction. The lower flange portion 225 faces a radially outer end portion of the lower annular portion 211 from the upper side.

The upper annular portion 223 is formed in a plate shape which has an annular shape in plan view and of which front and back surfaces are directed in the vertical direction. The upper annular portion 223 faces the operation portion 233 which will be described later in the vertical direction. An inner diameter and an outer diameter of the upper annular portion 223 are substantially equal to an inner diameter and an outer diameter of the operation portion 233. An inner support portion 223*a* which protrudes upward is formed at an inner circumferential edge portion of the upper annular portion 223. A plurality of inner support portions 223*a* are formed at intervals in the circumferential direction. An annular outer support portion 223*b* which protrudes upward is formed at an outer circumferential portion of the upper annular portion 223.

The middle lid 204 is formed in a tubular shape with a top and includes a top wall member 230 located at a top wall portion thereof, and a mounting ring 240 located at a circumferential wall portion thereof. The middle lid 204 is provided above the inner lid 203 and defines the communication space S1 which communicates with the communication hole 221*a* between the inner lid 203 and the middle lid 204. The middle lid 204 in the embodiment is integrally formed by injection molding the top wall member 230 using the mounting ring 240 as an insert article. The middle lid 204 may be formed by separately forming the top wall member 230 and the mounting ring 240 and then combining them.

The mounting ring 240 is formed in a double cylindrical shape having an inner cylinder 241 and an outer cylinder 242 of which upper ends are connected to each other. A fitting portion 242*a* which protrudes inward in the radial direction is formed at a lower portion of an inner circumferential surface of the outer cylinder 242. Downward movement of the fitting ring 281 and the inner container 202 with respect to the mounting ring 240 is restricted by undercut-fitting of the fitting portion 242*a* to the fitting ring 281. A circumferential groove 242*b* which is recessed inward in the radial direction and extends in the circumferential direction is formed at a lower portion of an outer circumferential surface of the outer cylinder 242. The locking portion 264*a* of the bottom member 260 is engaged with the circumferential groove 242*b* (refer to FIG. 11). Thus, the mounting ring 240 is suppressed from being separated from the bottom member 260, and upward movement of the inner container 202 relative to the bottom member 260 is restricted.

An annular placing portion 244 which extends outward in the radial direction is provided on an outer circumferential surface of the mounting ring 240. The placing portion 244 is provided over the entire circumference of the outer circumferential surface of the mounting ring 240. A lower surface of the placing portion 244 is in contact with an upper surface of the tubular wall portion 262 of the bottom member 260 from the upper side. The placing portion 244 is a portion of the middle lid 204 which is placed on the bottom member 260. With the above-described constitution, the inner container 202 or a refill container 202A described later is mounted in the bottom member 260 via the mounting ring 240.

In the embodiment, the inner container 202, the inner lid 203, and the middle lid 204 constitute the refill container 202A. The refill container 202A is provided detachably to the outer shell 207. Thus, a user can replace the refill container 202A with a new refill container 202A filled with the contents after using up the contents in the inner container 202. The user can remove the refill container 202A from the outer shell 207 by releasing the engagement between the locking portion 264*a* of the bottom member 260 and the circumferential groove 242*b* of the mounting ring 240.

An annular raised portion 243 which protrudes upward is formed on an upper surface of the mounting ring 240. An inner circumferential surface of the raised portion 243 is formed in a curved surface shape which extends radially outward toward the upper side. The raised portion 243 facilitates an operation in which the contents discharged from the discharge hole 234*a* described later is scooped up with the puff P. Further, the raised portion 243 serves to block the discharged contents, for example, to suppress the contents from dripping outside the mounting ring 240, or to stabilize a position of the puff P placed on the middle lid 204.

The top wall member 230 includes an operation portion 233 which has an annular shape in plan view, a locking tubular portion 231 which extends downward from an outer circumferential edge of the operation portion 233, an upper flange portion 232 which extends radially outward from an upper end portion of the locking tubular portion 231, a valve-holding cylinder 235 located at the inside of the operation portion 233 in the radial direction, and an annular connection portion 234 which connects the valve-holding cylinder 235 with the operation portion 233. The locking tubular portion 231, the upper flange portion 232, the operation portion 233, the connection portion 234, and the valve-holding cylinder 235 are disposed coaxially with the container axis O.

The locking tubular portion 231 is locked in the inner cylinder 241 of the mounting ring 240. The locking tubular portion 231 may be locked into the inner cylinder 241 by separately forming the top wall member 230 and the mounting ring 240 and then fitting the locking tubular portion 231 into the inner cylinder 241. The locking tubular portion 231 is externally fitted to the outer circumferential tubular portion 224 of the inner lid 203. The valve-holding cylinder 235 holds the second valve body 206. A tapered surface of which a diameter gradually increases toward the upper side is formed at an upper end opening portion of the valve-holding cylinder 235. The connection portion 234 defines the communication space S1 between the first valve seat portion 221 and the internal tubular portion 222 of the inner lid 203. The communication space S1 is formed in a circular shape which is coaxial with the container axis O in plan view. A discharge hole 234*a* which discharges the contents is formed in the connection portion 234. The discharge hole 234*a* passes through the connection portion 234 in the vertical direction and communicates with the communication space S1.

In the embodiment, the discharge hole 234*a* has a lower hole portion which opens toward the communication space S1, and an upper hole portion which faces a second valve main body 206*a* described later in the vertical direction. As shown in FIG. 9, in the top view, the lower hole portion is formed in a circular shape, and the upper hole portion is formed in an elliptical shape which extends in the radial direction. As shown in FIG. 10, a radially outer end of the upper hole portion is located on the radial outside of a radially outer end of the lower hole portion, and a radially inner end portion of the lower hole portion is located on the radial inside of a radially inner end portion of the upper hole portion. A plurality of discharge holes 234*a* are formed at equal intervals in the circumferential direction. The plurality of discharge holes 234*a* are annularly disposed to surround the container axis O. The number and shape of the discharge holes 234*a* can be changed appropriately.

The operation portion 233 faces the upper annular portion 223 of the inner lid 203 in the vertical direction and defines an operation space S2 between the operation portion 233 and the upper annular portion 223. The operation space S2 is annularly formed in top view. The operation space S2 communicates with the communication space S1 through a gap between the plurality of inner support portions 223*a* disposed at intervals in the circumferential direction. In the longitudinal sectional view, a lower surface 233*a* and an upper surface 233*b* of the operation portion 233 are formed in a shape which protrudes upward. In the embodiment, the lower surface 233*a* and the upper surface 233*b* are formed in a curved surface shape which protrudes upward in a longitudinal sectional view. The upper surface 233*b* is located above the upper flange portion 232. In addition, for example, a trapezoidal shape which protrudes upward in a longitudinal sectional view may be adopted as a shape of the lower surface 233*a* or the upper surface 233*b* of the operation portion 233.

The operation portion 233 is formed to be elastically deformable in the vertical direction. The operation portion 233 elastically deforms to increase or decrease an internal pressure of the operation space S2 and the communication space S1. For example, a soft material such as an elastomer, nitrile rubber, butyl rubber, silicone rubber, soft polyethylene, or urethane may be used as a material of the operation portion 233. Further, in consideration of chemical resistance to the contents, for example, elastically deformable and relatively soft polypropylene (PP), polyethylene terephthalate (PET) molded to be thin, or the like may be used as the material of the operation portion 233. The operation portion 233 is softer than the mounting ring 240, and the mounting ring 240 is harder than the operation portion 233.

The inner support portion 223*a* and the outer support portion 223*b* of the upper member 220 are in contact with an inner circumferential edge portion and an outer circumferential edge portion of the operation portion 233 formed in an annular shape from the lower side of the operation portion 233. The operation portion 233 is supported by the inner support portion 223*a* and the outer support portion 223*b*. Thus, when the operation portion 233 is pressed, the operation portion 233 is elastically deformed in the vertical direction with the inner circumferential edge portion and the outer circumferential edge portion thereof as fixed ends.

The first valve body 205 is mounted on the inner lid 203 and is located in the communication space S1. The first valve body 205 serves to switch the communication and the blocking between the communication hole 221*a* of the inner lid 203 and the communication space S1. In the example of the embodiment, a three-point valve is used as the first valve body 205. A shape of the three-point valve may be appropriately changed or a check valve having a constitution different from that of the three-point valve may be adopted as the first valve body 205 according to properties of the contents accommodated in the inner container 202.

The first valve body 205 includes a valve cylinder 205*b* and a first valve main body 205*a*. The valve cylinder 205*b* is fitted into the internal tubular portion 222 of the inner lid 203 and is located below the restriction protrusion 222*a* of the internal tubular portion 222. Therefore, the first valve body 205 is fixed to the inner lid 203. A lower end of the valve cylinder 205*b* is in contact with the first valve seat portion 221 from the upper side thereof. The first valve main body 205*a* is connected to a lower end portion of the valve cylinder 205*b*. The first valve main body 205*a* is disposed in the valve cylinder 205*b*. The first valve main body 205*a* includes a disk-shaped valve plate, and a plurality of elastic legs which connect the valve plate with the valve cylinder 205*b*. The first valve main body 205*a* can move in the vertical direction with respect to the valve cylinder 205*b* by elastically deforming the elastic legs.

The first valve main body 205*a* is in contact with the valve seat 221*b* from the upper side thereof and covers the upper side of the communication hole 221*a*. The first valve body 205 is a check valve which allows a flow of contents from the accommodation space S3 of the inner container 202 to the communication space S1 and blocks the flow of contents from the communication space S1 to the accommodation space S3.

The second valve body 206 is mounted on the middle lid 204 and closes the discharge hole 234*a* to be openable. The second valve body 206 includes a shaft portion 206*b* which extends in the vertical direction, a second valve main body 206*a* which extends radially outward from an upper end portion of the shaft portion 206*b*, and a retaining portion 206*c* which protrudes radially outward from a lower end portion of the shaft portion 206*b*. The shaft portion 206*b* is fitted into the valve-holding cylinder 235. The retaining portion 206*c* is located below the valve-holding cylinder 235. Thus, the second valve body 206 is suppressed from being separated from the valve-holding cylinder 235 upward. The second valve main body 206*a* has a circular shape in top view and is formed in a curved surface shape (an umbrella shape) which protrudes upward. The second valve main body 206*a* covers the discharge hole 234*a* from the upper side, and an outer circumferential edge of the second valve main body 206*a* is in contact with an upper surface of the connection portion 234.

When the operation portion 233 is pressed and the internal pressure of the communication space S1 increases, the second valve main body 206*a* is elastically deformed to be turned upward with the shaft portion 206*b* as a fixed end. With such a constitution, the second valve body 206 closes the discharge hole 234*a* to be openable. Further, when the internal pressure in the communication space S1 becomes equal to the atmospheric pressure, the second valve main body 206*a* is restored and deformed to close the discharge hole 234*a* again. Therefore, the second valve body 206 also serves as a check valve which suppresses a backflow of the contents or external air discharged from the discharge hole 234*a* into the communication space S1. That is, the second valve body 206 allows the flow of the contents or the air from the communication space S1 to the outside through the discharge hole 234*a* and blocks the flow of the contents and the air from the outside to the communication space S1.

Next, an operation of the compact container 201A in the embodiment will be described.

When the compact container 201A is in an unused state, the contents are accommodated only in the accommodation space S3, and the communication space S1 and the operation space S2 are filled with, for example, air. The user operates the push piece 208 to open the lid member 250 of the outer shell 207. Next, the operation portion 233 is pressed from the upper side and elastically deformed to be recessed downward. At this time, since the operation portion 233 is supported by the inner support portion 223*a* and the outer support portion 223*b*, the operation portion 233 is elastically deformed downward with the inner circumferential edge portion and the outer circumferential edge portion thereof as the fixed ends. Since a volume of the operation space S2 is reduced when the operation portion 233 is elastically deformed downward, the internal pressure of the operation space S2 and the communication space S1 which communicates with the operation space S2 increases. Then, the second valve main body 206*a* is elastically deformed upward by the internal pressure of the communication space S1, the discharge hole 234*a* is open, and some of the air in the communication space S1 is discharged from the discharge hole 234*a* to the outside. Thereafter, the second valve main body 206*a* is restored and deformed to be seated on the connection portion 234, and the discharge hole 234*a* is closed again.

When a pressing force applied to the operation portion 233 is released, the operation portion 233 which has been elastically deformed is restored and deformed to an original state thereof. Thus, the volume of the operation space S2 increases, and the inside of the operation space S2 and the communication space S1 has a negative pressure. At this time, since the discharge hole 234*a* is closed by the second valve body 206, entry of the air from the outside into the communication space S1 is curbed. On the other hand, when the communication space S1 has a negative pressure, an upward force acts on the first valve main body 205*a* due to the negative pressure. As a result, the first valve main body 205*a* is elastically displaced upward, the communication hole 221*a* and the communication space S1 communicate with each other, and the contents in the accommodation space S3 are suctioned up into the communication space S1 and the operation space S2 through the communication hole 221*a*. In this way, when the operation portion 233 moves upward and the internal pressure of the communication space S1 and the operation space S2 decreases, the second valve body 206 blocks the communication between the discharge hole 234*a* and the communication space S1, and also the first valve body 205 causes the communication hole 221*a* to communicate with the communication space S1.

When the above-described elastic deformation and restoring deformation of the operation portion 233 are performed a plurality of times, the air in the communication space S1 and the operation space S2 is discharged to the outside, and the contents are filled in the communication space S1 and the operation space S2. Since the inner container 202 has flexibility, a volume thereof is reduced as the contents flow out to the communication space S1 and the like through the communication hole 221*a*.

Accordingly, even when the contents flow into the communication space S1 and the like and the total amount of the contents in the accommodation space S3 decreases, it is possible to stably send the contents from the accommodation space S3 to the communication space S1 and the operation space S2.

When the operation portion 233 is elastically deformed downward in a state in which the communication space S1 is filled with the contents, the contents in the communication space S1 move toward the second valve main body 206*a* through the discharge hole 234*a* and push up the second valve main body 206*a*. Therefore, the closing of the discharge hole 234*a* due to the second valve main body 206*a* is released, and the contents are discharged from the discharge hole 234*a*. Due to such an operation, the user can discharge the contents by repeating the pressing and releasing of the operation portion 233. Further, since the contents are discharged to the inside of the raised portion 243, the dripping from the upper surface of the middle lid 204 is curbed by the raised portion 243. The user can wipe the upper surface of the middle lid 204 with a puff P or the like to adhere the contents to the puff P or the like and can use the contents.

As described above, according to the compact container 201A of the embodiment, when the operation portion 233 is pressed and the internal pressure of the communication space S1 increases, the contents can be discharged from the discharge hole 234*a* by an amount corresponding to a deformation amount of the operation portion 233. Additionally, in the embodiment, the lower surface 233*a* of the operation portion 233 is formed in a shape which protrudes upward. Therefore, a deformation amount of the lower surface 233*a* when the operation portion 233 is pressed increases, and an in-plane tension acting on the lower surface 233*a* also increases. Thus, when the pressing is released, an upward restoring deformation force acting on the operation portion 233 increases, the operation portion 233 is easily restored and deformed to the shape before the elastic deformation, the amount of the contents suctioned from the inner container 202 into the communication space S1 is stabilized, and the discharge amount of the contents can be stabilized when the operation portion 233 is pressed the next time.

Further, in the embodiment, the lower surface 233*a* of the operation portion 233 is formed in a curved surface shape which protrudes upward. Thus, when the operation portion 233 is elastically deformed, it is possible to curb a large stress from locally acting on the lower surface 233*a*, and durability of the compact container 201A can be improved. Also, since the operation portion 233 is formed in an annular shape in a plan view, when the operation portion 233 is pressed, the operation portion 233 is elastically deformed downward with the inner circumferential edge portion and the outer circumferential edge portion of the operation portion 233 as the fixed ends. Thus, an upward elastic force acting on the operation portion 233 becomes larger, and the operation portion 233 can be restored and deformed to the original shape more stably.

Further, since the upper surface 233*b* of the operation portion 233 is formed in the shape which protrudes upward, the deformation amount and the in-plane tension of the upper surface 233*b* when the operation portion 233 is pressed becomes larger. Therefore, the upward elastic force acting on the operation portion 233 can further increase. Also, the user can easily visually recognize the position of the operation portion 233, and operability of the compact container 201A can be further improved. Furthermore, since the upper surface 233*b* is formed in a curved surface shape which protrudes upward, it is possible to curb a large stress from locally acting on the upper surface 233*b* when the operation portion 233 is elastically deformed, and the upper surface 233*b* may be formed in a smooth shape, for example, to curb partially remaining of the contents discharged from the discharge hole 234*a*.

The technical scope of the present invention is not limited to the above-described embodiment. For example, as described below, various modifications can be made to the above-described embodiment without departing from the spirit of the present invention.

For example, in the embodiment, although the discharge hole 234*a* is disposed near the center in the radial direction (near the container axis O), the discharge hole 234*a* may be disposed radially away from the container axis O, for example. In this case, the operation portion 233 may be formed to have a C shape in a plan view to avoid the discharge hole 234*a*.

Moreover, the constitution of the second valve body 206 is not limited to the above-described embodiment. For example, a constitution in which the discharge hole 234*a* is opened and closed by elastically deforming a portion of the top wall member 230 in the vicinity of the discharge hole 234*a* and bringing the elastically deformed portion into contact with or being separated from a part of the inner lid 203 may be adopted. Alternatively, the discharge hole 234*a* itself may be opened and closed to serve as the second valve body.

Further, the compact container 201A may be a container in which the lid member 250 and the bottom member 260 are screwed together and the lid member 250 is removed from the bottom member 260 by relative rotation around the container axis O.

In addition, it is possible to replace the elements in the above-described embodiment with known elements as appropriate without departing from the spirit of the present invention, and it is also possible to combine appropriately the above-described modified examples with the embodiment.

Fifth Embodiment

Next, a compact container 301B according to a fifth embodiment of the present invention will be described with reference to FIG. 12.

Figure 12:
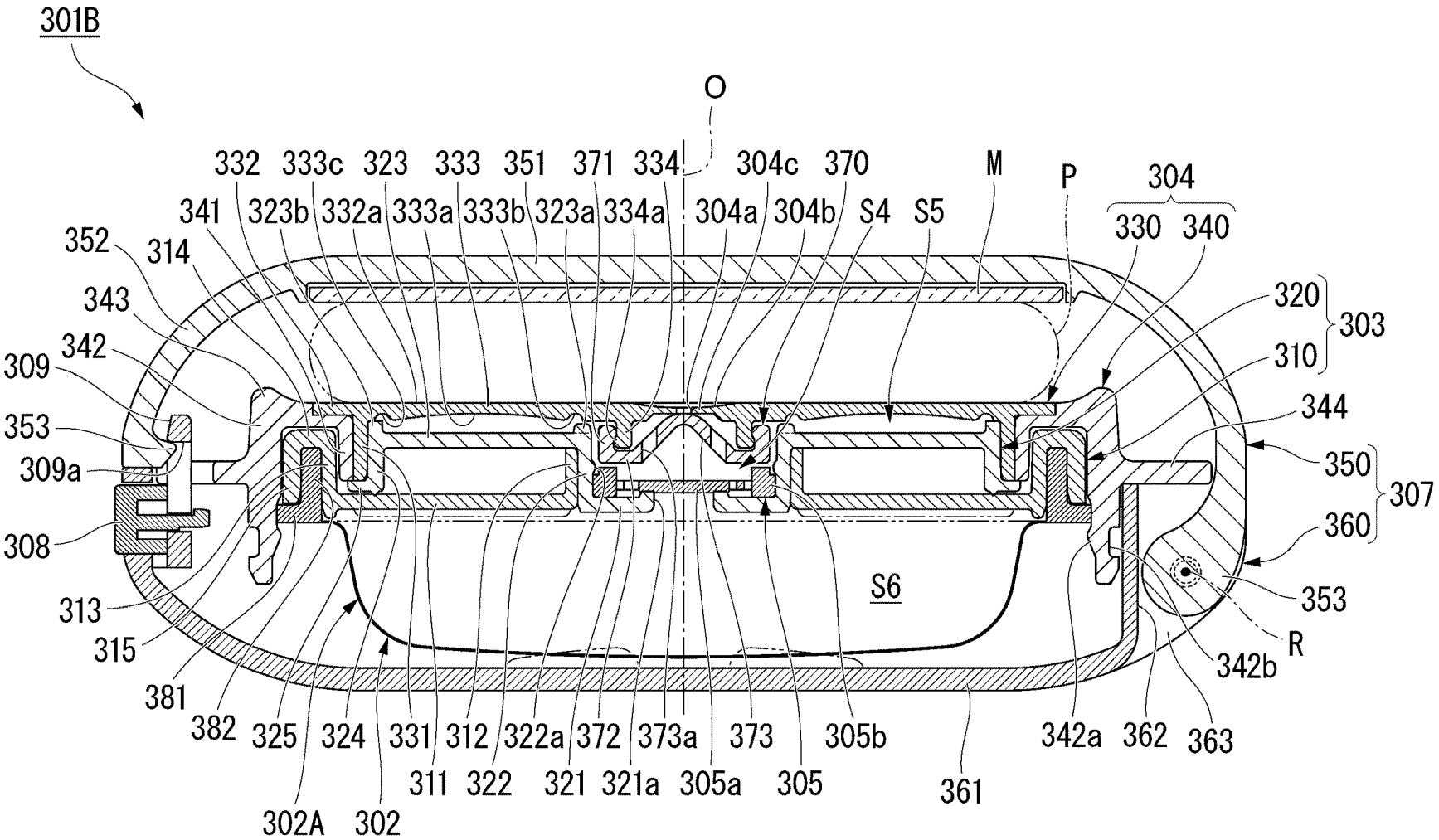
FIG. 12 is a longitudinal sectional view showing a compact container of a fifth embodiment.

As shown in FIG. 12, the compact container 301B includes an inner container 302 in which the contents are accommodated, an inner lid 303 which seals the inside of the inner container 302, a middle lid 304 in which a discharge hole 304*a* for discharging the content is formed, a first valve body 305, a second valve body 370, and an outer shell 307. The inner container 302, the inner lid 303, the middle lid 304, the first valve body 305, and the second valve body 370 are accommodated inside the outer shell 307. The outer shell 307 includes a lid member 350 and a bottom member 360 which are rotatable around the rotational axis R relative to each other.

In the embodiment, a central axis of the outer shell 307 (a central axis of the compact container 301B) is referred to as a container axis O, and a direction along the container axis O is referred to as a vertical direction. Further, in a state in which the lid member 350 is closed, a direction from the bottom member 360 toward the lid member 350 in the vertical direction is referred to as an upward direction, and a direction from the lid member 350 toward the bottom member 360 is referred to as a downward direction. Also, a cross section along the container axis O is referred to as a longitudinal cross section. In plan view when seen in the vertical direction, a direction orthogonal to the container axis O is referred to as a radial direction, and a direction circling around the container axis O is referred to as a circumferential direction. A direction approaching the container axis O in the radial direction is referred to as a radial inside, and a direction away from the container axis O is referred to as a radial outside. In the radial direction, a direction parallel to the rotational axis R is referred to as a right and left direction, and a direction orthogonal to the rotational axis R is referred to as a forward and rearward direction. In the forward and rearward direction, a direction from the container axis O toward the rotational axis R is referred to as a rear, and a direction from the rotational axis R toward the container axis O is referred to as a front.

As shown in FIG. 12, the bottom member 360 includes a disk-shaped bottom plate portion 361 which is disposed coaxially with the container axis O, and a cylindrical tubular wall portion 362 which extends upward from an outer circumferential edge of the bottom plate portion 361 and is formed in a tubular shape with a bottom. A concave portion 363 which is recessed forward is provided in a rear end portion of the bottom member 360. A push piece 308 and a locking member 309 are provided at a front end portion of the bottom member 360. The push piece 308 is located forward from the locking member 309, and at least a part thereof protrudes forward from the tubular wall portion 362. The push piece 308 is provided to be movable rearward with respect to the bottom member 360 in a state in which it is biased forward. A locking hole 309*a* which is recessed rearward is formed in the locking member 309. In the embodiment, the locking hole 309*a* passes through the locking member 309 in the forward and rearward direction.

As shown in FIG. 12, a locking piece (not shown) which extends upward from the bottom plate portion 361 is formed at the bottom member 360. A locking portion (not shown) which protrudes inward in the radial direction is formed at an upper end portion of the locking piece. A plurality of locking pieces are formed at regular intervals in the circumferential direction. Each of the locking pieces extends in the circumferential direction and is formed in a plate shape of which front and back surfaces are directed in the radial direction.

As shown in FIG. 12, the lid member 350 includes a disk-shaped top plate portion 351 coaxially arranged with the container axis O, and a cylindrical tubular portion 352 extending downward from the outer peripheral edge of the top plate portion 351. A connection portion 354 which protrudes downward from the tubular portion 352 is formed at a rear end portion of the lid member 350. The connection portion 354 is located in the concave portion 363 of the bottom member 360 and is rotatable around the rotational axis R in the concave portion 363. With this constitution, the lid member 350 is rotatable around the rotational axis R with respect to the bottom member 360 and closes an upper end opening of the bottom member 360 to be openable and closable.

A locking protrusion 353 which protrudes rearward and is removably undercut-fitted to the locking member 309 is formed at a lower end of a front end portion of the tubular portion 352. When the locking protrusion 353 is located in the locking hole 309*a* of the locking member 309, the lid member 350 is locked in the closed state. When the push piece 308 is pushed rearward by a user, the locking member 309 moves rearward with the push piece 308, and the engagement between the locking member 309 and the locking protrusion 353 is released. Thus, the lid member 350 is in a state in which an opening operation thereof is allowed. When the pushing of the push piece 308 toward the rear side is released, the push piece 308 and the locking member 309 are moved and restored forward.

The compact container 301B may not have the above-described push piece 308. For example, the engagement between the locking protrusion 353 and the locking hole 309*a* may be released by pushing the locking protrusion 353 upward with a fingertip or the like, and thus the lock of the lid member 350 in the closed state may be released.

A mirror M is fixed to a lower surface of the top plate portion 351 of the lid member 350. A puff P (an applicator) is disposed between the lid member 350 and the inner lid 303. The puff P is placed on an operation portion 333 of the middle lid 304 which will be described later.

The inner container 302 is disposed inside the tubular wall portion 362 of the bottom member 360 in the radial direction. The inner container 302 is a flat cylindrical container which is disposed coaxially with the container axis O and is open upward. The inner container 302 is flexible and is reducible in volume (deformable to be reduced in volume). The inner container 302 is constituted by, for example, a laminated film or a thin resin molded product. The inner container 302 may be a so-called delamination container in which an inner container having excellent flexibility is laminated on an inner surface of the outer container harder than the inner container. Alternatively, other constitutions capable of reducing the volume of an accommodation space S6 in the inner container 302 may be employed.

The accommodation space S6 which is the inside of the inner container 302 accommodates contents having fluidity. The contents may be a liquid phase, a gel phase, or a jelly phase. The contents are, for example, cosmetics such as liquid foundation. An annular fitting ring 381 which surrounds an upper end portion of the inner container 302 on the radial outside thereof is fixed to the upper end portion of the inner container 302. The fitting ring 381 has a fitting tubular portion 382 which protrudes upward. The fitting ring 381 serves to mount the inner container 302 to the middle lid 304. As a method of fixing the fitting ring 381 to the inner container 302, for example, the fitting ring 381 may be injection-molded using the inner container 302 as an insert article. Alternatively, the inner container 302 and the fitting ring 381 may be bonded or welded, or the molding of the inner container 302 and the fixing of the fitting ring 381 to the inner container 302 may be performed simultaneously.

The inner lid 303 is disposed above the inner container 302. The inner lid 303 closes an upper opening of the inner container 302 and seals the inside of the inner container 302. The inner lid 303 includes a lower member 310 which is mounted in the inner container 302 via the fitting ring 381, and an upper member 320 which is mounted in the inner container 302 via the lower member 310. The lower member 310 may be formed integrally with the fitting ring 381.

The lower member 310 includes a lower annular portion 311 which covers the upper opening of the inner container 302, a mounting tubular portion 312 and an inner tubular portion 313 which extend upward from the lower annular portion 311, an annular connection portion 314 which extends radially outward from an upper end portion of the inner tubular portion 313, and an outer tubular portion 315 which extends downward from an outer circumferential edge of the connection portion 314. The lower annular portion 311, the mounting tubular portion 312, the inner tubular portion 313, the connection portion 314, and the outer tubular portion 315 are disposed coaxially with the container axis O.

The mounting tubular portion 312 protrudes upward from an inner circumferential edge of the lower annular portion 311. A lower end portion of the mounting tubular portion 312 opens toward the inner container 302. The inner tubular portion 313 extends upward from an outer circumferential edge of the lower annular portion 311. The outer tubular portion 315 is located on the radial outside of the inner tubular portion 313. In the radial direction, the inner tubular portion 313 is disposed substantially at the same position as an outer circumferential portion of the inner container 302, and the outer tubular portion 315 is located outside the outer circumferential portion of the inner container 302. The fitting tubular portion 382 of the fitting ring 381 is fitted to a space between the outer tubular portion 315 and the inner tubular portion 313. Thus, the inner container 302 and the inner lid 303 are fixed via the fitting ring 381.

The upper member 320 includes a first valve seat portion 321 which has an annular shape in plan view, an internal tubular portion 322 which extends upward from an outer circumferential edge of the first valve seat portion 321, an upper annular portion 323 which extends radially outward from an upper end portion of the internal tubular portion 322, an outer circumferential tubular portion 324 which extends downward from an outer circumferential edge of the upper annular portion 323, and a lower flange portion 325 which extends radially outward from a lower end portion of the outer circumferential tubular portion 324. The first valve seat portion 321, the internal tubular portion 322, the upper annular portion 323, the outer circumferential tubular portion 324, and the lower flange portion 325 are disposed coaxially with the container axis O.

An inner circumferential surface of the first valve seat portion 321 is a communication hole 321*a* which allows communication between a communication space S4 described later and the inside of the inner container 302. The communication hole 321*a* is formed in a circular hole which is coaxial with the container axis O. An annular valve seat 321*b* which protrudes upward from the first valve seat portion 321 is formed at an upper end opening edge of the communication hole 321*a*. The internal tubular portion 322 is fitted into the mounting tubular portion 312 of the lower member 310. A restriction protrusion 322*a* which protrudes inward in the radial direction is formed at a central portion of the internal tubular portion 322 in the vertical direction. The outer circumferential tubular portion 324 is located between the mounting tubular portion 312 of the lower member 310 and the inner tubular portion 313 in the radial direction. The lower flange portion 325 faces a radially outer end portion of the lower annular portion 311 from the upper side.

The upper annular portion 323 is formed in a plate shape which has an annular shape in plan view and of which front and back surfaces are directed in the vertical direction. The upper annular portion 323 faces the operation portion 333 which will be described later in the vertical direction. An inner diameter and an outer diameter of the upper annular portion 323 are substantially equal to an inner diameter and an outer diameter of the operation portion 333. An inner support portion 323*a* which protrudes upward is formed at an inner circumferential edge portion of the upper annular portion 323. A plurality of inner support portions 323*a* are formed at intervals in the circumferential direction. An annular outer support portion 323*b* which protrudes upward is formed at an outer circumferential portion of the upper annular portion 323.

The middle lid 304 is formed in a tubular shape with a top and includes a top wall member 330 located at a top wall portion thereof, and a mounting ring 340 located at a circumferential wall portion thereof. The middle lid 204 is provided above the inner lid 303 and defines the communication space S4 which communicates with the communication hole 321*a* between the inner lid 303 and the middle lid 304. The middle lid 304 in the embodiment is integrally formed by injection molding the top wall member 330 using the mounting ring 340 as an insert article. The middle lid 304 may be formed by separately forming the top wall member 330 and the mounting ring 340 and then combining them.

The mounting ring 340 is formed in a double cylindrical shape having an inner cylinder 341 and an outer cylinder 342 of which upper ends are connected to each other. A fitting portion 342*a* which protrudes inward in the radial direction is formed at a lower portion of an inner circumferential surface of the outer cylinder 342. Downward movement of the fitting ring 381 and the inner container 302 with respect to the mounting ring 340 is restricted by undercut-fitting of the fitting portion 342*a* to the fitting ring 381. A circumferential groove 342*b* which is recessed inward in the radial direction and extends in the circumferential direction is formed at a lower portion of an outer circumferential surface of the outer cylinder 342. The locking portion 364*a* of the bottom member 360 is engaged with the circumferential groove 342*b* (refer to FIG. 12). Thus, the mounting ring 340 is suppressed from being separated from the bottom member 360, and upward movement of the inner container 302 relative to the bottom member 360 is restricted.

An annular placing portion 344 which extends outward in the radial direction is provided on an outer circumferential surface of the mounting ring 340. The placing portion 344 is provided over the entire circumference of the outer circumferential surface of the mounting ring 340. A lower surface of the placing portion 344 is in contact with an upper surface of the tubular wall portion 362 of the bottom member 360 from the upper side. The placing portion 344 is a portion of the middle lid 304 which is placed on the bottom member 360. With the above-described constitution, the inner container 302 or a refill container 302A described later is mounted in the bottom member 360 via the mounting ring 340.

In the embodiment, the inner container 302, the inner lid 303, and the middle lid 304 constitute the refill container 302A. The refill container 302A is provided detachably to the outer shell 307. Thus, a user can replace the refill container 302A with a new refill container 302A filled with the contents after using up the contents in the inner container 302. The user can remove the refill container 302A from the outer shell 307 by releasing the engagement between the locking portion 364*a* of the bottom member 360 and the circumferential groove 342*b* of the mounting ring 340.

An annular raised portion 343 which protrudes upward is formed on an upper surface of the mounting ring 340. An inner circumferential surface of the raised portion 343 is formed in a curved surface shape which extends radially outward toward the upper side. The raised portion 343 facilitates an operation in which the contents discharged from the discharge hole 304*a* described later is scooped up with the puff P. Further, the raised portion 343 serves to block the discharged contents, for example, to suppress the contents from dripping outside the mounting ring 340, or to stabilize a position of the puff P placed on the middle lid 304.

The top wall member 330 includes a top portion 332 which has a circular shape in plan view, and a locking tubular portion 331 and a valve-holding cylinder 334 which extend downward from the top portion 332. A portion of the top portion 332 which is located on the radial inside of the internal tubular portion 322 of the inner lid 303 defines the communication space S4 together with the first valve seat portion 321 and the internal tubular portion 322. The communication space S4 is formed in a circular shape which is coaxial with the container axis O in plan view.

The locking tubular portion 331 is locked in the inner cylinder 341 of the mounting ring 340. The locking tubular portion 331 may be locked into the inner cylinder 341 by separately forming the top wall member 330 and the mounting ring 340 and then fitting the locking tubular portion 331 into the inner cylinder 341. The locking tubular portion 331 is externally fitted to the outer circumferential tubular portion 324 of the inner lid 303. The discharge hole 304*a* which passes through the top portion 332 in the vertical direction is formed at a radially central portion of the top portion 332. The discharge hole 304*a* opens toward the communication space S4 and communicates with the communication space S4. The valve-holding cylinder 334 is located on the radial inside of the locking tubular portion 331. A holding protrusion 334*a* which protrudes outward in the radial direction is formed at a lower end portion of the valve-holding cylinder 334. The valve-holding cylinder 334 serves to hold the second valve body 370.

The elastically deformable operation portion 333 is provided at a portion of the top portion 332 which faces the upper annular portion 323 of the inner lid 303 in the vertical direction. The operation portion 333 is formed in an annular shape in top view and is located between the valve-holding cylinder 334 and the locking tubular portion 331 in the radial direction. The operation portion 333 defines an operation space S5 between the operation portion 333 and the upper annular portion 323. The operation space S5 is formed to have an annular shape in top view. The operation space S5 communicates with the communication space S4 through a gap between the plurality of inner support portions 323*a* disposed at intervals in the circumferential direction. In a longitudinal sectional view, a lower surface 333*a* of the operation portion 333 is formed in a shape which protrudes upward. In the embodiment, the lower surface 333*a* is formed in a curved surface shape which protrudes upward. In addition, for example, a trapezoidal shape which protrudes upward in a longitudinal sectional view may be adopted as a shape of the lower surface 333*a*.

The operation portion 333 is formed to be elastically deformable in the vertical direction. The operation portion 333 elastically deforms to increase or decrease an internal pressure of the operation space S5 and the communication space S4. For example, a soft material such as an elastomer, nitrile rubber, butyl rubber, silicone rubber, soft polyethylene, or urethane may be used as a material of the operation portion 333. Further, in consideration of chemical resistance to the contents, for example, elastically deformable and relatively soft polypropylene (PP), polyethylene terephthalate (PET) molded to be thin, or the like may be used as the material of the operation portion 333. The operation portion 333 is softer than the mounting ring 340, and the mounting ring 340 is harder than the operation portion 333.

An inner groove portion 333*b* which is recessed upward is formed in an inner circumferential edge portion of the operation portion 333, and an outer groove portion 333*c* which is recessed upward is formed in an outer circumferential edge portion of the operation portion 333. Therefore, the operation portion 333 is easily deformed with the inner groove portion 333*b* and the outer groove portion 333*c* as fixed ends. The inner groove portion 333*b* and the outer groove portion 333*c* are formed in an annular shape centering on the container axis O in plan view. A portion of the top wall member 330 adjacent to the inner groove portion 333*b* from the radial inside thereof is in contact with or close to the inner support portion 323*a*, and a portion thereof adjacent to the outer groove portion 333*c* from the radial outside thereof is in contact with or close to the outer support portion 323*b*. Thus, when the operation portion 333 is pressed, the operation portion 333 is supported by the inner support portion 323*a* and the outer support portion 323*b* and also elastically deformed in the vertical direction with the inner groove portion 333*b* and the outer groove portion 333*c* as the fixed ends. The locking tubular portion 331, the top portion 332, the operation portion 333, the valve-holding cylinder 334, and the discharge hole 304*a* are disposed coaxially with the container axis O.

The first valve body 305 is mounted on the inner lid 303 and is located in the communication space S4. The first valve body 305 serves to switch the communication and the blocking between the communication hole 321*a* of the inner lid 303 and the communication space S4. In the example of the embodiment, a three-point valve is used as the first valve body 305. A shape of the three-point valve may be appropriately changed or a check valve having a constitution different from that of the three-point valve may be adopted as the first valve body 305 according to properties of the contents accommodated in the inner container 302.

The first valve body 305 includes a valve cylinder 305*b* and a first valve main body 305*a*. The valve cylinder 305*b* is fitted into the internal tubular portion 322 of the inner lid 303 and is located below the restriction protrusion 322*a* of the internal tubular portion 322. Therefore, the first valve body 305 is fixed to the inner lid 303. A lower end of the valve cylinder 305*b* is in contact with the first valve seat portion 321 from the upper side thereof. The first valve main body 305*a* is connected to a lower end portion of the valve cylinder 305*b*. The first valve main body 305*a* is disposed in the valve cylinder 305*b*. The first valve main body 305*a* includes a disk-shaped valve plate, and a plurality of elastic legs which connect the valve plate with the valve cylinder 305*b*. The first valve main body 305*a* can move in the vertical direction with respect to the valve cylinder 305*b* by elastically deforming the elastic legs.

The first valve main body 305*a* is in contact with the valve seat 321*b* from the upper side thereof and covers the upper side of the communication hole 321*a*. The first valve body 305 is a check valve which allows a flow of contents from the accommodation space S6 of the inner container 302 to the communication space S4 and blocks the flow of contents from the communication space S4 to the accommodation space S6.

The second valve body 370 is mounted on the middle lid 304 and closes the discharge hole 304*a* to be openable. The second valve body 370 is located between the middle lid 304 and the inner lid 303. In the embodiment, the entire second valve body 370 is located below an upper surface 332*a* of the top portion 332 (an upper surface of the middle lid 304). The second valve body 370 is formed of a hard resin such as polyethylene (PE). The second valve body 370 includes a mounting portion 371 mounted to the valve-holding cylinder 334, an annular bottom portion 372 which extends radially inward from a lower end portion of the mounting portion 371, and a substantially conical closing portion 373 which extends upward from an inner circumferential edge of the bottom portion 372. The mounting portion 371, the bottom portion 372, and the closing portion 373 are disposed coaxially with the container axis O.

The mounting portion 371 is formed in a tubular shape which extends in the vertical direction. A fitting portion which protrudes radially inward is formed at an upper end portion of the mounting portion 371. The second valve body 370 is mounted on the valve-holding cylinder 334 by undercut-fitting of the fitting portion of the mounting portion 371 to the holding protrusion 334*a* of the valve-holding cylinder 334. The bottom portion 372 is formed in an annular shape in which front and back surfaces thereof are directed in the vertical direction. Inner and outer surfaces of the closing portion 373 gradually decrease in diameter toward the upper side. An upper end portion of the closing portion 373 is formed in a curved surface shape which protrudes upward and is in contact with a lower end opening portion of the discharge hole 304*a*. Thus, the closing portion 373 closes the discharge hole 304*a*. A flow hole 373*a* which passes through the closing portion 373 in the vertical direction is formed in a portion of the closing portion 373 located on the radial outside of the discharge hole 304*a*. A plurality of flow holes 373*a* are formed at intervals in the circumferential direction.

In the embodiment, a concave portion 304*b* is formed in the vicinity of the upper end opening portion of the discharge hole 304*a* in the top portion 332 of the middle lid 304. The concave portion 304*b* is recessed downward from the upper surface 332*a* of the top portion 332 (the upper surface of the middle lid 304). The concave portion 304*b* is formed in a curved surface shape which protrudes downward and is disposed coaxially with the container axis O. The discharge hole 304*a* is located on the radial inside of the concave portion 304*b*. Thus, a portion of the middle lid 304 adjacent to the discharge hole 304*a* is a thin portion 304*c* thinner than the other portions. The thin portion 304*c* is elastically deformed upward when the internal pressure of the communication space S4 increases.

Next, an operation of the compact container 301B in the embodiment will be described.

When the compact container 301B is in an unused state, the contents are accommodated only in the accommodation space S6, and the communication space S4 and the operation space S5 are filled with, for example, air. The user operates the push piece 308 to open the lid member 350 of the outer shell 307. Next, the operation portion 333 is pressed from the upper side and elastically deformed to be recessed downward. At this time, since the operation portion 333 is supported by the inner support portion 323*a* and the outer support portion 323*b*, the operation portion 333 is elastically deformed downward with the inner groove portion 333*b* and the outer groove portion 333*c* thereof as the fixed ends. Since a volume of the operation space S5 is reduced when the operation portion 333 is elastically deformed downward, the internal pressure of the operation space S5 and the communication space S4 which communicates with the operation space S5 increases.

In the embodiment, when the operation portion 333 is pressed in a state in which air is present in the communication space S4, the internal pressure of the communication space S4 increases, and thus the thin portion 304*c* is elastically deformed to be lifted upward. Thus, the lower end opening portion of the discharge hole 304*a* is separated upward from the closing portion 373, and the discharge hole 304*a* opens to discharge the air in the communication space S4. Further, when the operation portion 333 is pressed in a state in which the contents are filled in the communication space S4, the contents move toward the thin portion 304*c* through the flow hole 373*a* and push the thin portion 304*c* upward. As a result, the thin portion 304*c* is elastically deformed to be lifted upward, and the discharge hole 304*a* opens. After the contents are discharged from the discharge hole 304*a*, the thin portion 304*c* is restored and deformed downward, and thus the discharge hole 304*a* is closed again. As described above, in the compact container 301B of the embodiment, regardless of the elastic displacement or elastic deformation of the second valve body 370, the discharge hole 304*a* is opened or closed by the elastic deformation of the thin portion 304*c* of the middle lid 304.

When a pressing force applied to the operation portion 333 is released, the operation portion 333 which has been elastically deformed is restored and deformed to an original state thereof. Thus, the volume of the operation space S5 increases, and the inside of the operation space S5 and the communication space S4 has a negative pressure. At this time, since the discharge hole 304*a* is closed by the second valve body 370, entry of the air from the outside into the communication space S4 is curbed. On the other hand, when the communication space S4 has a negative pressure, an upward force acts on the first valve main body 305*a* due to the negative pressure. As a result, the first valve main body 305*a* is elastically displaced upward, the communication hole 321*a* and the communication space S4 communicate with each other, and the contents in the accommodation space S6 are suctioned up into the communication space S4 and the operation space S5 through the communication hole 321*a*. In this way, when the operation portion 333 moves upward and the internal pressure of the communication space S4 and the operation space S5 decreases, the second valve body 370 blocks the communication between the discharge hole 304*a* and the communication space S4, and also the first valve body 305 causes the communication hole 321*a* to communicate with the communication space S4.

When the above-described elastic deformation and restoring deformation of the operation portion 333 are performed a plurality of times, the air in the communication space S4 and the operation space S5 is discharged to the outside, and the contents are filled in the communication space S44 and the operation space S5. Since the inner container 302 has flexibility, a volume thereof is reduced as the contents flow out to the communication space S4 and the like through the communication hole 321*a*. Accordingly, even when the contents flow into the communication space S4 and the like and the total amount of the contents in the accommodation space S6 decreases, it is possible to stably send the contents from the accommodation space S6 to the communication space S4 and the operation space S5.

When the operation portion 333 is elastically deformed downward in a state in which the communication space S4 is filled with the contents, the contents in the communication space S4 reach the vicinity of the closing portion 306*e* through the flow holes 306*c*, and the contents exert a downward pressure on a tapered surface of the closing portion 306*e*. Further, the contents which have reached the vicinity of the closing portion 306*e* exert an upward pressure on the vicinity of a lower end opening portion of the discharge hole 304*a*. When the internal pressure of the communication space S4 due to the contents reaches a predetermined level, as the closing portion 306*e* moves down, the vicinity of the discharge hole 304*a* is elastically deformed upward, the discharge hole 304*a* is opened, and the contents are discharged from the discharge hole 304*a*. As described above, in the embodiment, the discharge hole 304*a* is not opened until the internal pressure of the communication space S44 reaches a predetermined pressure, and the sealability of the middle lid 304 is enhanced. A constitution in which the discharge hole 304*a* is opened only by moving down the closed portion 306*e* without elastically deforming the vicinity of the discharge hole 304*a* may be adopted.

Due to the above-described operation, the user can discharge the contents by repeating the pressing and releasing of the operation portion 333. Since the contents are discharged to the inside of the raised portion 343, the raised portion 343 suppresses the dripping of the contents from the upper surface of the middle lid 304. The user can wipe the upper surface of the middle lid 304 with a puff P or the like to attach the contents to the puff P or the like and then can use the contents.

As described above, according to the compact container 301B of the embodiment, when the operation portion 333 is pressed and the internal pressure of the communication space S4 increases, the contents can be discharged from the discharge hole 304*a* by an amount corresponding to a deformation amount of the operation portion 333. Additionally, in the embodiment, the second valve body 370 is mounted on the middle lid 304. Thus, for example, when an external force acts on the middle lid 304, the second valve body 370 moving with respect to the middle cover 304 and the discharge hole 304*a* being opened unexpectedly can be curbed. Therefore, the sealability in the middle lid 304 can be further enhanced.

Further, since the second valve body 370 is located between the middle lid 304 and the inner lid 303, it is difficult for the user to see the second valve body 370, and the exterior of the compact container 301B can be improved. Furthermore, when an upper end of the second valve body 370 is located to be substantially equal to or to be lower than an upper end of the discharge hole 304*a* in the vertical direction, that is, when the second valve body 370 does not protrude upward from the upper end opening portion of the discharge hole 304*a*, even when an unintended external force is applied in the vicinity of the upper end opening portion of the discharge hole 304*a*, the external force is less likely to act on the second valve body 370. Therefore, it is possible to more reliably suppress the unexpected movement of the second valve body 370 and the opening of the discharge hole 304*a* and to further improve the sealability inside the middle lid 304.

In addition, since the lower surface 333*a* of the operation portion 333 is formed in a shape which protrudes upward, the deformation amount of the lower surface 333*a* when the operation portion 333 is pressed increases, and the in-plane tension acting on the lower surface 333*a* also increases. Thus, when the pressing is released, an upward restoring deformation force acting on the operation portion 333 increases, the operation portion 333 is easily restored and deformed to the shape before the elastic deformation, the amount of the contents suctioned from the inner container 302 into the communication space S4 is stabilized, and the discharge amount of the contents can be stabilized when the operation portion 333 is pressed the next time. Further, in the embodiment, the lower surface 333*a* of the operation portion 333 is formed in a curved surface shape which protrudes upward. Thus, when the operation portion 333 is elastically deformed, it is possible to suppress a large stress from locally acting on the lower surface 333*a*, and durability of the compact container 301B can be improved.

Further, since the operation portion 333 is formed to have an annular shape in plan view, when the operation portion 333 is pressed, the operation portion 333 is elastically deformed downward with the inner circumferential edge portion and the outer circumferential edge portion of the operation portion 333 as fixed ends. Accordingly, an upward elastic force acting on the operation portion 333 increases, and thus the operation portion 333 can be more stably restored and deformed to the original shape.

The lower surface 333*a* of the operation portion 333 may be a flat surface. In this case, an elastically deformable biasing member which biases the operation portion 333 upward may be provided between the operation portion 333 and the inner lid 303.

Examples of the biasing member include the biasing portion 198 of the second embodiment, and the like. The restorability of the operation portion 333 after the operation portion 333 is pressed can be further improved by providing such a biasing member. The biasing member may be integral with the operation portion 333 or the inner lid 303, or may be separate from the operation portion 333 or the inner lid 303.

Additionally, in the embodiment, since the second valve body 370 is located between the middle lid 304 and the inner lid 303, and the entire second valve body 370 is located below the upper surface of the middle lid 304, it is difficult for the user to see the second valve body 370, and the exterior of the compact container 301B can be further improved.

The technical scope of the present invention is not limited to the above-described embodiment. For example, as described below, various modifications can be made to the above-described embodiment without departing from the spirit of the present invention.

For example, in the above-described embodiment, the discharge hole 304*a* is disposed near the center in the radial direction (near the container axis O), but for example, the discharge hole 304*a* may be disposed radially away from the container axis 0. In this case, the operation portion 333 may be formed in a C shape in plan view to avoid the discharge hole 304*a*.

Further, the compact container 301B may be a container in which the lid member 350 and the bottom member 360 are screwed together and the lid member 350 is removed from the bottom member 360 by relative rotation around the container axis O.

Further, in the compact container 301B (FIG. 12), the lower surface 333*a* of the operation portion 333 may be, for example, a flat surface. Furthermore, similarly to the contents described in the above-described embodiment, the biasing member which biases the operation portion 333 upward may be provided between the operation portion 333 and the inner lid 303.

In addition, it is possible to replace the elements in the above-described embodiment with known elements as appropriate without departing from the spirit of the present invention, and it is also possible to combine appropriately the above-described modified examples with the embodiment.

Sixth Embodiment

Figure 13:
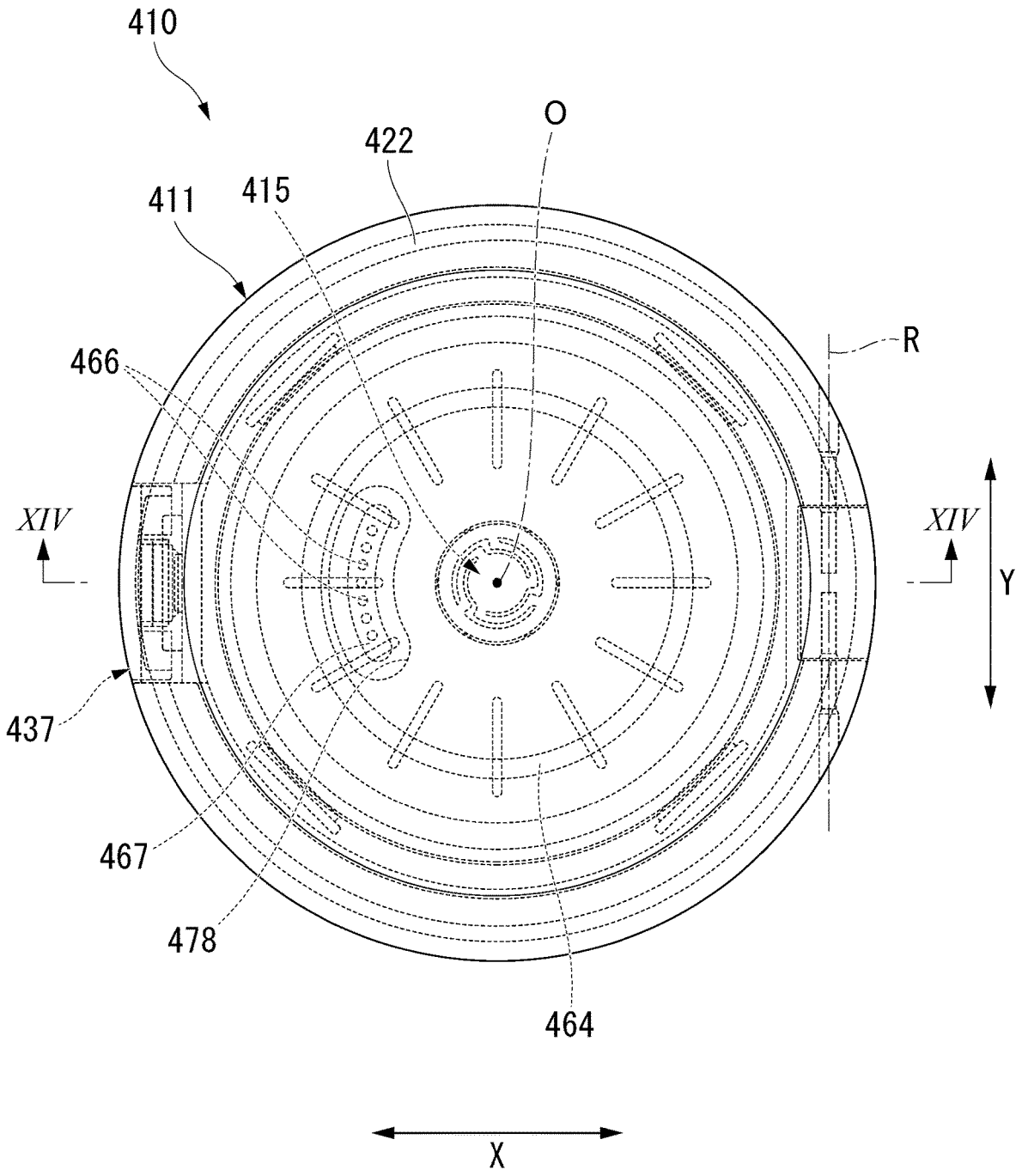
FIG. 13 is a top view showing a compact container of a sixth embodiment.
Figure 14:
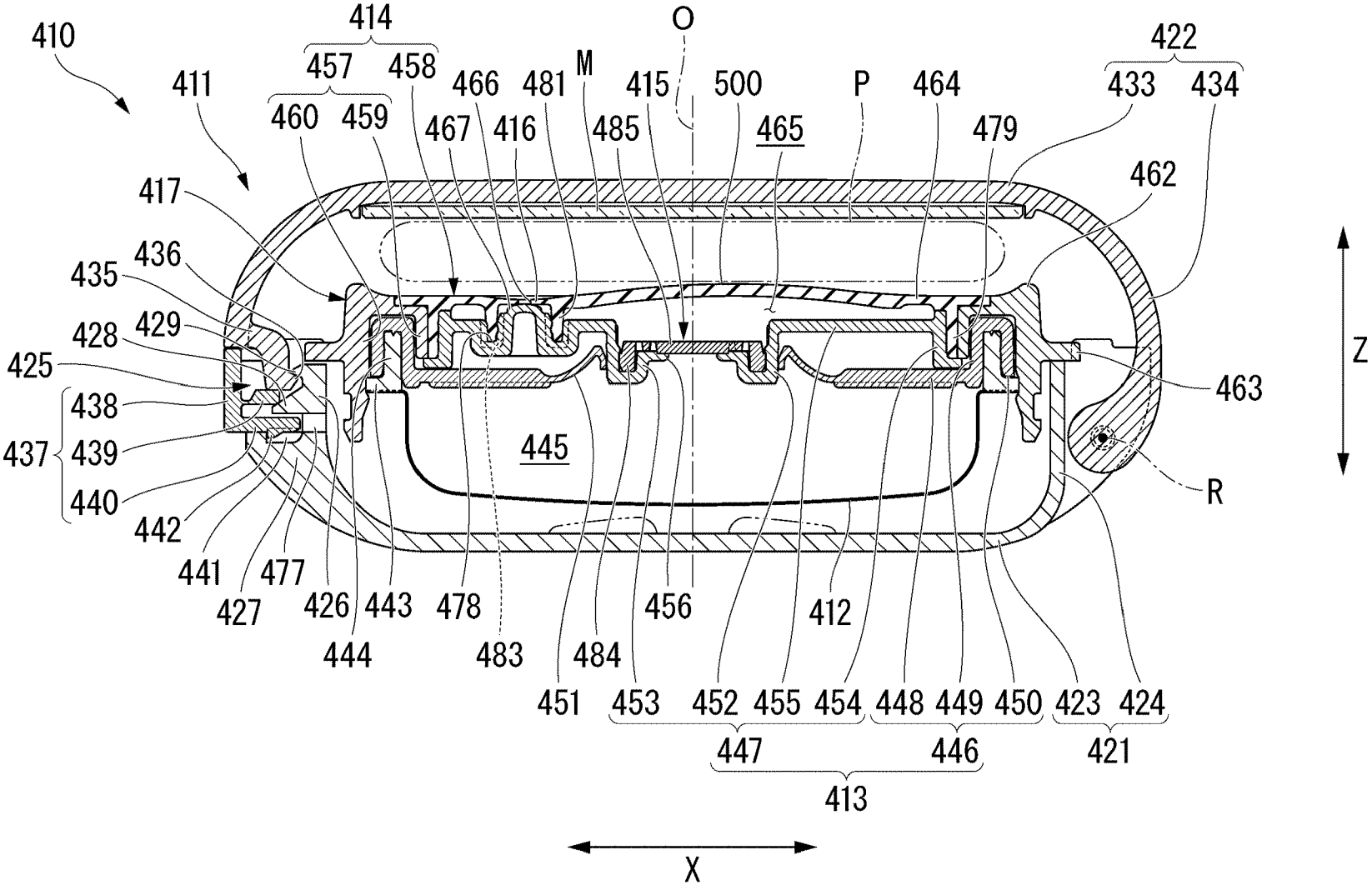
FIG. 14 is a cutaway perspective view taken along line XIV-XIV in FIG. 13.

Next, a compact container 410 according to a sixth embodiment of the present invention will be described with reference to FIGS. 13 and 14. As shown in FIGS. 13 and 14, the compact container 410 of the present embodiment is a flat container having a circular shape in plan view. The compact container 410 includes an outer shell 411, an inner container 412, an inner lid 413, a middle lid 414, a first valve body 415, and a second valve body 416.

The outer shell 411 accommodates the inner container 412, the inner lid 413, the middle lid 414, the first valve body 415 and the second valve body 416 therein. That is, members of the compact container 410 other than the outer shell 411 are accommodated in the outer shell 411. The outer shell 411 includes a bottom member 421 and a lid member 422. The bottom member 421 has a cylindrical shape with a bottom. The lid member 422 has a cylindrical shape with a top. The lid member 422 is mounted on the bottom member 421 to be rotatable about the rotational axis R.

In the embodiment, a central axis of the outer shell 411 (a central axis of the compact container 410) is referred to as a container axis O, and a direction along the container axis O (a direction in which the container axis O extends) is referred to as a vertical direction Z. A direction from the bottom member 421 toward the lid member 422 in the vertical direction Z is referred to as an upward direction, and a direction from the lid member 422 toward the bottom member 421 is referred to as a downward direction. In plan view when seen in the vertical direction Z, a direction intersecting the container axis O is referred to as a radial direction. A direction approaching the container axis O in the radial direction is referred to as a radial inside, and a direction away from the container axis O is referred to as a radial outside. In the radial directions in plan view when seen in the vertical direction Z, a direction parallel to the rotational axis R is referred to as a right and left direction Y, and a direction orthogonal to the rotational axis R is referred to as a forward and rearward direction X. In the forward and rearward direction X, a direction from the container axis O toward the rotational axis R is referred to as a rear, and a direction from the rotational axis R toward the container axis O is referred to as a front. In plan view when seen in the vertical direction Z, a direction circling around the container axis O is referred to as a circumferential direction.

As shown in FIG. 13, the bottom member 421 includes a disk-shaped bottom plate portion 423 which is disposed coaxially with the container axis O, and a cylindrical tubular wall portion 424 which extends upward from an outer circumferential edge of the bottom plate portion 423. The bottom member 421 includes an engagement plate portion (not shown) which extends upward from the bottom plate portion 423. A plurality of engagement plate portions are disposed at regular intervals in the circumferential direction. Front and back surfaces of the engagement plate portion are directed in the radial direction. An engagement claw which protrudes inward in the radial direction is provided at an upper end portion of the engagement plate portion. An engagement space 425 is provided at a front end portion of the tubular wall portion 424. The engagement space 425 opens forward and upward. The engagement space 425 is defined by a rear wall portion 426 which is directed in the forward and rearward direction X and a bottom wall portion 427 which is directed in the vertical direction Z.

A guide wall portion 428 which protrudes forward is formed at a portion of the rear wall portion 426 located at a center in the right and left direction Y. An upper surface of the guide wall portion 428 is an inclined surface which is inclined downward toward the front side. A first engagement portion 429 which protrudes forward is formed at a portion of the rear wall portion 426 located above the guide wall portion 428. An escape hole 477 which passes through the rear wall portion 426 in the forward and rearward direction X is formed in a portion of the rear wall portion 426 located below the guide wall portion 428.

The lid member 422 is mounted on a rear end portion of the tubular wall portion 424 in the bottom member 421. The lid member 422 closes an upper end opening of the bottom member 421 to open and close. The lid member 422 includes a disk-shaped top plate portion 433 which is disposed coaxially with the container axis O, and a cylindrical tubular portion 434 which extends downward from an outer circumferential edge of the top plate portion 433. A mirror M is fixed to a lower surface of the top plate portion 433 of the lid member 422.

An engagement piece 435 is provided at a front end portion of the lid member 422 to protrude downward. The engagement piece 435 is formed in a plate shape which protrudes downward from an inner circumferential surface of the tubular portion 434 and extends in the right and left direction Y, and enters the engagement space 425 from the upper side. A second engagement portion 436 which protrudes rearward and is undercut-fitted to the first engagement portion 429 formed on the bottom member 421 to be separable is formed at a lower end portion of the engagement piece 435. The lid member 422 is locked in a closed state by the second engagement portion 436 engaging with the first engagement portion 429 from the lower side.

A push piece 437 which releases the engagement between the first engagement portion 429 and the second engagement portion 436 is provided in the engagement space 425. The push piece 437 includes an operation wall portion 438 disposed forward from the engagement piece 435, a release protrusion 439 which protrudes rearward from the operation wall portion 438 and is located on the inclined surface of the guide wall portion 428, and a base portion 440 which protrudes rearward from a lower end portion of the operation wall portion 438 and is mounted on the bottom wall portion 427. The push piece 437 is movable rearward with respect to the bottom member 421 and the lid member 422 when the push piece 437 is pushed rearward.

The release protrusion 439 moves rearward along the inclined surface of the guide wall portion 428 according to rearward movement of the push piece 437 and pushes up the second engagement portion 436 from the lower side to separate the second engagement portion 436 from the first engagement portion 429. Thus, the engagement between the first engagement portion 429 and the second engagement portion 436 can be released, and the lid member 422 can be brought into a state in which it can be operated to be open. When the push piece 437 moves rearward, the push piece 437 is restored and moved forward by restoring deformation of the release protrusion 439.

The base portion 440 enters from the front into the relief hole 477 formed in the rear wall portion 426 in accordance with the rearward movement of the push piece 437. Further, a locking convex portion 442 which protrudes downward and is locked to a locking concave portion 441 formed in the bottom wall portion 427 is formed at the base portion 440. Accordingly, the push piece 437 is combined with the outer shell 411 in a state in which the push piece 437 is prevented from being removed forward.

The above-described push piece 437 is not essential and may not be provided. For example, the engagement between the first engagement portion 429 and the second engagement portion 436 may be released by causing the lower end portion of the engagement piece 435 to be slightly bent forward using a fingertip or the like, and thus the lock of the lid member 422 in the closed state may be released.

The inner container 412 is disposed on the radial inside of the tubular wall portion 424 of the bottom member 421. The inner container 412 is a flat cylindrical container which is disposed coaxially with the container axis O and opens upward. An annular fitting ring 443 which surrounds an upper end portion of the inner container 412 on the radial outside thereof is fixed to the upper end portion of the inner container 412. The fitting ring 443 has an engagement tubular portion 444 which protrudes upward. The inner container 412 is flexible and is reducible in volume (deformable to be reduced in volume). The inner container 412 is constituted by, for example, a laminated film or a thin resin molded product. The inner container 412 may be a so-called delamination container in which an inner container having excellent flexibility is laminated on an inner surface of the outer container harder than the inner container. Other constitutions in which a volume in the inner container 412 (an accommodation space 445 which will be described later) is reducible may be employed. The inner container 412 may be formed of a light-transmitting material (a transparent material or a translucent material). The inner container 412 may be formed of a laminated film including an aluminum film for a barrier property and the like.

The accommodation space 445 which is the inside of the inner container 412 accommodates contents having fluidity. The contents may be a liquid phase, a gel phase, or a jelly phase. The contents are, for example, cosmetics such as liquid foundation.

The inner lid 413 is disposed above the inner container 412. The inner lid 413 closes an upper end opening of the inner container 412 and seals the inside of the inner container 412. The inner lid 413 includes a lower member 446 directly mounted in the inner container 412 and an upper member 447 mounted in the inner container 12 via the lower member 446.

The lower member 446 includes an inner lid annular portion 448, an inner tubular portion 449, and an outer tubular portion 450. The inner lid annular portion 448 is disposed coaxially with the container axis O. The inner lid annular portion 448 covers an upper end opening portion of the inner container 412. A mounting portion 451 is disposed on an inner circumferential edge of the inner lid annular portion 448. The mounting portion 451 is formed in an annular shape and disposed coaxially with the container axis O. Specifically, the mounting portion 451 extends upward from the inner circumferential edge of the inner lid annular portion 448 toward the radial inside, and an inner end portion thereof in the radial direction is bent downward. The mounting portion 451 is formed to be thinner than the inner lid annular portion 448. The inner tubular portion 449 is formed in a cylindrical shape and extends upward from an outer circumferential edge of the inner lid annular portion 448. The outer tubular portion 450 is formed in a cylindrical shape and disposed coaxially with the container axis O. The outer tubular portion 450 surrounds the inner tubular portion 449 on the radial outside thereof. An upper end portion of the outer tubular portion 450 is connected to an upper end portion of the inner tubular portion 449.

The engagement tubular portion 444 of the fitting ring 443 is fitted to a space between an inner circumferential surface of the outer tubular portion 450 and an outer circumferential surface of the inner tubular portion 449. Thus, the inner container 412 and the inner lid 413 are fixed via the fitting ring 443. A lower end opening edge of the outer tubular portion 450 is in contact with an upper surface of the fitting ring 443. In the embodiment, although the fitting ring 443 does not protrude radially inward from the engagement tubular portion 444, and thus the lower end opening edge of the inner tubular portion 449 is not in contact with the upper surface of the fitting ring 443, the fitting ring 443 may protrude radially inward from the engagement tubular portion 444, and the lower end opening edge of the inner tubular portion 449 may be in contact with the upper surface of the fitting ring 443. Further, the lower end opening edge of the outer tubular portion 450 may not be in contact with the upper surface of the fitting ring 443.

The upper member 447 includes a fitting tubular portion 452, a first valve seat portion 453, an outer circumferential tubular portion 454, and a connection annular portion 455. The fitting tubular portion 452 is formed in a cylindrical shape and disposed coaxially with the container axis O. The fitting tubular portion 452 is fitted into the mounting portion 451. The first valve seat portion 453 includes a tubular portion which is disposed coaxially with the container axis O and has a diameter smaller than that of the fitting tubular portion 452, and a valve seat plate which extends radially inward from an upper end portion of the tubular portion. A lower end portion of the tubular portion of the first valve seat portion 453 is connected to a lower end portion of the fitting tubular portion 452. The valve seat plate of the first valve seat portion 453 is located below an upper end of the fitting tubular portion 452. A communication hole 456 which passes through the valve seat plate in the vertical direction Z is formed in a central portion of the valve seat plate of the first valve seat portion 453. Therefore, the valve seat plate has a ring plate shape. The communication hole 456 has a circular shape and is disposed coaxially with the container axis O. The communication hole 456 communicates with the inside of the inner container 412. That is, the communication hole 456 which communicates with the inside of the inner container 412 is formed in the inner lid 413.

The outer circumferential tubular portion 454 is formed in a cylindrical shape and disposed coaxially with the container axis O. The outer circumferential tubular portion 454 has a diameter larger than the fitting tubular portion 452 and smaller than the inner tubular portion 449. The outer circumferential tubular portion 454 is disposed in the inner tubular portion 449. The connection annular portion 455 is disposed coaxially with the container axis O. An inner circumferential edge portion of the connection annular portion 455 is connected to an upper end portion of the fitting tubular portion 452. An outer circumferential edge portion of the connection annular portion 455 is connected to an upper end portion of the outer circumferential tubular portion 454. The outer circumferential edge portion of the connection annular portion 455 is located below an upper end of the outer circumferential tubular portion 454 and above a center of the outer circumferential tubular portion 454 in the vertical direction Z.

A second valve seat portion 467 is disposed at a portion of the connection annular portion 455 located forward from the container axis O. The second valve seat portion 467 protrudes upward from an upper surface of the connection annular portion 455. The second valve seat portion 467 has a cylindrical shape with a top. The second valve seat portion 467 protrudes upward from a bottom surface of a recessed portion 478 formed in the connection annular portion 455. As shown in FIG. 13, the second valve seat portion 467 and the recessed portion 478 have an arc shape which extends in the circumferential direction in plan view. However, shapes of the second valve seat portion 467 and the recessed portion 478 in plan view can be changed as appropriate.

As shown in FIG. 14, the middle lid 414 is disposed above the inner lid 413. The middle lid 414 is formed to have a tubular shape with a top. The middle lid 414 includes a mounting ring 457 which has a circumferential wall of the middle lid 414, and an operation portion 458 which has a top wall of the middle lid 414. The middle lid 414 is manufactured, for example, by insert molding using the mounting ring 457 as an insert article.

The mounting ring 457 is mounted to the inner lid 413. The mounting ring 457 is formed in a double cylindrical shape having an inner cylinder 459 and an outer cylinder 460 of which upper ends are connected to each other. A plurality of circumferential grooves (not shown) which extend in the circumferential direction are formed in a lower portion of an outer circumferential surface of the outer cylinder 460 at intervals in the circumferential direction. The above-described engagement claw of the engagement plate portion of the bottom member 421 engages with the circumferential grooves. Thus, the mounting ring 457 is prevented from being separated from the bottom member 421.

The lower member 446 (the inner tubular portion 449 and the outer tubular portion 450) of the inner lid 413 is fitted to a space between the inner cylinder 459 and the outer cylinder 460 in the mounting ring 457. Therefore, the inner container 412 is fixed to the mounting ring 457 (the middle lid 414) via the fitting ring 443. The inner container 412 is disposed to be separated upward from the bottom plate portion 423 of the bottom member 421 in a state in which the inner container 412 is fixed to the middle lid 414.

A raised portion 462 which protrudes upward is formed on the upper surface of the mounting ring 457. A shape of the raised portion 462 in plan view is a ring shape which is disposed coaxially with the container axis O. An inner circumferential surface of the raised portion 462 has a curved surface shape which extends radially outward toward the upper side. A puff P (an applicator) is placed on a portion of an upper surface of the operation portion 458 located at the inside of the raised portion 462 in the radial direction. A flange portion 463 which protrudes radially outward and extends continuously over the entire circumference is formed on an outer circumferential surface of the mounting ring 457. A lower surface of the flange portion 463 is disposed at an upper end opening edge of the tubular wall portion 424 of the bottom member 421.

The operation portion 458 closes the inside of the mounting ring 457 from the upper side. In the embodiment, the operation portion 458 has a disk shape. An outer circumferential edge portion of the operation portion 458 is connected to a portion of the mounting ring 457 located in the radial inside of the raised portion 462. An upper surface of an outer circumferential edge portion of the operation portion 458 is formed to be flush with a portion of the upper surface of the mounting ring 457 which is continuous with the operation portion 458 from the radial outside thereof. The operation portion 458 is disposed at a position which overlaps the first valve body 415 which will be described later in plan view seen in the vertical direction Z.

The operation portion 458 is formed to be elastically deformable. For example, a soft material such as an elastomer, nitrile rubber, butyl rubber, silicone rubber, soft polyethylene, or urethane may be used as a material of the operation portion 458. Further, in consideration of chemical resistance to the contents, for example, elastically deformable and relatively soft polypropylene (PP), polyethylene terephthalate (PET) molded to be thin, or the like may be used as the material of the operation portion 458. The operation portion 458 is preferably softer than the mounting ring 457.

A hanging tubular portion 479 and a restriction wall portion 481 are formed on a lower surface of the operation portion 458. The hanging tubular portion 479 is disposed coaxially with the container axis O. The hanging tubular portion 479 has a cylindrical shape which protrudes downward from the lower surface of the operation portion 458. The hanging tubular portion 479 is fitted to the inside of the inner cylinder 459 in the radial direction and is fitted to the outside of the outer circumferential tubular portion 454 in the radial direction. The hanging tubular portion 479 is sandwiched in the radial direction by the inner cylinder 459 and the outer circumferential tubular portion 454. In the illustrated example, an upper end opening edge of the outer circumferential tubular portion 454 is in contact with the lower surface of the operation portion 458.

The restriction wall portion 481 is formed in a cylindrical shape and protrudes downward from the lower surface of the operation portion 458. The second valve seat portion 467 is fitted into the restriction wall portion 481. A lower end portion of the restriction wall portion 481 is fitted into the recessed portion 478. Therefore, the lower end portion of the restriction wall portion 481 is sandwiched by an outer circumferential surface of the second valve seat portion 467 and an inner circumferential surface of the recessed portion 478. A lower end opening edge of the restriction wall portion 481 approaches or is in contact with a bottom surface of the recessed portion 478 from the upper side of the bottom surface.

An easily deformable portion 464 is formed on an outer circumferential portion of the operation portion 458. The easily deformable portion 464 is formed in an annular shape and disposed coaxially with the container axis O. The easily deformable portion 464 is formed at a portion of the operation portion 458 which defines a communication space 465 described later. One annular groove which is recessed upward is formed on a lower surface of a portion of the operation portion 458 in which the easily deformable portion 464 is located. A groove bottom surface of the annular groove is a flat surface. The upper surface of the operation portion 458 is flush with both sides (the inside and the outside) which straddle the easily deformable portion 464 in the radial direction. The easily deformable portion 464 is formed to be thinner than portions of the operation portion 458 excluding the second valve body 416.

The middle lid 414 defines the communication space 465 which communicates with the communication hole 456 between the inner lid 413 and the middle lid 414. In the embodiment, the communication space 465 is formed by closing an upper end opening of the outer circumferential tubular portion 454 (the upper member 447) by the operation portion 458. The operation portion 458 closes the inside of the mounting ring 457 from the upper side and defines the communication space 465 in the inside of the mounting ring 457. The communication space 465 is formed in a circular shape in plan view. The operation portion 458 is elastically deformed and thus increases or decreases an internal pressure of the communication space 465.

As shown in FIGS. 13 and 14, a discharge hole 466 which discharges the contents is formed in the middle lid 414. A shape of the discharge hole 466 in a plan view is circular. A plurality of discharge holes 466 are formed in the middle lid 414. The plurality of discharge holes 466 are formed in a portion of the middle lid 414 located forward from the container axis O and are disposed at intervals in the circumferential direction.

As shown in FIG. 14, the discharge holes 466 pass through the operation portion 458 in the vertical direction Z. The discharge holes 466 communicate with the inside of the communication space 465. In the embodiment, the discharge holes 466 and the communication space 465 communicate with each other by a plurality of groove portions 483 formed in an outer circumferential surface of the second valve seat portion 467 and in a bottom surface and an inner circumferential surface of the recessed portion 478. The discharge holes 466 are closed by the second valve seat portion 467 provided in the inner lid 413. The discharge holes 466 are closed from the lower side by a top surface of the second valve seat portion 467.

The first valve body 415 switches between the communication and the blocking between the communication hole 456 of the inner lid 413 and the communication space 465. The first valve body 415 is provided in the inner lid 413.

The first valve body 415 includes a valve cylinder 484 and a valve main body 485. In the present embodiment, the valve cylinder 484 is fitted into the fitting tubular portion 452 of the inner lid 413. A tubular portion of the first valve seat portion 453 is fitted into the valve cylinder 484. A lower end opening edge of the valve cylinder 484 is in contact with an upper surface of a ring-shaped connection portion which connects a lower end portion of the tubular portion of the first valve seat portion 453 with a lower end of the fitting tubular portion 452. The valve main body 485 is connected to an upper end portion of the valve cylinder 484. The valve main body 485 is disposed in the valve cylinder 484. The valve main body 485 includes a disk-shaped valve plate and a plurality of elastic legs which connect the valve plate with the valve cylinder 484. The valve main body 485 is movable in the vertical direction Z with respect to the valve cylinder 484. The valve seat plate of the first valve seat portion 453 is in contact with the valve plate of the valve main body 485 from the lower side of the valve main body 485.

The first valve body 415 covers the upper side of the communication hole 456. The first valve body 415 is a check valve. The first valve body 415 allows a flow of a fluid (the contents, hereinafter, the same) from the accommodation space 445 of the inner container 412 to the communication space 465 and blocks the flow of the fluid from the communication space 465 to the accommodation space 445. In the embodiment, a three-point valve may be used as the first valve body 415. For example, a shape of the three-point valve may be appropriately changed or a check valve having a constitution different from that of the three-point valve may be adopted as the first valve body 415 according to properties of the contents stored in the inner container 412.

The second valve body 416 switches between communication and blocking between the discharge hole 466 of the middle lid 414 and the communication space 465. The second valve body 416 is provided in the middle lid 414. The second valve body 416 is integrally formed with the operation portion 458. The second valve body 416 is disposed at a position on the operation portion 458 which is displaced forward from the central portion. The second valve body 416 is formed by a portion including an opening circumferential edge portion of the discharge hole 466 in the operation portion 458. In the embodiment, the second valve body 416 is a portion of the operation portion 458 which is surrounded by the tubular restriction wall portion 481.

The second valve body 416 is thinner than the easily deformable portion 464 and is the thinnest portion of the operation portion 458. A shape of the second valve body 416 in plan view is similar to a shape of the second valve seat portion 467 in plan view and is larger than the shape of the second valve seat portion 467 in plan view (refer to FIG. 13). The second valve body 416 is disposed at a portion of the operation portion 458 located on the radial inside of the easily deformable portion 464 to be inscribed in the easily deformable portion 464. As shown in FIG. 14, the second valve body 416 blocks the communication between the discharge hole 466 and the communication space 465 by being seated on the second valve seat portion 467. The second valve body 416 brings the discharge hole 466 into communication with the communication space 465 when the second valve body 416 is elastically deformed to be separated upward from the second valve seat portion 467. The second valve body 416 is a check valve. The second valve body 416 allows a flow of a fluid from the communication space 465 to the outside and blocks the flow of the fluid from the outside to the communication space 465.

In the embodiment, the inner container 412, the inner lid 413 and the middle lid 414 constitute a refill container 417. The refill container 417 is provided detachably to the outer shell 411. Thus, a user can replace the refill container 417 with a new refill container 417 filled with the contents after using up the contents in the inner container 412. When the refill container 417 is removed from the outer shell 411, the user releases the engagement state between the engagement claw of the engagement plate portion of the bottom member 421 and the circumferential groove of the mounting ring 457.

Additionally, in this embodiment, the operation portion 458 includes a bulging portion 500 of which an upper surface bulges upward. Upper and lower surfaces of the bulging portion 500 bulge upward. The upper and lower surfaces of the bulging portion 500 are formed in a curved surface shape which protrudes upward. The lower surface of the bulging portion 500 may be flat.

Here, the operation portion 458 is formed in a protruding curved surface shape which extends gradually upward as it is away from an outer circumferential portion in which the easily deformable portion 464 is formed and the second valve body 416. The bulging portion 500 is disposed at a portion of the operation portion 458 which includes the container axis O and is located on the side opposite to the side in which the second valve body 416 is displaced with respect to the container axis O. In the illustrated example, the bulging portion 500 is the entire portion of the operation portion 458 located rearward from the second valve body 416.

The bulging portion 500 has a bulging height toward the upper side which is higher than that of a portion of the operation portion 458 located forward from the second valve body 416. Positions of an upper surface of the uppermost portion of the bulging portion 500 and an upper end portion of the raised portion 462 of the middle lid 414 in the vertical direction Z are equal to each other. A top portion of the bulging portion 500 is located rearward from the container axis O. The top portion of the bulging portion 500 is located at a center of the operation portion 458 in the right and left direction Y. The bulging portion 500 faces the communication hole 456 and the first valve body 415 in the vertical direction Z.

The easily deformable portion 464 of which a length is changeable is formed on at least a part of the bulging portion 500. In the illustrated example, a portion of the outer circumferential portion of the operation portion 458 which is located rearward from the second valve body 416 coincides with a portion of an outer circumferential edge portion of the bulging portion 500, and the easily deformable portion 464 of the operation portion 458 is located at a part of the outer circumferential edge portion of the bulging portion 500. Therefore, the easily deformable portion 464 is formed over a half or more of the outer circumferential edge portion of the bulging portion 500. The easily deformable portion 464 is formed to be thinner than others in the bulging portion 500. Instead of the easily deformable portion 464 formed to be thin, for example, a soft material portion or the like formed of a material softer than a material which forms a bellows portion formed by folding at least a part of the bulging portion 500 or other parts of the bulging portion 500 may be employed.

A thickness of the bulging portion 500 is, for example, about 0.4 mm or more and 2.0 mm or less. A bulging height of the bulging portion 500, that is, a distance between the upper surface of the top of the bulging portion 500 and the upper surface of the outer circumferential portion of the operation portion 558 in the vertical direction Z is, for example, about 0.1 mm or more and 7.0 mm or less, preferably 0.5 mm or more and 5.0 mm or less. For example, the bulging height of the bulging portion 500 is preferably lowered when rigidity of the bulging portion 500 is high, and is high when the rigidity of the bulging portion 500 is low. For example, when the bulging portion 500 is formed of soft polyethylene to have a thickness of about 1.0 mm, the bulging height of the bulging portion 500 may be about 1.0 mm, and when the bulging portion 500 is formed of an elastomer to have a thickness of about 1.0 mm, the bulging height of the bulging portion 500 may be about 2.0 mm. However, the bulging height of the bulging portion 500 may be appropriately set on the basis of physical properties of the material of the bulging portion 500 such as hardness and elastic modulus, operability of the bulging portion 500, and the like. In plan view, a ratio of a plane area of the bulging portion 500 to a plane area of the operation portion 458 is 20% or more. In this case, the ratio of the plane area of the bulging portion 500 to the plane area of the operation portion 458 is large, and thus good operability can be provided.

Next, a discharge method of the contents of the compact container 410 of the embodiment will be described.

When the compact container 410 is in an unused state, the contents are accommodated only in the accommodation space 445, and the communication space 465 is filled with, for example, air. First, the user operates the push piece 437 to open the lid member 422 of the outer shell 411 and then presses the bulging portion 500 to be elastically deformed and thus to be recessed downward. When the bulging portion 500 is elastically deformed to be recessed downward, a volume of the communication space 465 is reduced, and thus an internal pressure of the communication space 465 increases. That is, the internal pressure of the communication space 465 is increased by the downward movement of the bulging portion 500. Then, the second valve body 416 bulges and is elastically deformed upward by the internal pressure of the communication space 465 and is separated from the second valve seat portion 467, the closed state of the discharge hole 466 is released, and some of the air in the communication space 465 is discharged from the discharge hole 466 to the outside. Thereafter, the second valve body 416 is deformed and restored to be seated on the second valve seat portion 467 and closes the discharge hole 466. At this time, since the first valve body 415 blocks movement of the fluid from the communication space 465 to the accommodation space 445, the communication hole 456 is closed by the first valve body 415, and a flow of the air in the communication space 465 from the communication hole 456 to the accommodation space 445 is suppressed. In this way, when the internal pressure of the communication space 465 is increased by the downward movement of the bulging portion 500, the first valve body 415 blocks the communication between the communication hole 456 and the communication space 465, and the second valve body 416 causes the discharge hole 466 to communicate with the communication space 465.

Next, the user releases the pressing force applied to the bulging portion 500 and restores and deforms the elastically deformed bulging portion 500 to the original state. Thus, the volume of the communication space 465 increases, and the pressure in the communication space 465 becomes negative. That is, as the bulging portion 500 which has moved downward is moved upward to the original position, the internal pressure of the communication space 465 is lowered. At this time, since the discharge hole 466 is closed by the second valve body 416, entry of air into the communication space 465 from the outside is suppressed. Thus, the contents in the accommodation space 445 are suctioned up into the communication space 465 through the communication hole 456. Since the first valve body 415 allows the flow of the fluid from the accommodation space 445 to the communication space 465, the first valve body 415 is in a state in which the communication hole 456 and the communication space 465 communicates with each other and thus does not inhibit the flow of the contents. Accordingly, the contents flow into the communication space 465. In this way, when the internal pressure of the communication space 465 is lowered by upward movement of the bulging portion 500, the second valve body 416 blocks the communication between the discharge hole 466 and the communication space 465, and the first valve body 415 causes the communication hole 456 to communicate with the communication space 465.

The user can discharge the air of the communication space 465 to the outside and can fill the communication space 465 with the contents by performing the elastic deformation and the restoring deformation of the bulging portion 500 a plurality of times. Here, since the inner container 412 has flexibility and is reduced in volume (deformed to be reduced in volume) by the contents flowing out to the communication space 465 through the communication hole 456, when the internal pressure of the accommodation space 445 decreases as the contents decrease, the inner container 412 is deformed and contacted, and the volume of the accommodation space 445 decreases. Thus, even when the contents flow into the communication space 465 and the total amount of the contents in the accommodation space 445 decreases, it is possible to stably send the contents from the accommodation space 445 to the communication space 465.

When the bulging portion 500 is elastically deformed in a state in which the contents are filled in the communication space 465, the internal pressure of the communication space 465 increases. Thus, the second valve body 416 bulges and is deformed upward, and the closing of the discharge hole 466 is released. Therefore, the contents pushed out from the communication space 465 are discharged from the discharge hole 466 to the outside. In this way, the user can discharge the contents. The contents are discharged from the discharge hole 466 to the inside of the raised portion 462 on the upper surface of the middle lid 414. Therefore, overflowing of the contents from the upper surface of the middle lid 414 can be curbed. The user wipes the upper surface of the middle lid 414 with a puff P or the like, and the contents become adhered to the puff P or the like and then the contents are used.

As described above, according to the compact container 410 of the embodiment, the user can increase or decrease the internal pressure of the communication space 465 by pressing the bulging portion 500 or releasing the pressing and thus elastically deforming the bulging portion 500, can make the inside of the communication space 465 be a negative pressure, can cause the contents to flow in the inner container 412 into the communication space 465 and thus can fill the communication space 465 with the contents. In this state, when the bulging portion 500 is pressed to increase the internal pressure of the communication space 465, the contents can be discharged from the discharge hole 466 by an amount corresponding to the increase in the internal pressure of the communication space 465. In this way, the contents can be stably suctioned from the inner container 412 into the communication space 465, and the discharge amount of the contents can be made as desired when the bulging portion 500 is pressed the next time. Thus, adjustment of the discharge amount of the contents is easy.

Further, since the upper surface of the bulging portion 500 bulges upward, it is possible to reduce the force required to press the bulging portion 500 and to discharge the contents, and for example, even when the bulging portion 500 is pressed while the upper surface of the operation portion 458 is softly touched with a finger, the contents can be discharged smoothly. Moreover, since the upper and lower surfaces of the bulging portion 500 bulge upward, they can be easily restored and deformed upward.

Moreover, since the bulging portion 500 is formed in the curved surface shape which protrudes upward, it is possible to reduce reliably the force required to press the bulging portion 500 and to discharge the contents, and for example, when the bulging portion 500 is pressed while the upper surface of the operation portion 458 is softly touched with a finger, the upper surface of the bulging portion 500 can be smoothly slid without being caught by the finger. Further, since the easily deformable portion 464 of which the length is changeable is formed in the bulging portion 500, it is possible to change the length of the easily deformable portion 464 when the bulging portion 500 is pressed. Even when the pressing force does not excessively increase, a large amount of elastic deformation of the bulging portion 500 in the vertical direction Z can be secured.

Moreover, since the bulging height of the bulging portion 500 is 0.1 mm or more and 7.0 mm or less, the force required to press the bulging portion 500 to discharge the contents can be reliably reduced without obstructing the exterior of the compact container 410 when the lid member 422 is opened and the accommodation space between the upper surface of the operation portion 458 and the lower surface side of the lid member 422, or the like, and also the good operability can be provided. In particular, when the bulging height of the bulging portion 500 is set to 0.5 mm or more and 5.0 mm or less, such effects can be surely achieved.

When the bulging height of the bulging portion 500 is less than 0.1 mm, the force required to press the bulging portion 500 to discharge the contents cannot be reduced. Also, when the bulging height of the bulging portion 500 is more than 7.0 mm, the exterior of the compact container 410 at the time of opening the lid member 422 is deteriorated, or the accommodation space between the upper surface of the operation portion 458 and the lower surface side of the lid member 422 is narrowed, and thus the stored applicator or the like may be unstable. Further, when the contents are discharged by pressing the bulging portion 500 while the upper surface of the operation portion 458 is softly touched, a finger may be caught by the bulging portion 500, and thus the good operability may be deteriorated.

Seventh Embodiment

Figure 15:
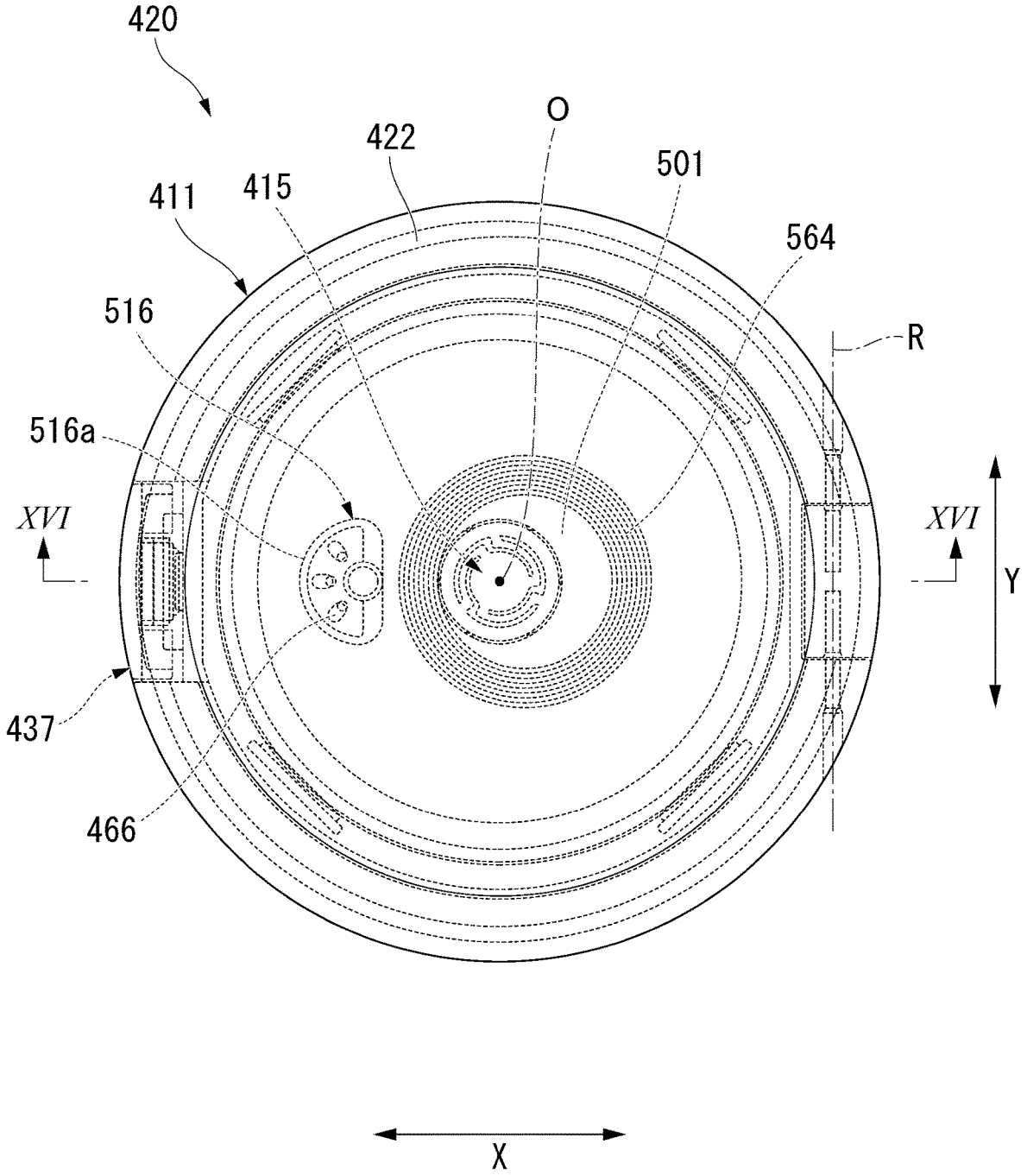
FIG. 15 is a top view showing a compact container of a seventh embodiment.
Figure 16:
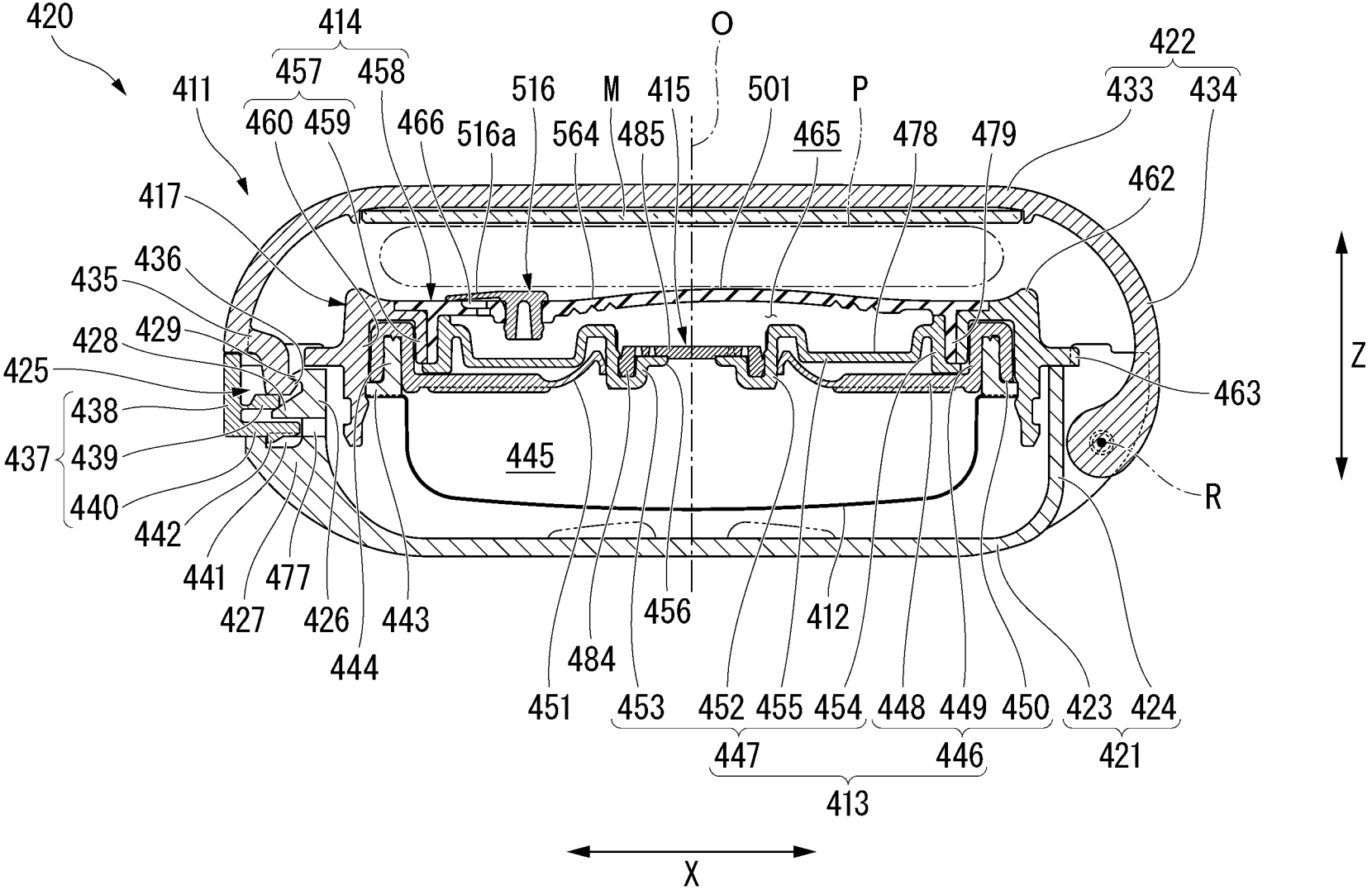
FIG. 16 is a cutaway perspective view taken along line XVI-XVI in FIG. 14.

Next, a seventh embodiment according to the present invention will be described, but the basic constitution is the same as that in the sixth embodiment. Thus, the same reference numerals are used for the same structures, the description thereof will be omitted, and only a different point will be described. In a compact container 420 of the embodiment, as shown in FIG. 15 and FIG. 16, the recessed portion 478 formed in the connection annular portion 455 of the inner lid 413 is formed in an annular shape which extends continuously over the entire circumference and is disposed coaxially with the container axis O. The second valve seat portion 467 is not disposed on the bottom surface of the recessed portion 478.

A second valve body 516 which switches between the communication and the blocking between the discharge hole 466 of the middle lid 414 and the communication space 465 is separate from the operation portion 458. The second valve body 516 includes a mounting portion which is fitted into a mounting hole formed in a portion of the operation portion 458 located rearward from the discharge hole 466, and a valve portion 516*a* which is disposed on the upper surface of the operation portion 458 to be separated upward and covers the discharge hole 466 to be openable. The valve portion 516*a* is formed in a plate shape which is elastically deformable. The mounting portion is disposed at a central portion of a rear end portion of the valve portion 516*a* in the right and left direction Y. The valve portion 516*a* has a triangular shape in plan view and is disposed so that two of three corner portions thereof are located on both sides of the mounting portion in the right and left direction Y and the remaining one is located in front of the mounting portion. These three corner portions have a protruding curved surface shape in plan view.

Additionally, a bulging portion 501 having a circular shape in plan view is formed in a portion of the operation portion 458 which is located rearward from the second valve body 516 and defines the communication space 465. A central axis of the bulging portion 501 is located rearward with respect to the container axis O and extends in parallel. The central axis of the bulging portion 501 is located at a center of the operation portion 458 in the right and left direction Y. The easily deformable portion 564 is formed in an annular shape and is disposed coaxially with the central axis of the bulging portion 501. The easily deformable portion 564 is formed over the entire circumference of the outer circumferential edge portion of the bulging portion 501. A plurality of annular grooves which are recessed upward are formed in a lower surface of a portion of the operation portion 458 at which the easily deformable portion 564 is located. The annular groove has a groove width which is narrowed toward the upper side to have a groove bottom portion which becomes sharper toward the upper side.

In the above-described constitution, when the bulging portion 501 is pressed, the front side of the valve portion 516*a* of the second valve body 516 opposite to the bulging portion 501 side is separated from the upper surface of the operation portion 458, and the contents are discharged. According to the compact container 420 of the embodiment, since the easily deformable portion 564 is formed over the entire circumferential of the outer circumferential edge portion of the bulging portion 501, the plurality of annular grooves are formed at the portion of the operation portion 458 in which the easily deformable portion 564 is located, and the force required to press the bulging portion 501 to discharge the contents can also be further reliably reduced.

Eighth Embodiment

Next, an eighth embodiment according to the present invention will be described, but the basic constitution is the same as that in the seventh embodiment. Thus, the same reference numerals are used for the same structures, the description thereof will be omitted, and only a different point will be described.

Figure 17:
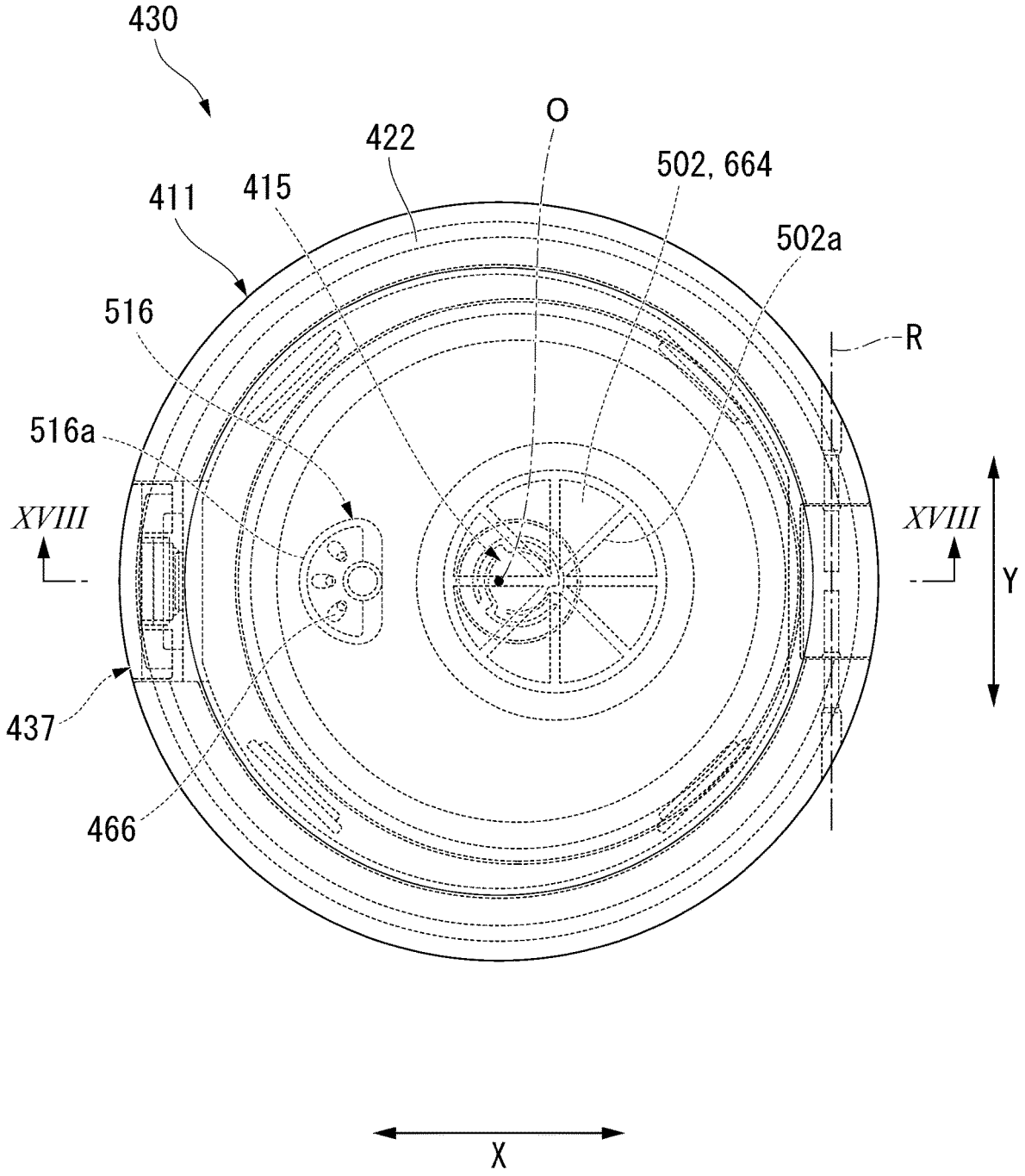
FIG. 17 is a top view showing a compact container of an eighth embodiment.
Figure 18:
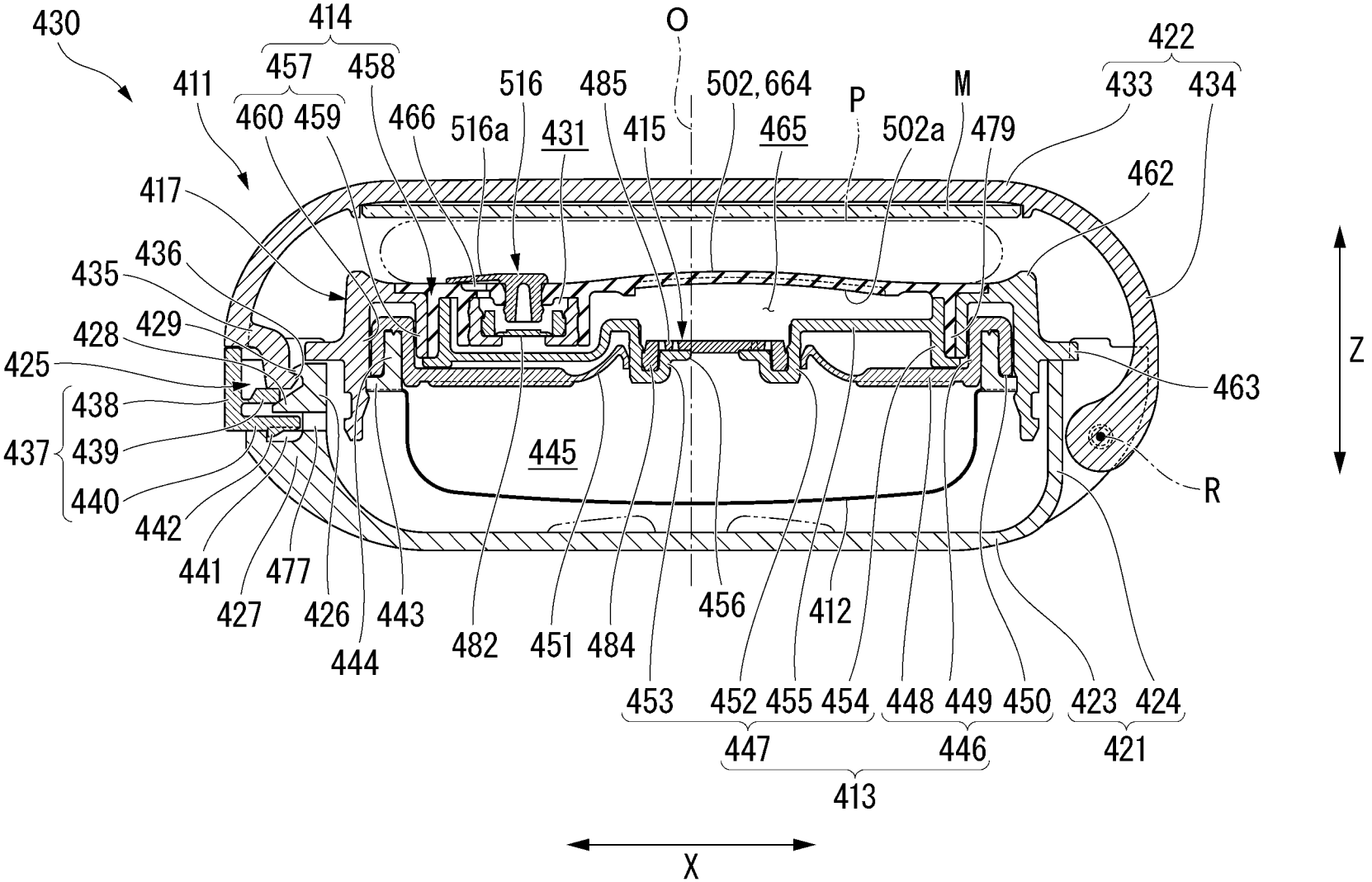
FIG. 18 is a cutaway perspective view taken along line XVIII-XVIII in FIG. 17.

In a compact container 430 of the embodiment, as shown in FIGS. 17 and 18, the central axis of the communication hole 456 is displaced rearward from the container axis O, and the recessed portion 478 formed in the connection annular portion 455 of the inner lid 413 does not extend continuously over the entire circumference and is disposed at a position which faces at least the discharge hole 466.

A sub space 431 which communicates with the discharge hole 466 is defined in the communication space 465, and a sub valve body 482 which switches between communication and blocking between the sub space 431 and the communication hole 456. The sub space 431 is directly connected to the lower side of the discharge hole 466, and an internal volume thereof is less than a half of an internal volume of the communication space 465. The sub valve body 482 is a check valve which allows the flow of the contents directed from the communication hole 456 to the sub space 431 but prevents the flow of the contents from the sub space 431 toward the communication hole 456. The sub valve body 482 is opened when a bulging portion 502 is moved downward to reduce the volume of the communication space 465 and to increase the internal pressure of the communication space 465 and is closed when the sub space 431 is brought into communication with the communication hole 456 side, the bulging portion 502 is moved and restored upward to increase the volume of the communication space 465 and the communication space 465 has a negative pressure, and thus the communication between the sub space 431 and the communication hole 456 is blocked.

The easily deformable portion 664 is formed over the entire region of the portion of the operation portion 458 at which the bulging portion 502 is located. That is, the easily deformable portion 664 has a circular shape in plan view and is disposed coaxially with a central axis of the bulging portion 502, and the bulging portion 502 has the smallest thickness in the operation portion 458. A reinforcing rib 502*a* is formed on a lower surface of the bulging portion 502. The reinforcing rib 502*a* is disposed radially so that the reinforcing rib 502*a* passes through the central axis of the bulging portion 502 and both ends thereof reach an outer circumferential edge portion of the bulging portion 502.

According to the compact container 430 of the embodiment, since the easily deformable portion 664 is formed over the entire region of the bulging portion 502, the force required to press the bulging portion 501 to discharge the contents can be reliably reduced. Moreover, since the reinforcing rib 502*a* is formed on the lower surface of the bulging portion 502, even when the easily deformable portion 664 is formed over the entire region of the bulging portion 502, it is possible to secure a spring constant of the bulging portion 502, and it is possible to suppress the bulging portion 502 from being difficult to be restored and deformed upward.

The technical scope of the present invention is not limited to the above-described embodiments. For example, as described below, various modifications can be made to the above-described embodiments without departing from the spirit of the present invention.

In the above-described embodiments, the bulging portions 500, 501, and 502 have a constitution formed in a curved surface shape which protrudes upward but may adopt, for example, a constitution formed in a frustum shape or a step shape. Further, the easily deformable portions 464, 564, and 664 may not be formed in the bulging portions 500, 501, and 502. Moreover, although the constitution which faces the communicating hole 456 and the first valve body 415 in the vertical direction Z has been shown as the bulging portions 500, 501, and 502, the bulging portions 500, 501, and 502 may be disposed to be displaced with respect to the communication hole 456 and the first valve body 415 in a direction orthogonal to the vertical direction Z.

The shapes of the bulging portions 500, 501, and 502 in plan view are not particularly limited and may be an elliptical shape, may be a triangular shape, may be a quadrangular shape, and may be a polygonal shape having five or more sides. Further, the shape of the inner container 412 is not particularly limited and may be, for example, an elliptical tubular shape or an angular tubular shape. In addition, the inner container 412, the inner lid 413, and the middle lid 414 may not constitute the refill container 417. That is, when the contents are used up, the inner container 412 may not be replaced.

Also, even when the middle lid 414 may not have the mounting ring 457 and may have the elastically deformable operation portion 458 formed in a tubular shape with a top, the operation portion 458 may be mounted on the inner lid 413. The discharge hole 466 may not be formed in the operation portion 458. For example, a flange which protrudes radially inward and defines the communication space 465 may be provided at the mounting ring 457, and the discharge hole 466 may be provided in the flange. Only one discharge hole 466 may be formed. As the contents flow out into the communication space 465 through the communication hole 456, the volume of the inner container 412 may not be reduced. The inner container 412 may have a non-flexible constitution.

Further, the compact container 410 of the sixth embodiment includes the second valve body 416 provided on the middle lid 414, and the second valve seat portion 467 provided on the inner lid 413, blocks the communication between the discharge hole 466 and the communication space 465 by the second valve body 416 being seated on the second valve seat portion 467, and communicates the discharge hole 466 with the communication space 465 by the second valve body 416 being elastically deformed to be separated upward from the second valve seat portion 467. However, the compact container 410 of the sixth embodiment is not limited thereto. The compact container 410 of the sixth embodiment may include, for example, a valve seat portion which is mounted on the middle lid 414, instead of the second valve seat portion 467 provided on the inner lid 413. For example, the second valve body 370 of the compact container of the fifth embodiment may be adopted as such a valve seat portion.

In addition, it is possible to replace components in the embodiments with known components as appropriate without departing from the spirit of the present invention, and the above-described modified examples may also be appropriately combined with the embodiments.

With respect to the above-described first to eighth embodiments, the technical scope of the present invention is not limited to the above-described embodiments, and various modifications can be made to the first to eighth embodiments without departing from the spirit of the present invention. For example, the elements of the first to eighth embodiments may be combined with one other elements as appropriate without departing from the spirit of the present invention.

INDUSTRIAL APPLICABILITY

According to the present invention, a compact container can be provided in which adjustment of a discharge amount of the contents is easy.

REFERENCE SIGNS LIST

10, 80, 190, 201A, 301B, 410, 420, 430 Compact container
11, 111, 207, 307, 411 Outer shell
12, 112, 202, 302, 412 Inner container
13, 113, 203, 302, 413 Inner lid
14, 114, 204, 304, 414 Middle lid
15, 115, 205, 305, 415 First valve body
16, 116, 206, 370, 416 Second valve body
56, 156, 221*a*, 321*a*, 456 Communication hole
58, 158, 233, 333, 458 Operation portion
64, 164 Thin portion
65, 165, S1, S4, 465 Communication space
66, 166, 234*a*, 304*a*, 466 Discharge hole
198 Biasing portion
464, 564, 664 Easily deformable portion
500, 501, 502 Bulging portion

The invention claimed is:

1. A compact container comprising:

an inner container in which contents are accommodated;

an inner lid which seals an inside of the inner container, the inner lid including a communication hole communicating with the inner container;

a middle lid which is disposed above the inner lid, the middle lid defining a communication space communicating with the communication hole between the middle lid and the inner lid, and the middle lid including a discharge hole communicating with the communication space and discharging the contents from the communication space;

a first valve body which switches between communication and blocking of flow of contents between the communication hole and the communication space; and a second valve body which switches between communication and blocking of flow of contents between the discharge hole and the communication space, wherein:

the middle lid includes an elastically deformable operation portion which defines the communication space, the operation portion increases or decreases an internal pressure of the communication space by being elastically deformed, and the operation portion includes an annular thin portion formed by indenting a lower surface of the operation portion upward, when the internal pressure of the communication space is increased by the operation portion, the first valve body blocks communication between the communication hole and the communication space, and the second valve body allows communication between the discharge hole and the communication space, and when the internal pressure of the communication space is decreased by the operation portion, the second valve body blocks communication between the discharge hole and the communication space, and the first valve body allows communication between the communication hole and the communication space.

2. The compact container according to claim 1, further comprising an outer shell which covers the inner container, the inner lid and the middle lid, wherein a volume of the inner container is reduced as the contents flow out of the inner container into the communication space through the communication hole.

3. The compact container according to claim 1, further comprising a biasing portion which biases the operation portion upward when the operation portion has moved downward.

* * * * *